US006695712B1

(12) United States Patent
Iwata et al.

(10) Patent No.: US 6,695,712 B1
(45) Date of Patent: Feb. 24, 2004

(54) GOLF CLUB HEAD, IRON GOLF CLUB HEAD, WOOD GOLF CLUB HEAD, AND GOLF CLUB SET

(75) Inventors: Mototaka Iwata, Osaka (JP); Hiroshi Nagao, Osaka (JP); Kanta Shimotaka, Osaka (JP); Kei Tsuji, Osaka (JP); Koji Sakai, Oaska (JP); Takashi Kimura, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/701,817

(22) PCT Filed: Apr. 3, 2000

(86) PCT No.: PCT/JP00/02162

§ 371 (c)(1),
(2), (4) Date: Dec. 1, 2000

(87) PCT Pub. No.: WO00/59585

PCT Pub. Date: Oct. 12, 2000

(30) Foreign Application Priority Data

| | | |
|---|---|---|
| Apr. 5, 1999 | (JP) | 11-097990 |
| Sep. 14, 1999 | (JP) | 11-260743 |
| Sep. 14, 1999 | (JP) | 11-260845 |
| Jan. 20, 2000 | (JP) | 2000-012304 |

(51) Int. Cl.[7] ..... A63B 53/04
(52) U.S. Cl. ..... 473/291; 473/345; 473/350
(58) Field of Search ..... 473/250, 291, 473/345, 350

(56) References Cited

U.S. PATENT DOCUMENTS

| | | | | |
|---|---|---|---|---|
| 5,309,753 | A | * | 5/1994 | Johnson |
| 5,335,914 | A | | 8/1994 | Long |
| 5,366,223 | A | | 11/1994 | Werner |
| 5,375,840 | A | | 12/1994 | Hirsch et al. |
| 5,447,309 | A | | 9/1995 | Vincent |
| 5,613,917 | A | * | 3/1997 | Kobayashi |
| 5,643,103 | A | | 7/1997 | Aizawa ..... 473/290 |
| 5,836,830 | A | | 11/1998 | Onuki et al. |
| 5,935,018 | A | * | 8/1999 | Takeda |
| 6,045,455 | A | * | 4/2000 | Kosmatka et al. ..... 473/291 |
| 6,093,112 | A | * | 7/2000 | Peters |

FOREIGN PATENT DOCUMENTS

| | | | |
|---|---|---|---|
| JP | 1300970 | 12/1989 | ..... A63B/53/04 |
| JP | 7-67991 | 3/1995 | ..... A63B/53/04 |
| JP | 9149954 | 6/1997 | ..... A63B/53/04 |
| JP | 9-154984 | 6/1997 | ..... A63B/53/04 |
| JP | 10225540 | * 8/1998 | |
| TW | 234903 | 11/1994 | |
| TW | 296633 | 1/1997 | |
| TW | 322789 | 12/1997 | |
| TW | 353028 | 2/1999 | |
| WO | WO 92/15374 | 9/1992 | |

OTHER PUBLICATIONS

International Publication No. WO 98/31433; Jul. 1998 (original and correction version).
Taiwanese Office Action dated Oct. 14, 2002 and English Translation, Application No. 91101363.
Taiwanese Office Action dated Mar. 13, 2003 and English Translation, Application No. 91101364.

* cited by examiner

*Primary Examiner*—Stephen Blau
(74) *Attorney, Agent, or Firm*—Troutman Sanders LLP; Ryan A. Schneider, Esq.; Gerald R. Boss, Esq.

(57) ABSTRACT

A golf club head (11) has an ellipsoid of inertia (12) with its center at a center of gravity G. When the ellipsoid of inertia (12) is virtually cut with a plane passing through the center of gravity of the golf club head (11) and being parallel to a face surface (11*f*), a major axis of a plane ellipse (13) appearing on its cut surface forms an angle of θ with an intersecting line (15) of the cut surface and a ground surface (16). The major axis extends upward and away from the ground surface (16) as it approaches a toe part (11*t*). The angle θ is not smaller than 0.5° and not larger than 9.5°. An aspect ratio a/b defined by a ratio of the length a of the major axis (13*d*) to the length b of a minor axis (13*e*) of the plane ellipse (13) is not smaller than 1 and not larger than 4.

33 Claims, 59 Drawing Sheets

LATERAL DEVIATION AND FLYING DISTANCE
(CONVENTIONAL PRODUCT)

GOLF CLUB HEAD, IRON GOLF CLUB HEAD, WOOD GOLF CLUB HEAD, AND GOLF CLUB SET

This application claims priority based on the following; PCT Application No. PCT/JP00/02162 filed Apr. 3, 2000; Japanese patent application No. 11-097990(P) filed Apr. 5, 1999; Japanese patent application No. 11-260743(P) filed Sep. 14, 1999; Japanese patent application No. 11-260845 (P) filed Sep. 14, 1999; and Japanese patent application No. 2000–012304(P) filed Jan. 20, 2000, entitled "Golf Club Head, Iron Golf Club Head, Wood Gold Club Head, and Golf Club Set."

TECHNICAL FIELD

The present invention generally relates to a golf club head, an iron golf club head, a wood golf club head, and a golf club set. Specifically, it relates to a golf club head, an iron golf club head, a wood golf club head that can improve the directivity of a flying ball and increase the flying distance by restraining the rotation of the golf club head in striking a golf ball with the golf club head, and a golf club set using the golf club heads.

BACKGROUND OF THE INVENTION

The first conventional example of a golf club head is described in Japanese Patent Application Laid-open No. 07-67991(1995). In this document, the toe weight and the hosel weight have a center of mass positioned above the horizontal line that passes through the center of gravity of the golf club head when the gold club head is in an addressed position.

Further, the second conventional example is described in Japanese Patent Application Laid-open No. 09-149954 (1997). In this document, X-axis, Y-axis, and Z-axis that intersect perpendicularly to each other are set using the center of gravity of the gold club head as an origin. The angle formed by X-axis and the line obtained by projecting onto XZ-plane the principal axis of inertia having the smallest angle with X-axis among the three principal axes of inertia of the golf club head that intersect perpendicularly to each other, is not smaller than 10° and not larger than 40°.

Further, a wood golf club as the third conventional example is described in Japanese Patent Application Laid-open No. 01-300970(1989). This document discloses a technique of providing a horizontal principal axis of inertia by setting the weight of the hosel part to be not larger than 5% of the weight of the golf club head body and setting the length of the hosel part to be not larger than 4 cm.

Further, as a technique for improving the directivity of a hit ball, a technique of increasing the moment of inertia of a golf club head is known. As the fourth conventional example, a so-called cavity structure is known in which a cavity part is provided in the inside of an iron golf club head body and the peripheral part is made thick to increase the moment of inertia. Also, as the fifth conventional example, a hollow structure is known in which the inside of an iron golf club head is made into a complete cavity.

The flying distance and the directivity of a hit ball may be mentioned as the characteristics required in a golf club. Particularly, the directivity is a great factor that is related to fairway keep and green keep, and gives an influence on the score. The directivity is determined by the position (hitting point position) at which the golf club head is brought into contact with a golf ball. Apart from professional golfers and top amateurs, most of the general players strike the golf ball at various locations on the upper side, the lower side, the right side, and the left side of the face surface of the golf club head. For this reason, the directivity of the hit ball decreases if the golf ball impinges on the position out of the center of gravity, although the directivity of the hit ball is good if the golf ball impinges on a neighborhood of the center of gravity of the golf club head.

Thus, in order to prevent decrease in the directivity even if the golf ball impinges on a position located away from the center of gravity of the golf club head, a method of increasing the moment of inertia of the golf club head, particularly the moment of inertia in the direction from the toe part to the heel part of the golf club when the golf club head is placed on a plane, is proposed.

The first conventional example does not disclose a technique of restraining the rotation of the golf club head at the time of striking. The second conventional example does not disclose a technique of restraining the rotation of the golf club head at the time of striking, either.

Also, the distribution shape of the variation of the points at which: the golf ball impinges on the face surface has a width in the up-and-down direction of the face surface. Further, the shape of the variation changes depending on the golf clubs having different identification numbers. For this reason, it is necessary not only to improve the directivity of the hit ball in the right-and-left direction but also to reduce the variation of the flying distance.

Furthermore, the aforesaid third example involves a problem that the variation of the flying distance of the hit ball cannot be reduced.

Further, even the aforesaid fourth and fifth conventional examples fail to disclose a technique of restraining the rotation of the golf club head.

Therefore, the object of the present invention is to provide a golf club head and a golf club set that can reduce the variation of the hit ball in the right-and-left direction and the variation of the flying distance.

DISCLOSURE OF THE INVENTION

A golf club head according to one aspect of the present invention has an ellipsoid of inertia with its center at the center of gravity. When the ellipsoid of inertia is virtually cut with a plane passing through the center of gravity of the golf club head and being parallel to a face surface, the major axis of a plane ellipse appearing on its cut surface forms an angle of θ with an intersecting line of the cut surface and the ground surface. The major axis extends upward and away from the ground surface as it approaches a toe part. The angle θ is not smaller than 0.5° and not larger than 9.5°. An aspect ratio a/b defined by a ratio of the length a of the major axis to the length b of the minor axis is not smaller than 1 and not larger than 4.

A golf club set according to one aspect of the present invention includes a plurality of golf clubs having different identification numbers. Each of the plurality of golf clubs has a golf club head and a shaft connected to the golf club head. Each of the golf club heads has an ellipsoid of inertia with its center at the center of gravity. When the ellipsoid of inertia is virtually cut with a plane passing through the center of gravity of the golf club head and being parallel to a face surface, the major axis of a plane ellipse appearing on its cut surface forms an angle of θ with an intersecting line of the cut surface and the ground surface. The major axis extends upward and away from the ground surface as it approaches a toe part. The angle θ is not smaller than 0.5° and not larger than 9.5°. An aspect ratio a/b defined by a ratio of the length a of the major axis to the length b of the minor axis is not smaller than 1 and not larger than 4. The angle θ of each of the plurality of golf club heads increases successively or remains approximately equal according as the identification number increases. The aspect ratio a/b of each of the plurality of golf club heads decreases successively or remains approximately equal according as the identification number increases.

Preferably, the angle θ increases successively with an approximately constant ratio according as the identification number of the golf club head increases.

Also, preferably, the aspect ratio a/b decreases successively with an approximately constant ratio according as the identification number of the golf club head increases.

A golf club head according to another aspect of the present invention has an ellipsoid of inertia with its center at the center of gravity. When the ellipsoid of inertia is virtually cut with a plane passing through the center of gravity of the golf club head and being parallel to a face surface, the major axis of a plane ellipse appearing on its cut surface forms an angle of θ with an intersecting line of the cut surface and the ground surface. The major axis extends upward and away from the ground surface as it approaches a toe part. The angle θ is not smaller than 0.50 and not larger than 9.5°. The height h of a sweet spot from the ground surface is not smaller than 10 mm and not larger than 30 mm.

A golf club set according to another aspect of the present invention includes a plurality of golf clubs having different identification numbers. Each of the plurality of golf clubs has a golf club head and a shaft connected to the golf club head. Each of the golf club heads has an ellipsoid of inertia with its center at the center of gravity. When the ellipsoid of inertia is virtually cut with a plane passing through the center of gravity of the golf club head and being parallel to a face surface, the major axis of a plane ellipse appearing on its cut surface forms an angle of θ with an intersecting line of the cut surface and the ground surface. The major axis extends upward and away from the ground surface as it approaches a toe part. The angle θ is not smaller than 0.5° and not larger than 9.5°. The angle θ of each of the plurality of golf club heads increases successively or remains approximately equal according as the identification number increases. The height h of the sweet spot of each of the plurality of golf club heads decreases successively or remains approximately equal according as the identification number increases.

Also, preferably, the angle θ increases successively with an approximately constant ratio according as the identification number of the golf club increases.

Also, preferably, the height h of the sweet spot decreases successively with an approximately constant ratio according as the identification number of the golf club increases.

A golf club head according to still another aspect of the present invention has an ellipsoid of inertia with its center at the center of gravity. When the ellipsoid of inertia is virtually cut with a plane passing through the center of gravity of the golf club head and being parallel to a face surface, an aspect ratio a/b defined by a ratio of the length a of the major axis to the length b of the minor axis of a plane ellipse appearing on its cut surface is not smaller than 1 and not larger than 4. The height h of a sweet spot from the ground surface is not smaller than 10 mm and not larger than 30 mm.

Also, preferably, the major axis forms an angle of θ with an intersecting line of the cut surface and the ground surface. The major axis extends upward and away from the ground surface as it approaches a toe part. The angle θ is not smaller than 0.5° and not larger than 9.5°.

A golf club set according to still another aspect of the present invention includes a plurality of golf clubs having different identification numbers. Each of the plurality of golf clubs has a golf club head and a shaft connected to the golf club head. Each of the golf club heads has an ellipsoid of inertia with its center at the center of gravity. When the ellipsoid of inertia is virtually cut with a plane passing through the center of gravity of the golf club head and being parallel to a face surface, an aspect ratio a/b defined by a ratio of the length a of the major axis to the length b of the minor axis of a plane ellipse appearing on its cut surface is not smaller than 1 and not larger than 4. The height h of a sweet spot from the ground surface is not smaller than 10 mm and not larger than 30 mm. The aspect ratio a/b of each of the plurality of golf club heads decreases successively or remains approximately equal according as the identification number increases. The height h of the sweet spot of each of the plurality of golf club heads decreases successively or remains approximately equal according as the identification number increases.

Also, preferably, the major axis forms an angle of θwith an intersecting line of the cut surface and the ground surface. The major axis extends upward and away from the ground surface as it approaches a toe part. The angle θ is not smaller than 0.5° and not larger than 9.5°. The angle θ of each of the plurality of golf club heads increases successively or remains approximately equal according as the identification number increases.

Also, preferably, the aspect ratio a/b decreases successively with an approximately constant ratio according as the identification number of the golf club increases.

Also, preferably, the height h of the sweet spot decreases successively with an approximately constant ratio according as the identification number of the golf club increases.

Also, preferably, the angle θ increases successively with an approximately constant ratio according as the identification number of the golf club increases.

An iron golf club head according to the present invention includes a head body having a toe, a sole, and a heel; a first weight member disposed in an upper part of the toe of the head body; and a second weight member disposed in a heel side part of the sole of the head body.

Preferably, the first weight member has a larger specific gravity than a material constituting the head body.

Preferably, the second weight member has a larger specific gravity than a material constituting the head body.

Preferably, the first weight member has a larger density than other parts of the head body.

Preferably, the second weight member has a larger density than other parts of the head body.

Preferably, the head body has a back cavity.

Preferably, the depth of the back cavity increases according as it approaches from a lower part of the toe to a heel part.

Preferably, the width of a sole part decreases according as it approaches from a lower part of the toe to a heel part.

Preferably, the head body has a through-hole, and further includes an insert member fitted into the through-hole so as to form a back cavity.

A wood golf club head according to the present invention includes a head body having a toe, a sole, and a back; a first weight member disposed in an upper part of the toe of the head body; and a second weight member disposed in a back part of the center of the sole of the head body.

Preferably, the first weight member has a larger specific gravity than a material constituting the head body.

Preferably, the second weight member has a larger specific gravity than a material constituting the head body.

Preferably, the first weight member includes a part having a larger thickness than other parts of the head body.

Preferably, the second weight member includes a part having a larger thickness than other parts of the head body.

Preferably, the first weight member has a larger density than other parts of the head body.

Preferably, the second weight member has a larger density than other parts of the head body.

Preferably, the first weight member includes a part having a larger specific gravity than a material constituting the head body, and a part having a larger thickness than other parts of the head body.

Preferably, the second weight member includes a part having a larger specific gravity than a material constituting the head body, and a part having a larger thickness than other parts of the head body.

Preferably, the first and second weight members have a larger specific gravity than a material constituting the head body.

BEST MODES FOR CARRYING OUT THE INVENTION

Figure 1A:
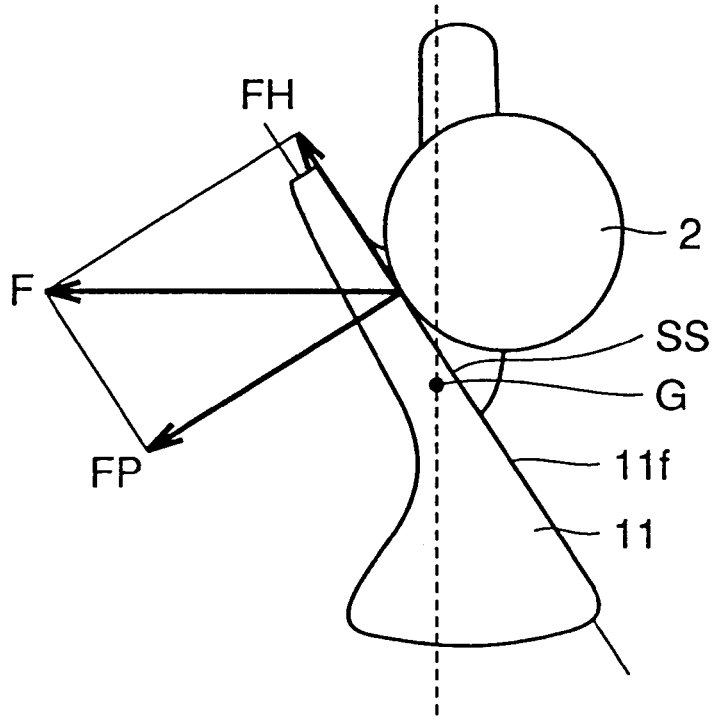
FIGS. 1A and 1B are views for explaining the principle of the present invention.
Figure 1B:
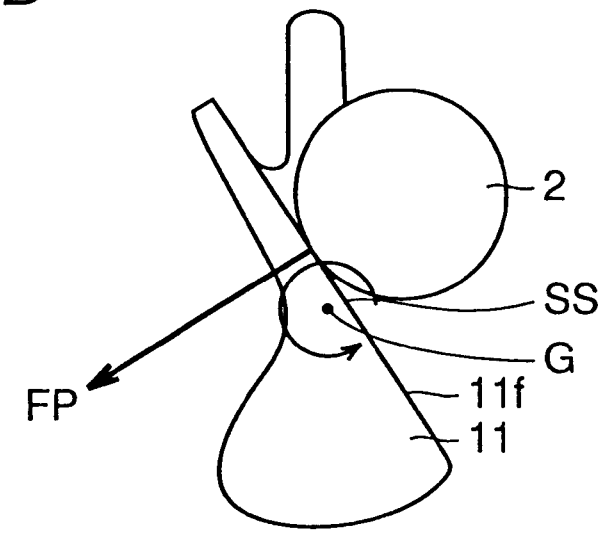

FIGS. 1A and 1B are views for explaining the principle of the present invention. FIG. 1A is a view for explaining a striking force generated on a face surface when a golf ball is hit with a golf club head. FIG. 1B is a view showing a state in which the face is rotated and the ball flies out at the striking time.

Referring to FIG. 1A, when a golf ball is struck with a golf club, a golf club head 11 receives a striking force F from the golf ball 2 in the proceeding direction of the swing at the hitting point position of the golf ball. In the golf club, an angle is formed between a sole and a face surface 11*f* in order to change the flying-out angle of the golf ball 2 in accordance with the identification number and to obtain a flying distance for each identification number. This angle is referred to as a loft angle. Typically, the loft angle is set to be about 10° in the case of a driver, about 20° in the case of a third iron, and about 40° in the case of a ninth iron. The loft angle increases according as the identification number increases.

Due to the presence of the loft angle, the striking force F at the striking time can be decomposed into a horizontal partial force FH and a perpendicular partial force FP with respect to the face surface 11*f*. The horizontal partial force FH is a force that rotates the golf ball 2 together with a frictional force of the face surface 11*f*, namely, it generates a back spin or a side spin. According as the swing speed increases and the impacting speed of the golf club head increases, the striking force F increases and the horizontal partial force FH increases, so that the back spin and the side spin are more likely to be generated. The ball trajectory of an iron of a professional golfer rises high above after the shot, and then falls vertically from above. This is due to the fact that, since the head speed is high, a back spin is generated, and the ball floats upward and falls down.

Also, the perpendicular partial force FP is a force that acts perpendicularly on the face surface 11*f*, as shown in FIG. 1B, and this force rotates the face surface 11*f*. By this rotation, the golf ball 2 after the shot flies out in the right-and-left direction and in the up-and-down direction. On the other hand, the point at which the line drawn perpendicularly from the center of gravity G of the golf club head 11 to the face surface 11*f* intersects the face surface 11*f* here is referred to as a sweet spot SS. The sweet spot SS is a point by which the golf ball flies most and, if the ball is struck here, the golf club head 11 rotates little. However, if a general players performs a shot, the ball hardly hits the sweet spot SS, and the player performs a shot in the neighborhood of the sweet spot SS.

Figure 2A:
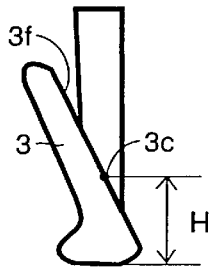
FIGS. 2A and 2B are views showing a distribution of hitting points when a general player hits a ball with a third iron.
Figure 2B:
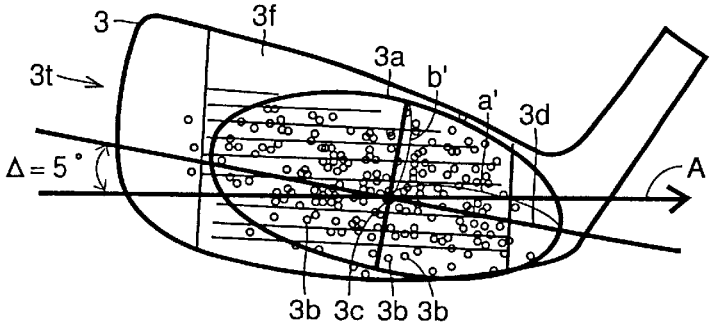
Figure 3A:
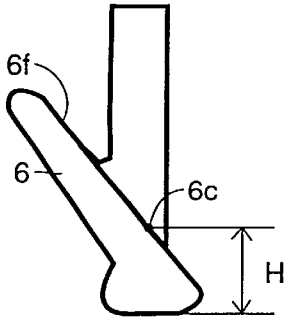
FIGS. 3A and 3B are views showing a distribution of hitting points when a general player hits a ball with a sixth iron.
Figure 3B:
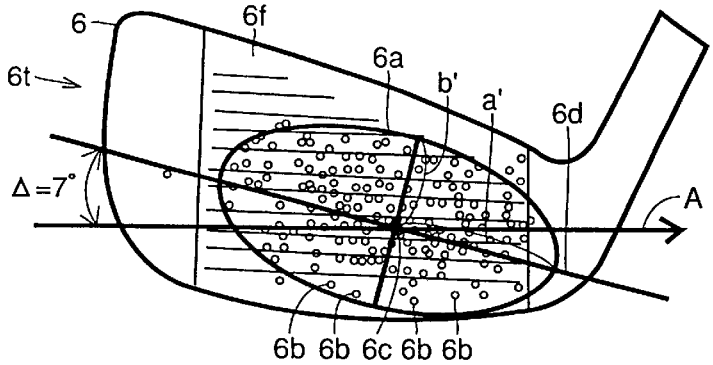
Figure 4A:
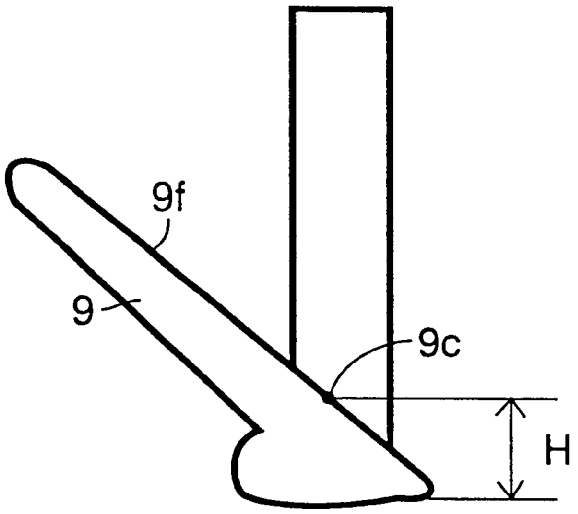
FIGS. 4A and 4B are views showing a distribution of hitting points when a general player hits a ball with a ninth iron.
Figure 4B:
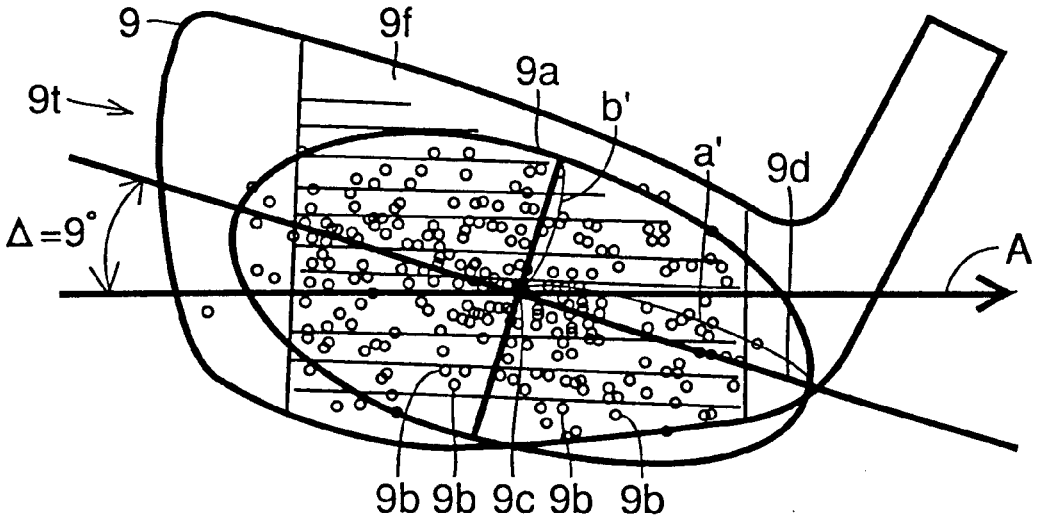

FIGS. 2A to 4B are views showing a distribution of the hitting points of a general player. FIGS. 2A and 2B show a distribution of the hitting points by a third iron golf club. FIGS. 3A and 3B show a distribution of the hitting points by a sixth iron golf club. FIGS. 4A and 4B show a distribution of the hitting points by a ninth iron golf club. As will be clear from FIGS. 2A to 4B, it is understood that a general player strikes at various positions up and down and to the right and left near the sweet spot SS. The player from whom these data have been obtained has a golf score of about 100 and is an average player. In the Figures, the points 3*b*, 6*b*, and 9*b* represent hit marks on the face surfaces 3*f*, 6*f*, and 9*f* of the golf club heads 3, 6, and 9. The hitting point centers are represented by points 3*c*, 6*c*, and 9*c*. Ellipses 3*a*, 6*a*, and 9*a* that approximate the size and the shape of the hitting point distribution by determining an interval covering not less than 95% of the hit marks are shown in a solid line. Further, the A-axis passing through the hitting point centers 3*c*, 6*c*, and 9*c* of the face surfaces 3*f*, 6*f*, and 9*f* and being parallel to the intersecting line of the face surfaces 3*f*, 6*f*, and 9*f* and the ground surface, as well as the major axes 3*d*, 6*d*, and 9*d* of the ellipses 3*a*, 6*a*, and 9*a* approximating the variation of the hitting points, are shown in solid lines.

From this result, the player strikes a golf ball at various locations up and down and to the right and left of the face surfaces 3*f*, 6*f*, and 9*f* of the golf club heads 3, 6, and 9. It is understood that the hitting points are varied in the right-and-left direction from the toe side to the heel side and in the up-and-down direction from the leading edge to the top edge. Since this variation degrades the directivity of the ball after hitting the ball, it is necessary to produce a golf club head that maintains the directivity to some extent even if the hitting points are varied.

On the other hand, as will be seen from the results of the hitting point distribution, the shape of the hitting point distribution is a shape of the ellipses 3*a*, 6*a*, and 9*a* having a major axis and a minor axis. Further, the angle that the major axes 3*d*, 6*d*, and 9*d* form with the A-axis is an angle such that the major axes 3*d*, 6*d*, and 9*d* extend upward and away from the ground surface as they approach the toe parts 3*t*, 6*t*, and 9*t*. In other words, the major axes 3*d*, 6*d*, and 9*d* extend in a toe-up direction. Further, as the identification number increases, the angle that the major axes 3*d*, 6*d*, and 9*d* form with the A-axis increase successively. Also, the shape of the ellipses 3*a*, 6*a*, and 9*a* successively approaches a circular shape. Further, it is understood that the height H of the hitting point centers 3*c*, 6*c*, and 9*c* from the ground surface decreases, as shown in FIGS. 2A to 4B. Thus, it is understood that the shape of the hitting point distribution of a general player has a specific tendency.

In other words, from the aforesaid distribution of the hitting points, the hitting points are located approximately within the ellipses 3*a*, 6*a*, and 9*a* having a major axis and a minor axis. The angle Δ that the major axes 3*d*, 6*d*, and 9*d* of the ellipses form with the A-axis extending parallel to the intersecting line of the face surfaces 3*f*, 6*f*, and 9*f* and the ground surface, approaches the toe parts 3*t*, 6*t*, and 9*t*. Also, according as the identification number increases, the angle Δ successively increases, and the shape of the ellipses successively approaches a circular shape. Further, the height H of the points 3*c*, 6*c*, and 9*c* representing the hitting point centers decrease.

The inertial resistance in the direction perpendicular to the face surface of the golf club head can be determined as follows.

Figure 5:
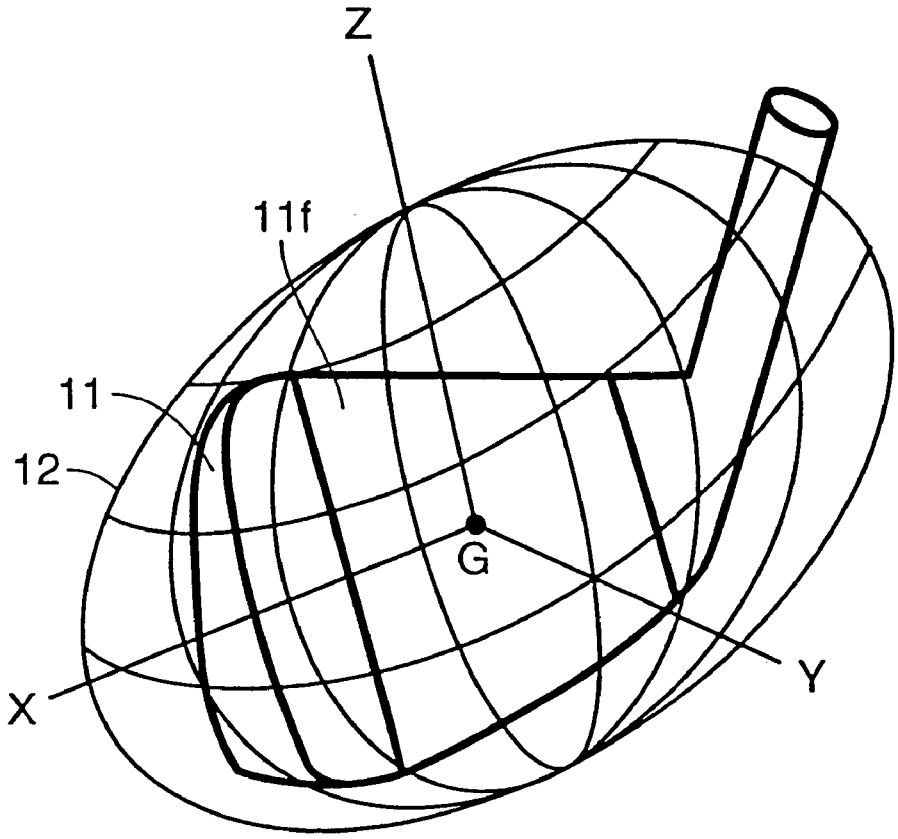
FIG. 5 is a view showing a relationship between an ellipsoid of inertia of a golf club head and XYZ-axes.

FIG. 5 is a view showing a relationship between the ellipsoid of inertia of a golf club head and X-axis, Y-axis, Z-axis. Referring to FIG. 5, the axis passing through the center of gravity G and being perpendicular to the ground surface is assumed to be the Z-axis. The axis passing through the center of gravity G and being perpendicular to the Z-axis and parallel to the intersecting line of the tangential plane at the centroid (center) of the face surface 11*f* and the ground surface, is assumed to be the X-axis. The tangential surface at the centroid (center) of the face surface 11*f* is approximately the same surface as the face surface 11*f*. The axis passing through the center of gravity G and being perpendicular to both the X-axis and the Z-axis is assumed to be the Y-axis.

Figure 7:
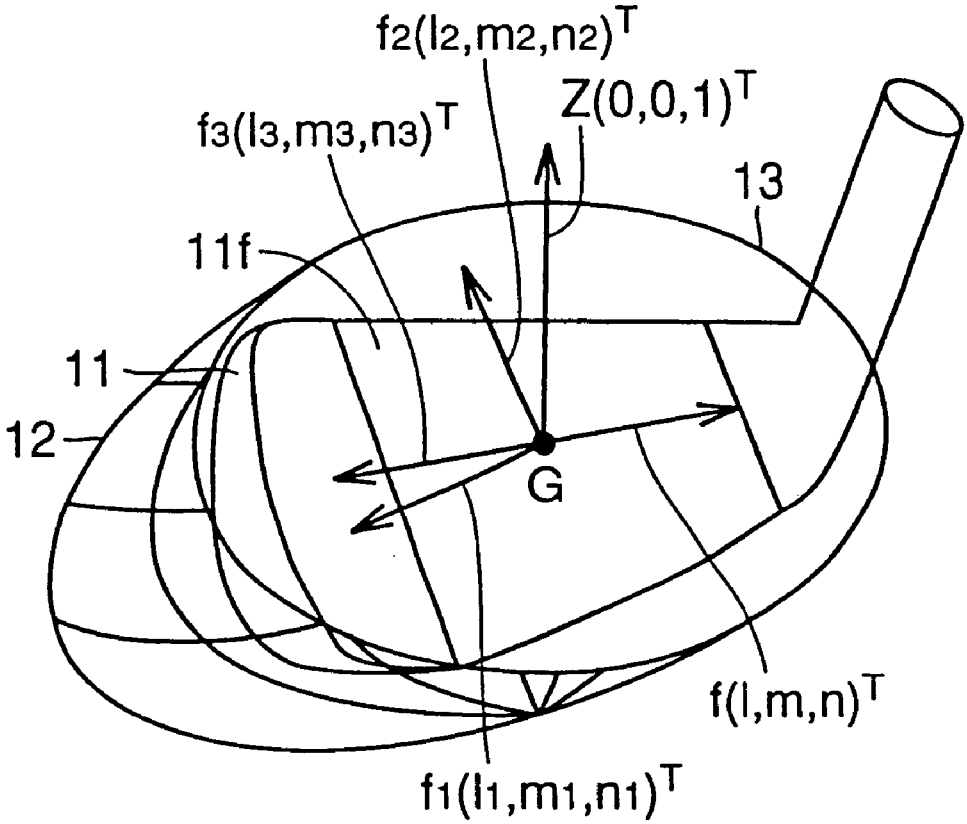
FIG. 7 is a view showing direction vectors in the cut ellipse surface.

FIG. 7 is a view showing direction vectors on an ellipse plane appearing when the ellipsoid of inertia is cut. Referring to FIG. 7, the direction vector of a plane passing through the center of gravity G and being parallel to the intersecting line of the tangential plane at the centroid of the face surface 11*f* and the ground surface is assumed to be f(l, m, n)$^T$, and each of the following vectors is calculated.

$$f_1(l_1, m_1, n_1)^T = f \times Z(0, 0, 1)^T$$

$$f_2(l_2, m_2, n_2)^T = f_1 \times f$$

$$f_3(l_3, m_3, n_3)^T = f_1 \times f_2 \quad (1)$$

where X designates an outer product.

Figure 6A:
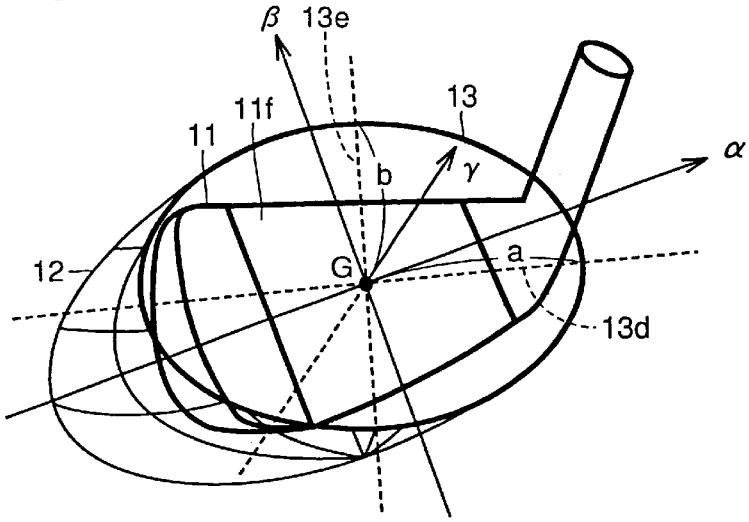
FIGS. 6A to 6C are views showing a cut ellipse surface appearing when the ellipsoid of inertia is cut with a plane passing through the center of gravity of the golf club head and being parallel to a face surface.
Figure 6B:
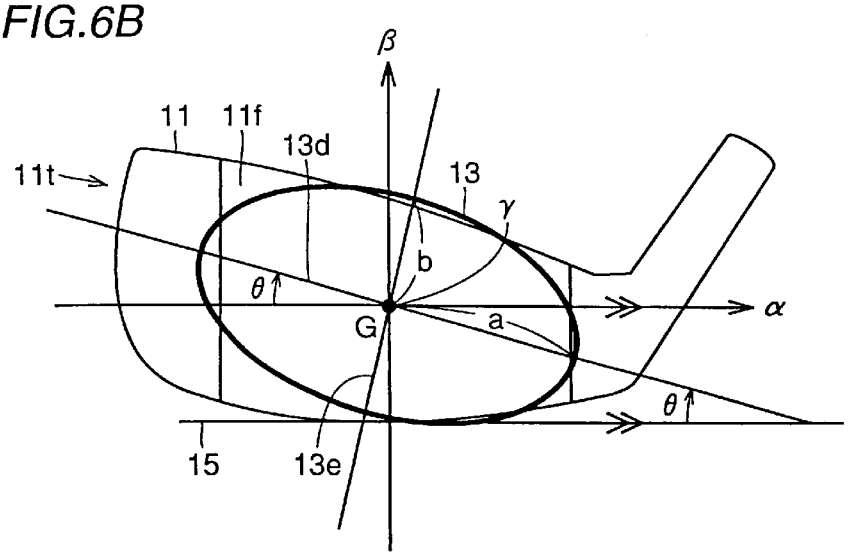
Figure 6C:
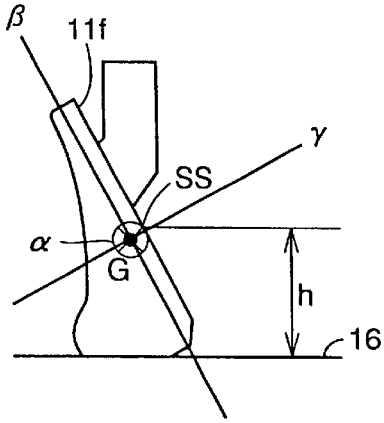

FIGS. 6A, 6B, and 6C are views showing cut surfaces when the ellipsoid of inertia is virtually cut with a plane passing through the center of gravity of a golf club head and being parallel to the face surface. Referring to FIGS. 6A, 6B, and 6C, the axis passing through the center of gravity G and being parallel to the intersecting line of the tangential plane at the centroid of the face surface 11*f* and the ground surface is assumed to be α-axis. The axis being parallel to the tangential plane at the centroid of the face surface 11*f* and perpendicular to the α-axis is assumed to be β-axis. The axis being perpendicular to the α-axis and the β-axis is assumed to be γ-axis. The conversion from the α, β, γ coordinate system to the X, Y, Z coordinate system is represented by the following equations.

$$X = l_1 \cdot \alpha + l_2 \cdot \beta + l_3 \cdot \gamma$$

$$Y = m_1 \cdot \alpha + m_2 \cdot \beta + m_3 \cdot \gamma$$

$$Z = n_1 \cdot \alpha + n_2 \cdot \beta + n_3 \cdot \gamma \quad (2)$$

Here, supposing that $I_1$, $I_2$, $I_3$ are moments of inertia with respect to the X, Y, Z axes, $I_{12}$ is a product of inertia with respect to the YZ-plane and the XZ-plane, $I_{13}$ is a product of inertia with respect to the YZ-plane and the XY-plane, $I_{23}$ is a product of inertia with respect to the XZ-plane and the XY-plane, then the following relationship is obtained.

$$I_1 \cdot X^2 + I_2 \cdot Y^2 + I_3 \cdot Z^2 + 2 \cdot I_{12} \cdot X \cdot Y + 2 \cdot I_{13} \cdot X \cdot Z + 2 \cdot I_{23} \cdot Y \cdot Z = 1 \quad (3)$$

The ellipsoid represented by the equation (3) is referred to as an ellipsoid of inertia. This shows the magnitude of the inertial resistance in each direction. Substituting the equation (3) with the equation (2) and letting the γ term zero, the equation (4) of the cut ellipse plane is determined.

$$(I_1 l_1^2 + I_2 m_1^2 + I_3 n_1^2 + I_{12} l_1 m_1 + I_{13} l_1 n_1 + I_{23} m_1 n_1)\alpha^2$$
$$+ (I_1 l_2^2 + I_3 m_2^2 + I_3 n_2^2 + I_{12} l_2 m_2 + I_{13} l_2 n_2 + I_{23} m_2 n_2)\beta^2$$
$$+ (I_1 l_1 l_2 + I_2 m_1 m_2 + I_3 n_1 n_2 + I_{12} l_1 m_2 + I_{12} l_2 m_1 + I_{13} l_1 n_2 + I_{13} l_2 n_1$$
$$+ I_{23} m_1 n_2 + I_{23} m_2 n_1)\alpha\beta = 1 \quad (4)$$

The magnitude of the cut surface represents the magnitude of the inertial resistance indicating the facility of rotation of this surface. Also, the cut surface represents the inertial resistance in the direction perpendicular to the cut surface. Further, as shown in FIGS. 6A, 6B, and 6C, it is apparent that the shape of the cut surface is a plane ellipse because it is a cut surface of a three-dimensional ellipsoid of inertia.

The plane ellipse appearing when the ellipsoid of inertia 12 of the golf club head 11 is cut with the face surface 11*f* represents the facility of the rotation in the perpendicular direction with respect to the face surface 11*f*. Also, in the plane ellipse 13 appearing on the cut surface when the ellipsoid of inertia 12 is cut with a plane passing through the center of gravity G and being parallel to the face surface 11*f*, the length of the major axis 13*d*, is represented by a and the length of the minor axis 13*e* is represented by b. The aspect ratio is defined by a/b. The angle formed by the major axis 13*d*, and the α-axis is assumed to be θ.

The distribution of the hitting points of the player shown in FIGS. 2A to 4B has an elliptic shape with its center at the center of hitting points. Further, the major axes 3*d*, 6*d*, and 9*d* extend to go away from the ground surface as they approach the toe parts 3*t*, 6*t*, and 9*t*. In other words, in the third iron golf club head 3 shown in FIGS. 2A and 2B, the angle Δ formed by the A-axis on the face surface 3*f* and the major axis 3*d*, of the ellipse 3*a* is 5°. In the sixth iron golf club head 6 shown in FIGS. 3A and 3B, the angle Δ formed by the A-axis on the face surface 6*f* and the major axis 6*d* of the ellipse 6*a* is 7°. In the ninth iron golf club head 9 shown in FIGS. 4A and 4B, the angle Δ formed by the A-axis of the golf club head 9 on the face surface 9*f* and the major axis 9*d* of the ellipse 9*a* is 9°.

Therefore, by allowing the sweet spot to be approximately coincident with the center of the plane ellipse appearing when the ellipsoid of inertia 12 is virtually cut with the face surface 11*f*, the distance between the hitting points and the sweet spot can be made as small as possible even if the hitting points are varied. This can restrain the rotation of the golf club head. Further, since the ball is hit in the neighborhood of the sweet spot, the initial velocity of the ball is improved to increase the flying distance.

Furthermore, by allowing the angle θ formed by the major axis 13*d*, of the plane ellipse 13 shown in FIG. 6B and the intersecting line 15 of the cut surface and the ground surface to be coincident with the angle Δ formed by the A-axis and the major axes 3*d*, 6*d*, and 9*d* of the ellipses 3*a*, 6*a*, and 9*a* indicating the hitting point distribution shown in FIGS. 2A to 4B, the deviation of the golf club head in the up-and-down direction and the right-and-left direction can be restrained. Further, the major axis 13*d*, of the ellipse 13, like the major axes 3*d*, 6*d*, and 9*d*, is set to extend away from the ground surface as it approaches the toe part 1 it. Further, by allowing the aspect ratio which is the ratio of the length a of the major axis 13*d*, and the length b of the minor axis 13*e* of the ellipse 13, to be coincident with the aspect ratio a'/b' of the ellipses 3*a*, 6*a*, and 9*a* indicating the hitting point distribution of a general player, the inertial resistance in the up-and-down direction and the inertial resistance in the right-and-left direction are allowed to conform to the variation of the hitting points of the general player. This can not only restrain the lateral deviation of the golf club head in the right-and-left direction but also restrain the variation of the flying distance in the flying ball line direction.

According as the identification number increases, the angle θ shown in FIG. 6B is successively increased. Also, the aspect ratio a/b is successively decreased according as the identification number of the golf club head increases. Also, the height h of the sweet spot from the ground surface 16 shown in FIG. 6C is successively decreased according as the identification number of the golf club head increases. By constructing a golf club set using these golf club heads, the variation of the flying distance in the right-and-left direction and the flying ball line direction can be restrained for a golf club of any identification number, whereby the flying distance can be increased by improving the speed of the ball.

Next, specific embodiments of the present invention will be explained.

A golf club head and set of an embodiment of the present invention includes the following constituent elements.

A golf club head according to the present invention has an ellipsoid of inertia with its center at the center of gravity. When the ellipsoid of inertia is virtually cut with a plane passing through the center of gravity of the golf club head and being parallel to a face surface, the major axis of a plane ellipse appearing on its cut surface forms an angle of θ with an intersecting line of the cut surface and the ground surface. The major axis extends upward and away from the ground surface as it approaches a toe part. The angle θ is not smaller than 0.5° and not larger than 9.5°. An aspect ratio a/b defined by a ratio of the length a of the major axis to the length b of the minor axis is not smaller than 1 and not larger than 4.

In a golf club set according to the present invention, the angle θ increases successively or remains approximately equal according as the identification number increases. The aspect ratio a/b decreases successively or remains approximately equal according as the identification number increases. The height h of the sweet spot decreases successively or remains approximately equal according as the identification number increases.

Also, these golf club head and golf club set can be produced from iron, stainless steel, aluminum, titanium, magnesium, tungsten, copper, nickel, zirconium, cobalt, manganese, zinc, silicon, tin, chromium, FRP (fiber reinforced plastics), synthetic resin, ceramics, or rubber or the like, which are materials often used in generally producing a golf club head. It may be produced from a single material of these or may be fabricated from a combination of two or more kinds of these materials.

As a production method, use of a precision casting method is preferable because the cost will be low and the dimension precision is high. In addition, the head body can be produced by die-casting, pressing, or forging. It is also possible to produce each of the parts by pressing, forging, precision casting, metal injection, die-casting, cut-processing, powder-metallurgy, or the like and bonding these by welding, adhesion, press-fit, fitting engagement, press-contact, screwing, soldering, or the like to fabricate a golf club head.

Next, with the use of an actual golf club, the fact that the product of the present invention produces a more excellent effect than a conventional product was verified.

TABLE 1

| Identification number of a golf club (iron) | Aspect ratio a'/b' of a plane ellipse approximating the variation of hitting points | Angle Δ formed by the ground surface and the major axis of a plane ellipse approximating the variation of hitting points (°) | Height H of the center of hitting points (mm) |
|---|---|---|---|
| I-3 | 2.1 | 5 | 21 |
| I-6 | 2 | 7 | 19.5 |
| I-9 | 1.9 | 9 | 18 |

Table 1 is a data showing a relationship between the identification number of the golf club heads shown in FIGS. 2A to 4B and the variation of the hitting points. From Table 1, for example, in the third iron golf club, the aspect ratio (the length of the major axis 3*d*/ the length of the minor axis) of the ellipse 3*a* approximating the variation of the hitting points is 2.1; the angle formed between the axis A and the major axis 3*d*, is 5°; and the height H of the hitting point center from the ground surface is 21 mm.

Figure 8A:
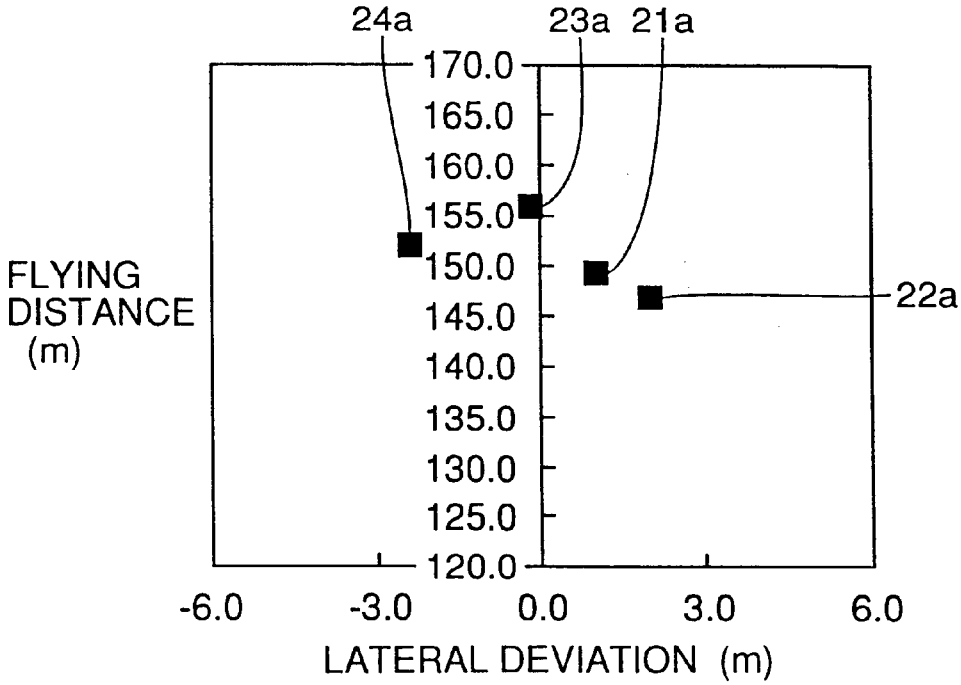
FIGS. 8A and 8B are views showing a variation of the flying distance by a club head according to an embodiment of the present invention.
Figure 8B:
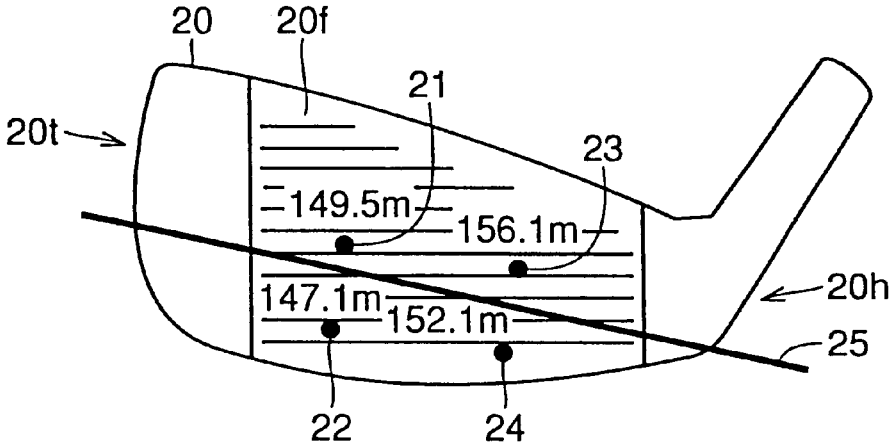

FIG. 8B is a front view of a golf club head according to the present invention. A golf club head 20 shown in FIG. 8B was fabricated on the basis of this data. The golf club head 20 has an ellipsoid of inertia with its center at the center of gravity. When the ellipsoid of inertia is virtually cut with a plane passing through the center of gravity of the golf club head 20 and being parallel to the face surface 20*f*, the angle θ formed by the major axis 25 of the plane ellipse appearing on the cut surface and the intersecting line of the cut surface and the ground surface was set to be 5°. Further, the major axis 25 was set to extend upward and away from the ground surface as it approaches a toe part 20*t*. Further, the aspect ratio a/b defined by a ratio of the length a of the major axis to the length b of the minor axis of the plane ellipse obtained by cutting the ellipsoid of inertia was set to be 2.1. Furthermore, the height h of the sweet spot was set to be 21 mm.

Figure 9A:
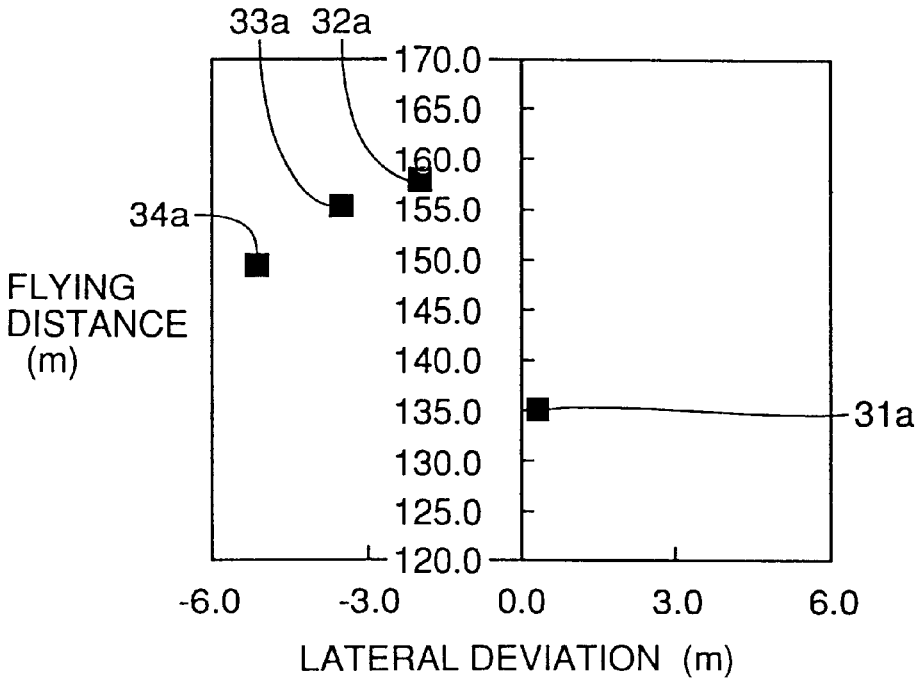
FIG.9A PRIOR ART
FIGS. 9A and 9B are views showing a variation of the flying distance by a conventional club head.
Figure 9B:
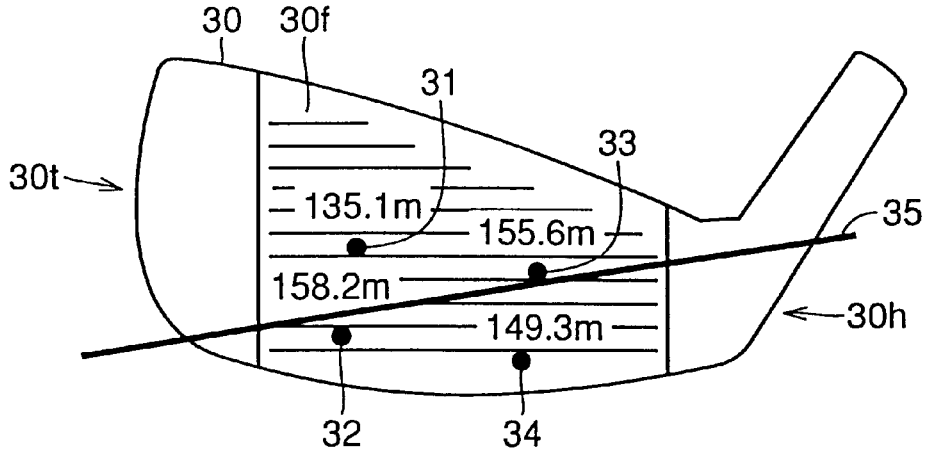
FIG.9B PRIOR ART

FIG. 9B is a front view of a conventional golf club head. A conventional golf club head 30 shown in FIG. 9B was prepared. The golf club head 30 has an ellipsoid of inertia with its center at the center of gravity. When the ellipsoid of inertia is virtually cut with a plane passing through the center of gravity of the golf club head 30 and being parallel to the face surface 30*f*, the angle formed by the major axis 35 of the plane ellipse appearing on the cut surface and the intersecting line of the cut surface and the ground surface was set to be 2°. However, the major axis 35 was set to extend to approach the ground surface as it approaches a toe part 30*t*. Further, the height of the sweet spot from the ground surface was set to be 20 mm. Here, the masses of the golf club heads 20 and 30 shown in FIGS. 8B and 9B were each set to be 248 g.

A shaft was attached to the golf club head 20 to make a golf club. This golf club was mounted on a golf robot, and balls were struck by setting the speed of the golf club head to be 37 m/sec. In order to allow the hitting point position to correspond to the variation of the hitting points of a player, the balls were struck at the upper toe part 21, the lower toe part 22, the upper heel part 23, and the lower heel part 24.

Here, the upper toe part 21 is distant by 12 mm in the direction from the sweet spot to the toe part 20*t* and by 6 mm in the upward direction. The lower toe part 22 is distant by 12 mm in the direction from the sweet spot to the toe part 20*t* and by 6 mm in the downward direction. The upper heel part 23 is distant by 12 mm in the direction from the sweet spot to the heel part 20*h* and by 6 mm in the upward direction. The lower heel part 24 is distant by 12 mm in the direction from the sweet spot to the heel part 20*h* and by 6 mm in the downward direction.

Also, with the golf club head 30 shown in FIG. 9B, balls were struck at the upper toe part 31, the lower toe part 32, the upper heel part 33, and the lower heel part 34 similar to the upper toe part 21, the lower toe part 22, the upper heel part 23, and the lower heel part 24 of FIG. 8B, and with a head speed similar to that of the golf club head 20 shown in FIG. 8B. The results of these are shown in FIGS. 8A and 9A.

FIG. 8A is a graph showing a flying distance and a variation of the lateral deviation generated when the balls are struck with the golf club according to the embodiment of the present invention. FIG. 9A is a graph showing a flying distance and a variation of the lateral deviation generated when the balls are struck with a conventional golf club. The point 21*a* of FIG. 8A is a data showing a flying distance and a lateral deviation of the golf balls struck at the upper toe part 21 of FIG. 8B. Also, the points 22*a* to 24*a* are points showing a flying distance and a lateral deviation of the golf balls struck at the lower toe part 22, the upper heel part 23, and the lower heel part 24, respectively. Similarly, the points 31*a* to 34*a* of FIG. 9A are points showing a flying distance and a lateral deviation of the golf balls struck at the upper toe part 31, the lower toe part 32, the upper heel part 33, and the lower heel part 34 shown in FIG. 9B.

From FIGS. 8A and 9A, it is understood that, with the golf club head 20 according to the present invention, the variation of the flying distance and the lateral deviation in the right-and-left direction are restrained as compared with the conventional golf club head 30 that does not take the variation of the hitting points of the general players into account. Specifically, while the variation of the hit balls to the right and the left is about 6 m with the golf club head 30, the variation in the right-and-left direction is about 4 m with the golf club head 20 of the present invention, whereby the distance of the variation could be reduced by 33%.

Also, when the variation in the flying ball line direction (the variation in the flying distance) is compared, the variation of the flying distance is about 9 m in the case of the golf club head 20 of the present invention, while the variation of the flying distance is about 23 m in the case of the golf club head 30. Therefore, the variation of the flying distance can be reduced by 61%. Further, when the average flying distance is compared, while the golf club head 30 gives an average flying distance of 149.6 m, the golf club head 20 of the present invention gives an average flying distance of 151.2 m, whereby the increase of about 2 m in the flying distance has been obtained. Here, FIGS. 8A and 9A show an average value when balls were hit for six times with each golf club head.

Also, when one takes a look at the result of striking at the upper toe parts 21 and 31, it is understood that there is a difference in the rotation performance of golf club heads. In other words, with the golf club head 30, the decrease in the flying distance in the flying ball line direction caused by the striking at the upper toe part 31 is conspicuous, and also the balls fall in the right direction as compared with the case in which the balls are struck at other parts. In contrast, with the golf club head 20, the decrease in the flying distance by the upper toe part 21 is small, and the lateral deviation is also small. This means that the rotation of the golf club head 20 is restrained more than the rotation of the golf club head 30, whereby it is understood that the rotation performance of the golf club head 20 is excellent.

Also, on the basis of the data shown in Table 1, a sixth iron golf club head and a ninth iron golf club head according to the present invention were prepared. Namely, the sixth iron golf club head has an ellipsoid of inertia with its center at the center of gravity. When the ellipsoid of inertia is virtually cut with a plane passing through the center of gravity of the golf club head and being parallel to the face surface, the angle θ formed by the major axis of the plane ellipse appearing on the cut surface and the intersecting line of the cut surface and the ground surface was set to be 7°. Further, the major axis of the plane ellipse was set to extend upward and away from the ground surface as it approaches a toe part. Also, the aspect ratio a/b was set to be 2. Further, the height h of the sweet spot was set to be 19.5 mm.

The ninth iron golf club head according to the present invention has an ellipsoid of inertia with its center at the center of gravity. When the ellipsoid of inertia is virtually cut with a plane passing through the center of gravity of the golf club head and being parallel to the face surface, the angle θ formed by the major axis of the plane ellipse appearing on the cut surface and the intersecting line of the cut surface and the ground surface was set to be 9°. The aspect ratio a/b was set to be 1.9. The height h of the sweet spot was set to be 18 mm.

Figure 33A:
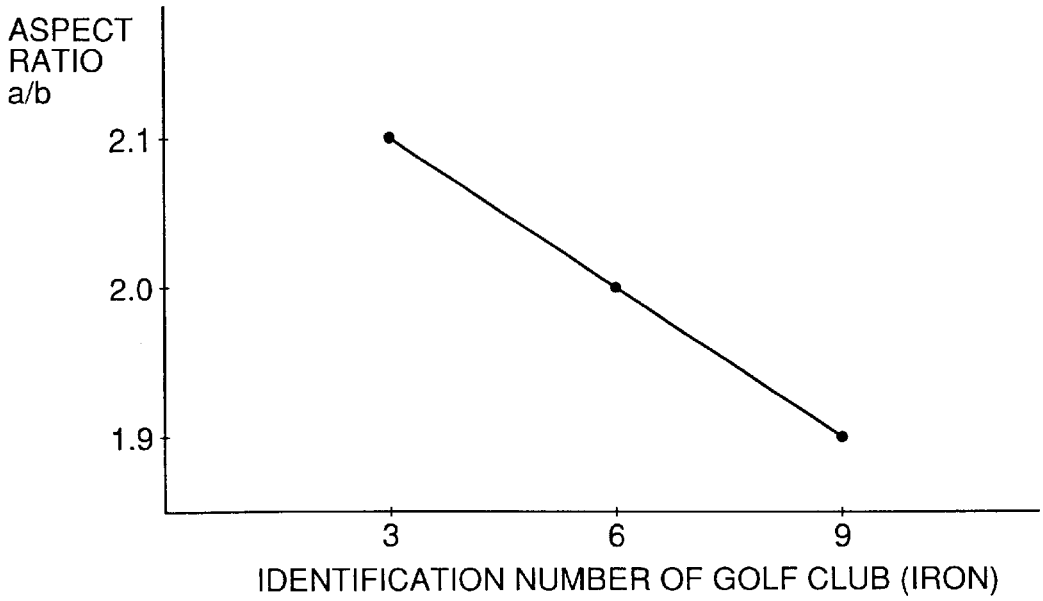
FIG. 33A is a view showing a relationship between the identification number of an iron golf club and the aspect ratio.
Figure 33B:
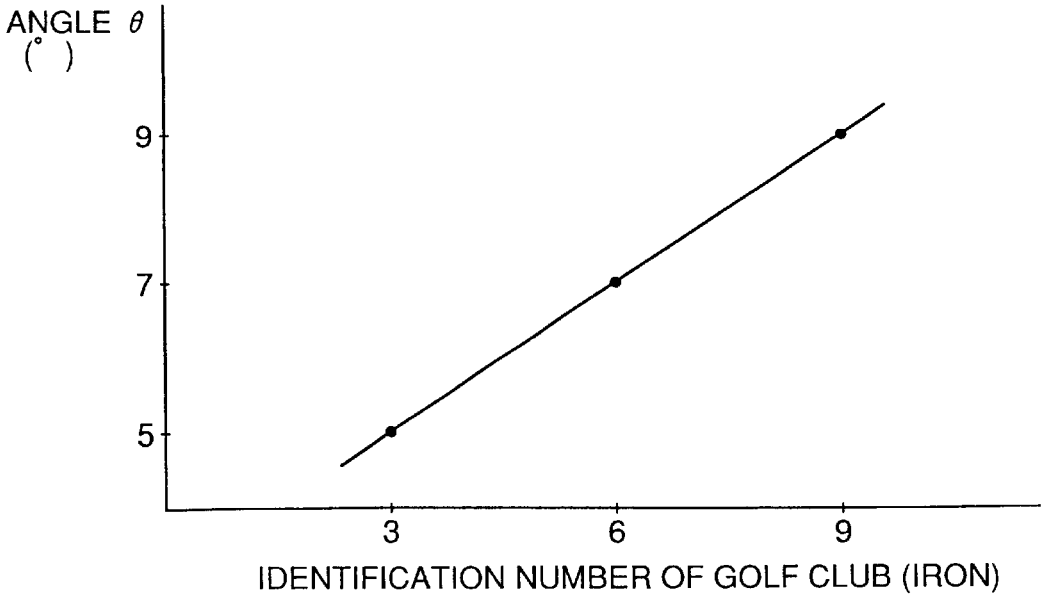
FIG. 33B is a graph showing a relationship between the identification number of an iron golf club and an angle Δ formed by the major axis of a plane ellipse that approximates the variation of the hitting points.
Figure 33C:
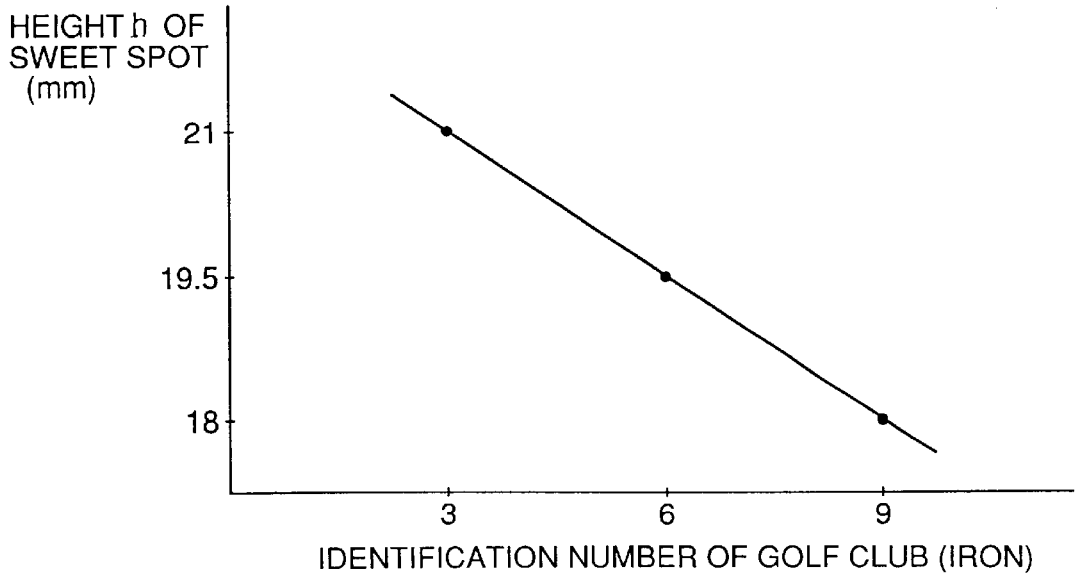
FIG. 33C is a graph showing a relationship between the identification number of an iron golf club and the height H of the hitting point center.

The identification numbers of the golf clubs having these golf club heads, the aspect ratios a/b, the angle θ, and the height h of the sweet spot have a relationship shown in FIGS. 33A to 33C. In other words, also, according as the identification number of the golf club increases, the aspect ratio a/b successively decreases. According as the identification number increases, the angle θ of each of the golf club heads successively increases with a constant ratio. Also, according as the identification number of the golf club increases, the height h of the sweet spot successively decreases with an approximately constant ratio.

Also, with respect to wood golf clubs, the aspect ratio of the ellipse approximating the variation of the hitting points of a general player, the angle Δ formed by the major axis of the ellipse and the intersecting line of the ground surface and the face surface, and the height H of the center of hitting points were determined. The results are shown in Table 2.

TABLE 2

| Identification number of a golf club (wood) | Aspect ratio a'/b' of a plane ellipse approximating the variation of hitting points | Angle Δ formed by the ground surface and the major axis of a plane ellipse approximating the variation of hitting points (°) | Height H of the center of hitting points (mm) |
|---|---|---|---|
| W-1 | 1.45 | 2 | 25 |
| W-3 | 1.4 | 4 | 22 |
| W-5 | 1.3 | 5 | 21.5 |

On the basis of this Table 2, wood golf club heads according to the present invention were prepared. Namely, each of the first, third, and fifth wood golf club heads has an ellipsoid of inertia with its center at the center of gravity. When the ellipsoid of inertia is virtually cut with a plane passing through the center of gravity of each golf club head and being parallel to each face surface, the major axis of the plane ellipse appearing on the cut surface was set to extend upward and away from the ground surface as it approaches a toe part. Further, the angle θ formed by the major axis and the intersecting line of the cut surface and the ground surface was set to be 2° for the first wood golf club head, 4° for the third wood golf club head, and 5° for the fifth wood golf club head. Also, the aspect ratio a/b was set to be 1.45 for the first wood golf club head, 1.4 for the third wood golf club head, and 1.3 for the fifth wood golf club head. Also, the height h of the sweet spot was set to be 25 mm for the first wood golf club head, 22 mm for the third wood golf club head, and 21.5 mm for the fifth wood golf club head.

A test of variation of the hit balls was carried out on these first, third, and fifth wood golf club heads and a conventional wood golf club head. As a result, it was confirmed that the wood golf club heads according to the present invention can reduce the variation in the right-and-left direction and in the flying ball line direction to a great extent.

Also, as a result of applying the present invention to various golf club heads it was made clear that the angle θ must be not smaller than 0.5° and not larger than 9.5°. Also, it was made clear that the aspect ratio a/b must be not smaller than 1 and not larger than 4. Further, it was found out that the height h of the sweet spot from the ground surface must be not smaller than 10 mm and not larger than 30 mm.

Hereafter, specific embodiments to which the present invention is applied will be explained.

Figure 10A:
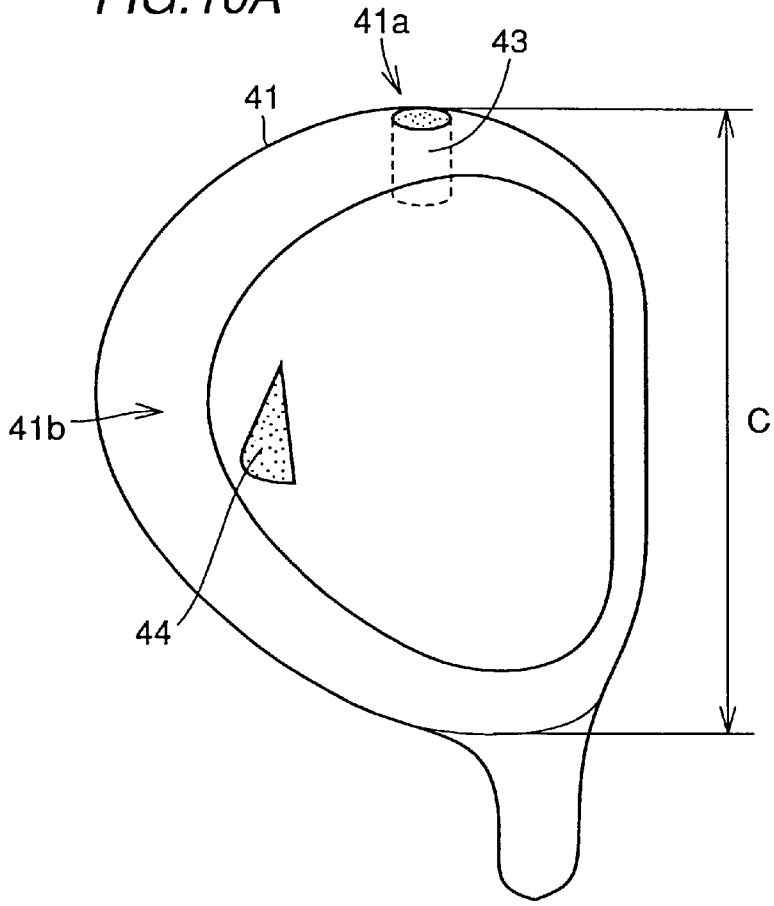
FIGS. 10A and 10B are views showing an embodiment of the present invention.
Figure 10B:
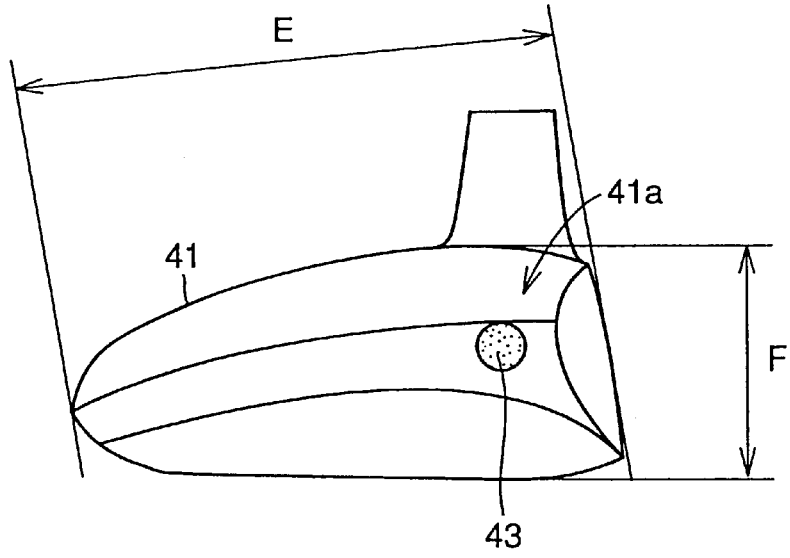

FIG. 10A is a bottom view of a wood golf club according to the present invention. FIG. 10B is a side view of a wood golf club according to the present invention. Referring to FIGS. 10A and 10B, a weight member 43 serving as the first weight member is embedded in the upper part 41*a* of the toe of the wood golf club head 41. A weight member 44 is embedded also in the back part 41*b* at the center of the sole. Thus, in the case where the third wood golf club and the seventh wood golf club shown in FIGS. 10A and 10B are constructed, the dimension and the weight of each will be shown in Table 3.

TABLE 3

| Item | Wood golf club #3 | Wood golf club #7 |
|---|---|---|
| Toe tip weight | 10 g | 10 g |
| Sole back center weight | 10 g | 20 g |
| Loft angle | 18° | 24° |
| Lie angle | 57.5° | 58.5° |
| Head length: C | 96 mm | 96 mm |
| Head width: E | 79 mm | 60 mm |
| Head thickness: F | 36 mm | 33 mm |
| Head weight | 200 g | 213 g |

Further, according to more preferable embodiments of the present invention, among the aforesaid constituent elements, the angle θ is set to be within a range not smaller than 1° and not larger than 9°, the aspect ratio a/b is set to be within a range not smaller than 1.5 and not larger than 2.5, and the height of the sweet spot is set to be within a range not smaller than 15 mm and not larger than 27 mm, and a design is made by suitably combining these.

Figure 11A:
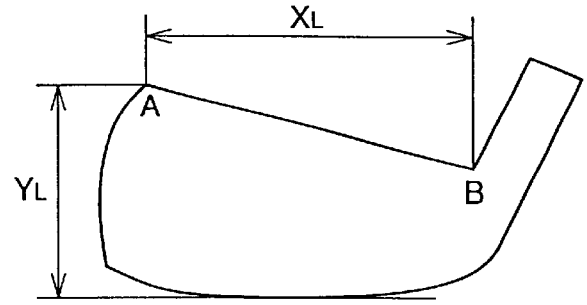
FIGS. 11A and 11B are views showing an example in which the aspect ratio and the direction of the axis are changed by the head shape.
Figure 11B:
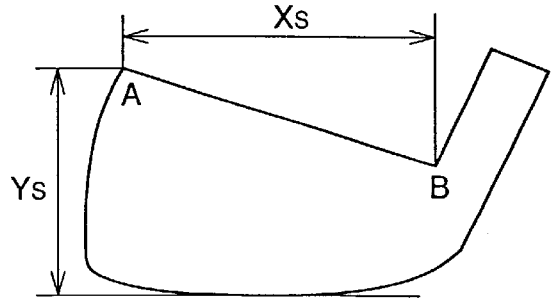

FIGS. 11A and 11B show iron golf clubs in which the aspect ratio is changed by changing the head shape. FIG. 11A shows a long iron golf club, and FIG. 11B shows a short iron golf club.

In FIGS. 11A and 11B, the point A shows the highest part of the toe part of the face surface having the largest height from the ground surface. The point B shows the lowest part of the top edge of the face surface having the smallest height from the ground surface. The length XL between the highest part A of the toe part of the long iron golf club and the lowest part B of the top edge, the length $Y_L$ from the ground surface to the highest part A of the toe part, the length $X_S$ from the highest part A of the toe part of the short iron golf club to the lowest part B of the top edge, and the length $Y_S$ from the ground surface to the highest part A of the toe part are selected to satisfy the following relationship.

$$X_L/Y_L>X_S/Y_S$$

In these iron golf clubs shown in FIGS. 11A and 11B, the direction of the axis (here, the direction of the axis refers to the direction formed by the major axis of the plane ellipse and the ground surface) can be changed by increasing the height of the toe part according as it becomes a short iron golf club, namely, according as the identification number increases.

Figure 12A:
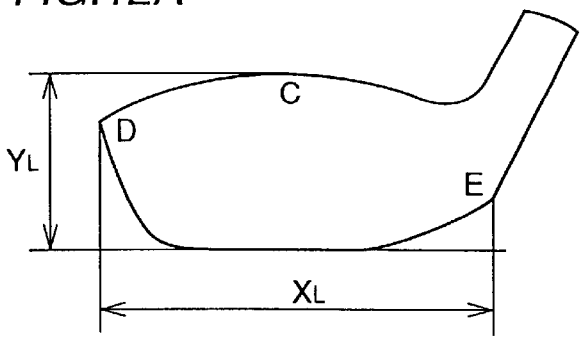
FIGS. 12A and 12B are views showing an example in which the aspect ratio and the direction of the axis are changed by a head shape.
Figure 12B:
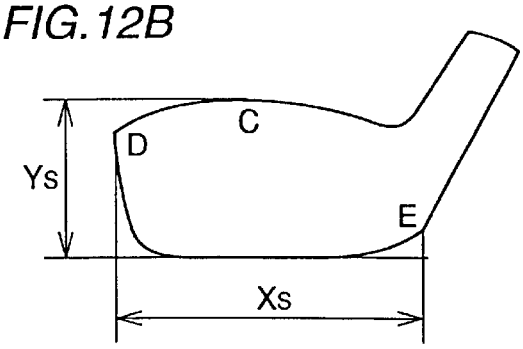

FIGS. 12A and 12B show examples in which the aspect ratio is changed by changing the head shape in wood golf clubs, in the same manner as in FIGS. 11A and 11B. FIG. 12A shows a driver. FIG. 12B shows a short wood golf club such as a ninth wood, for example. In FIGS. 12A and 12B, the point C shows a top point of the crown part. The point D shows the most protruding part of the toe part of the head. The point E shows the heel end part of the sole part. The length XL from the most protruding part D of the toe part of the head of the driver to the heel end part E of the sole part, the length $Y_L$ from the ground surface to the top point C of the crown part, the length $X_S$ from the most protruding part D of the toe part of the head of the short wood gold club to the heel end part E of the sole part, and the length $Y_S$ from the ground surface to the top point C of the crown part are selected to satisfy the following relationship.

$$X_L/Y_L>X_S/Y_S$$

In the examples shown in FIGS. 12A and 12B, the direction of the axis can be changed by increasing the height of the toe part according as it becomes a short wood golf club, namely, according as the identification number increases.

Figure 13A:
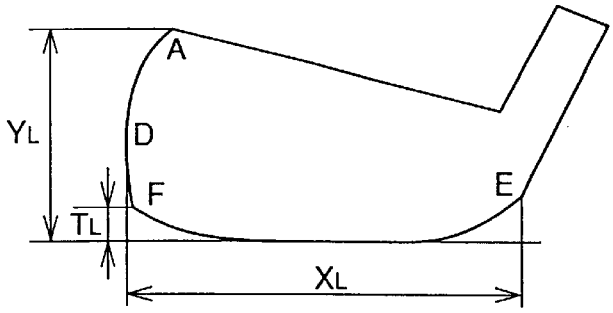
FIGS. 13A and 13B are views showing an example in which the aspect ratio and the direction of the axis are changed by the face shape.
Figure 13B:
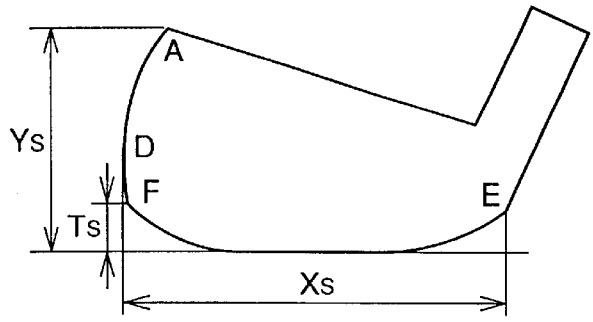

FIGS. 13A and 13B show iron golf clubs in which the aspect ratio is changed by changing the face shape. FIG. 13A shows a long iron golf club. FIG. 13B shows a short iron golf club. The point F in FIGS. 13A and 13B shows the toe end part of the sole part. In the examples shown in FIGS. 13A and 13B, the ratios of the length XL from the most protruding part D of the toe part of the head to the heel end part E of the sole part, the length $Y_L$ from the ground surface to the most protruding part A of the toe part, the length $X_S$ from the most protruding part D of the toe part of the head of the short iron gold club to the heel end part E of the sole part, and the length $Y_S$ from the ground surface to the highest part A of the toe part are selected to satisfy the following relationship.

$$Y_L/X_L>Y_S/X_S$$

Also, the relationship between the length $T_L$ from the ground surface to the toe end part F of the sole part in the long iron golf club and the length $T_S$ from the ground surface to the toe end part of the sole part in the short iron is selected to satisfy the following formula.

$$T_L>T_S$$

In this example, the direction of the axis can be changed by setting $T_L>T_S$.

Figure 14A:
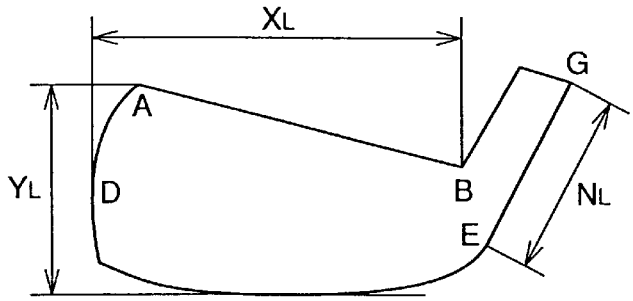
FIGS. 14A and 14B are views showing an example in which the aspect ratio is changed by the face shape and the direction of the axis is changed by the neck length.
Figure 14B:
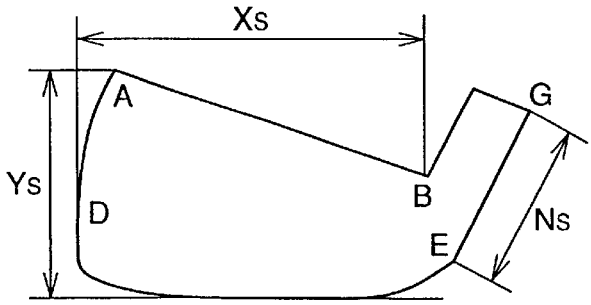

FIGS. 14A and 14B show iron golf clubs in which the aspect ratio is changed by changing the face shape and the direction of the axis is changed by changing the neck length. In FIGS. 14A and 14B, the point G shows the tip end part of the neck part. Then, the lengths from the neck tip end part G to the heel end part E of the sole part are respectively represented by $N_L$ and $N_S$. In this example also, $X_L$, $Y_L$, $X_S$, $Y_S$, $N_L$, and $N_S$ are selected to satisfy the following relationship.

$$Y_L/X_L>Y_S/X_S$$

$$N_L>N_S$$

Figure 15A:
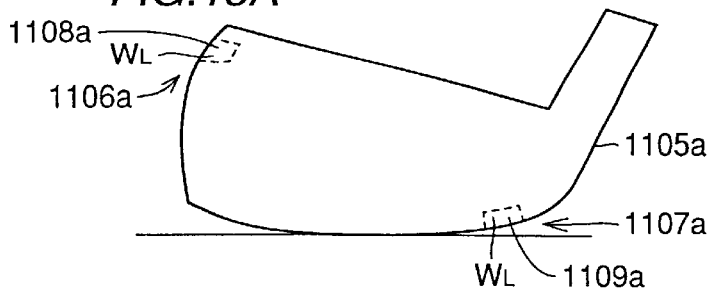
FIGS. 15A and 15B are views showing an example in which the aspect ratio and the direction of the axis are changed by disposing predetermined weights on the upper side of the toe and on the heel sole side.
Figure 15B:
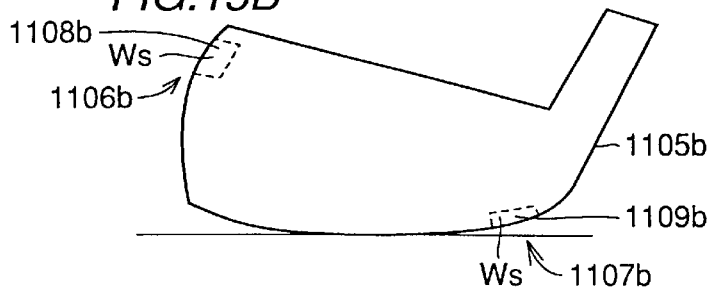

FIGS. 15A and 15B show iron golf clubs in which the aspect ratio and the direction of the axis are changed by disposing weight members in the upper part of the toe and the heel part of the sole. FIG. 15A shows a long iron golf club. FIG. 15B shows a short iron golf club.

Weight members 1108*a* and 1108*b* serving as the first weight members and weight members 1109*a* and 1109*b* serving as the second weight members are disposed in the upper parts 1106*a* and 1106*b* of the toe and in the heel side parts 1107*a* and 1107*b* of the sole of the iron golf club heads 1105*a* and 1105*b*, respectively. The weight members 1108*a*, 1108*b*, 1109*a*, and 1109*b* have masses $W_L$ and $W_S$. The masses $W_L$ and $W_S$ satisfy a relationship shown by $W_L<W_S$. By this, the aspect ratio and the direction of the axis can be changed.

Figure 16A:
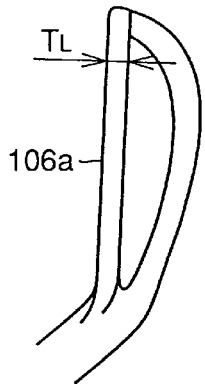
FIGS. 16A to 16D are views showing an example in which the aspect ratio and the direction of the axis are changed by changing the thickness of the top edge on the toe side and changing the width of the sole on the heel side.
Figure 16B:
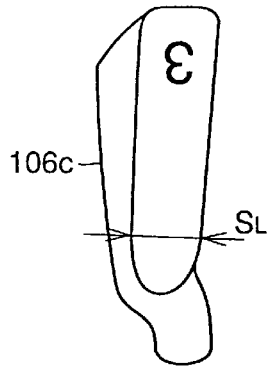
Figure 16C:
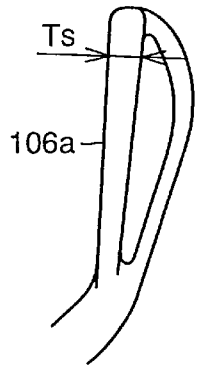
Figure 16D:
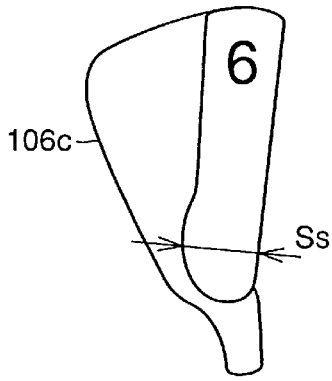

FIGS. 16A to 16D show iron golf clubs in which the aspect ratio and the direction of the axis are changed by changing the thickness of the top edge on the toe part side and changing the sole width of the heel part. FIG. 16A is a view of a long iron golf club as seen from the top edge side. FIG. 16B is a view of a long iron golf club as seen from the sole side. FIG. 16C is a view of a short iron golf club as seen from the top edge side. FIG. 16D is a view of a short iron golf club as seen from the sole side. In this example, the thickness $T_L$ of the top edge of the long iron golf club shown by FIG. 16A and the thickness $T_S$ of the top edge of the short iron golf club shown by FIG. 16C are selected to satisfy the relationship represented by $T_S>T_L$. Also, the sole width $S_L$ of the heel part of the long iron golf club shown by FIG. 16B and the sole width $S_S$ of the heel part of the short iron golf club shown by FIG. 16D are selected to satisfy the relationship represented by $S_L>S_S$.

Figure 17A:
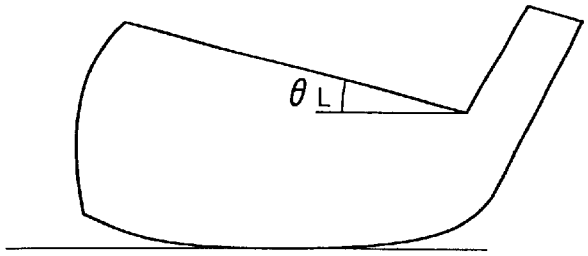
FIGS. 17A and 17B are views showing an example in which the aspect ratio and the direction of the axis are changed by changing the angle of the top edge to the intersecting line of the cut surface and the ground surface.
Figure 17B:
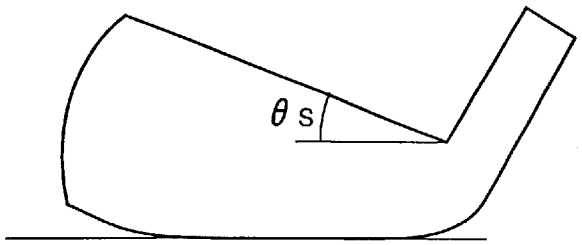

FIGS. 17A and 17B show iron golf clubs in which the aspect ratio and the direction of the axis are changed by changing the angle $\theta_L$ formed by the top edge and the intersecting line of the cut surface and the ground surface. FIG. 17A shows a long iron golf club. FIG. 17B shows a short iron golf club.

In this example, the angle $\theta_S$ formed by the top edge of the short iron golf club and the intersecting line of the ground surface and the angle $\theta_L$ in the long iron are selected to satisfy the relationship represented by $\theta_L<\theta_S$. By this, the aspect ratio and the direction of the axis can be changed.

Figure 18A:
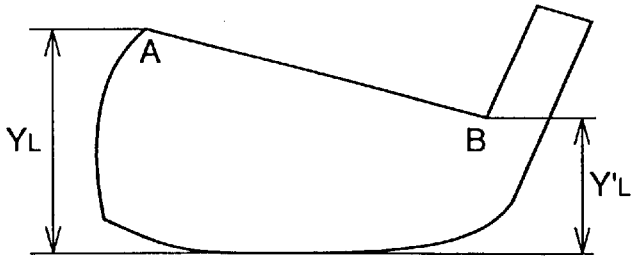
FIGS. 18A and 18B are views showing an example in which the aspect ratio and the direction of the axis are changed by changing the ratio of the height on the toe side to the height on the heel side.
Figure 18B:
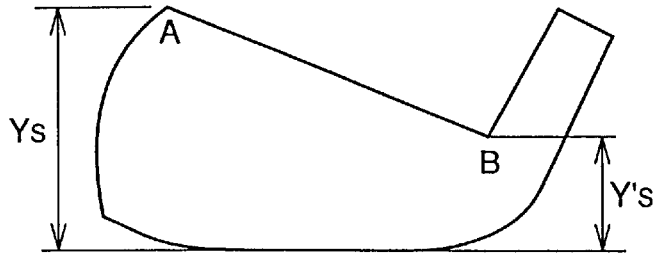

FIGS. 18A and 18B show iron golf clubs in which the aspect ratio and the direction of the axis are changed by changing the height of the toe part and the height of the heel part. FIG. 18A shows a long iron golf club. FIG. 18B shows a short iron golf club.

In this example, the lengths $Y_L$ and $Y_S$ from the ground surface to the highest point A of the toe part, and the lengths $Y'_L$ and $Y'_S$ to the lowest point B of the top edge are selected to satisfy the relationship represented by $Y'_L/Y_L>Y'_S/Y_S$.

Figure 19A:
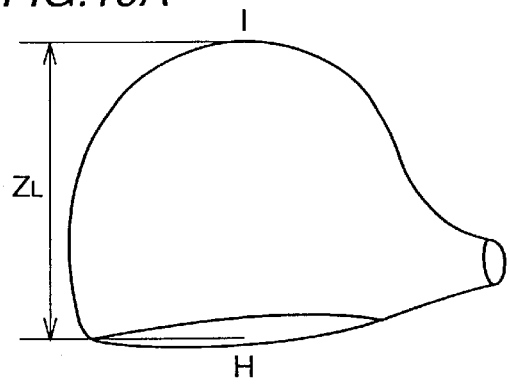
FIGS. 19A to 19D are views showing an example in which the aspect ratio is changed by approximating the head shape to a sphere, and the axis is tilted by changing the thickness of the upper toe and the thickness of the lower heel.
Figure 19B:
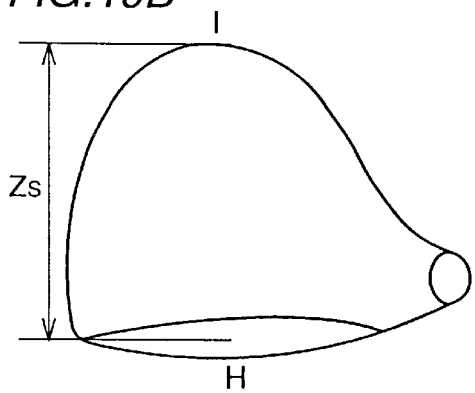
Figure 19C:
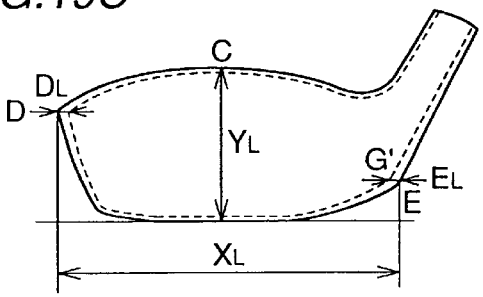
Figure 19D:
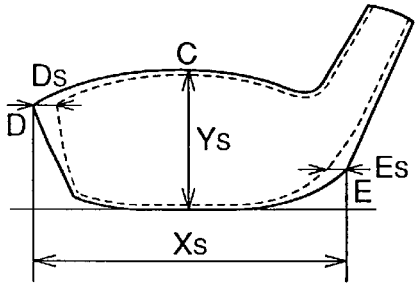

FIGS. 19A to 19D show wood golf clubs in which the aspect ratio is changed by approximating the shape of the head to a sphere and the axis is tilted by changing the thickness of the upper side of the toe part and the thickness of the lower side of the heel part. FIG. 19A shows a plan view of a driver. FIG. 19B shows a plan view of a short wood golf club. FIG. 19C shows a front view of a driver. FIG. 19D shows a front view of a short wood golf club.

In this example, the lengths from the centroid H of the face surface to the most protruding part I of the back side are assumed to be $Z_L$ and $Z_S$. The lengths from the most protruding part D of the toe part of the head to the heel end part E of the sole part are assumed to be $X_L$ and $X_S$. The lengths from the ground surface to the top point C of the crown part are assumed to be $Y_L$ and $Y_S$. The relationship of these is selected in such a manner that $X_S:Y_S:Z_S$ is nearer to 1:1:1 than $X_L:Y_L:Z_L$. By this, the shape of the head can be approximated to a sphere. Moreover, the axis is tilted by changing the thicknesses $D_L$ and $D_S$ of the toe part and the thicknesses $E_L$ and $E_S$ of the heel part.

Figure 20A:
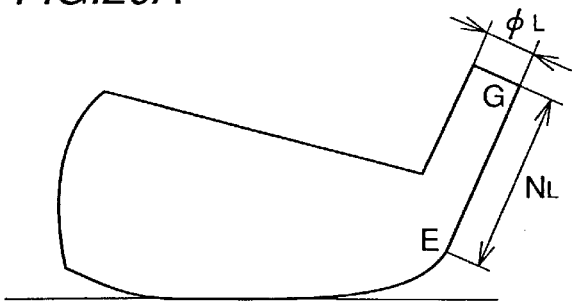
FIGS. 20A and 20B are views showing an example in which the axis is tilted and the sweet spot is lowered by decreasing the neck length and increasing the neck diameter according as it becomes a short iron.
Figure 20B:
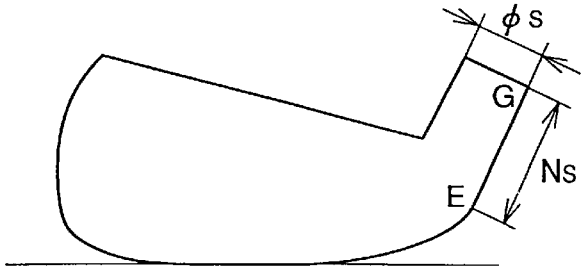

FIGS. 20A and 20B show iron golf clubs in which the axis is tilted by decreasing the neck length and increasing the neck diameter according as it becomes a short iron golf club. FIG. 20A shows a long iron golf club. FIG. 20B shows a short iron golf club.

In this example, the neck length $N_L$ of the long iron golf club shown by FIG. 20A and the neck length $N_S$ of the short iron golf club shown by FIG. 20B are selected to satisfy the relationship represented by $N_L>N_S$. The neck diameter $\phi_L$ of the long iron golf club and the neck diameter $\phi_S$ of the short iron golf club are selected to satisfy the relationship represented by $\phi_L<\phi_S$.

Figure 21A:
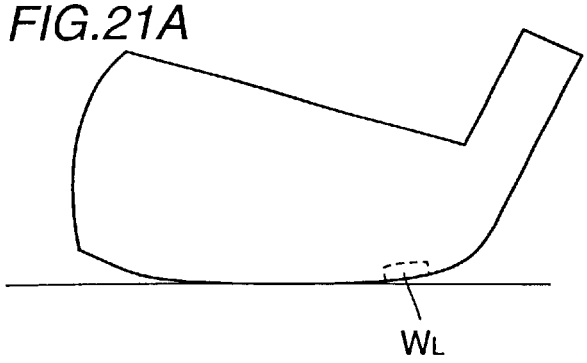
FIGS. 21A and 21B are views showing an example in which the axis is tilted and the sweet spot is lowered by increasing the weight of the lower heel.
Figure 21B:
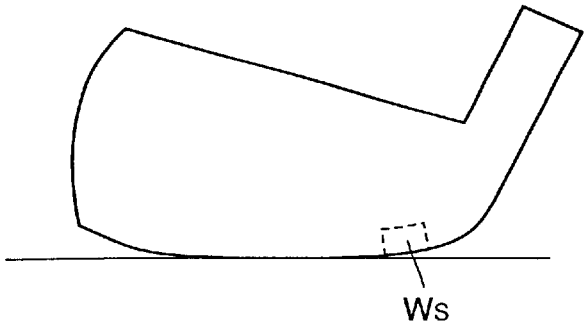

FIGS. 21A and 21B show iron golf clubs in which the axis is tilted and the height of the sweet spot is decreased by increasing the mass of the lower part of the heel part. FIG. 21A shows a long iron golf club. FIG. 21B shows a short iron golf club. In this example, a weight member is added to the lower part of the heel part of each of the long iron golf club and the short iron golf club. Assuming the masses of the respective weight members to be $W_L$ and $W_S$, these satisfy a relationship represented by $W_L<W_S$.

Figure 22A:
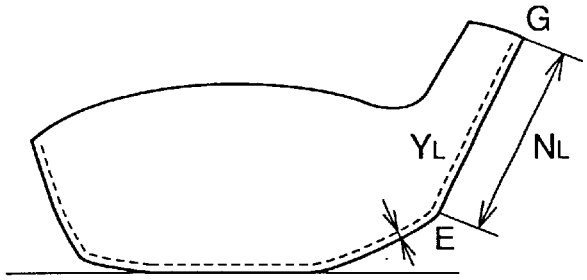
FIGS. 22A and 22B are views showing an example in which the axis is tilted and the sweet spot is lowered by decreasing the length of the neck and increasing the thickness of the sole on the heel side.
Figure 22B:
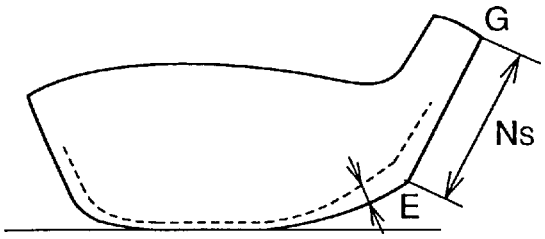

FIGS. 22A and 22B show wood golf clubs in which the axis is tilted and the sweet spot is lowered by decreasing the length of the neck and increasing the thickness of the sole of the heel part. FIG. 22A shows a driver. FIG. 22B shows a short wood golf club. In this example, the neck length is decreased and the thickness of the heel part is increased according as it becomes a short wood golf club, namely, according as the identification number increases.

Figure 23A:
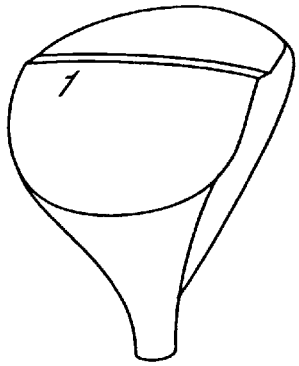
FIGS. 23A and 23B are views showing an example in which the axis is tilted and the sweet spot is lowered by increasing the thickness of the sole of a short wood as compared with a driver.
Figure 23B:
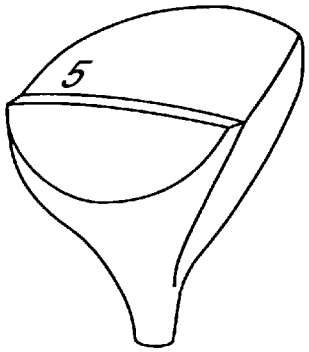

FIGS. 23A and 23B show wood golf clubs in which the thickness of the sole part is successively increased. FIG. 23A shows a driver. FIG. 23B shows a short wood golf club. In this example, the axis is tilted and the sweet spot height is decreased by successively increasing the thickness of the sole part of the short wood golf club as compared with the driver, and by shifting the thick part to the heel part side.

Figure 24A:
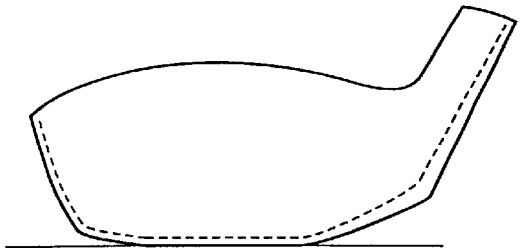
FIGS. 24A and 24B are views showing an example in which the direction of the axis is changed and the sweet spot is lowered by disposing a predetermined weight in the inside of the heel side head on the upper side of the sole.
Figure 24B:
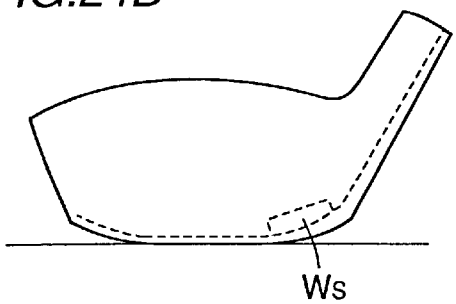

In FIGS. 24A and 24B, a weight member is disposed on the upper part of the sole in the inside of the head at the heel part of the short wood golf club shown in FIG. 24B, as compared with the driver shown in FIG. 24A. By this, the direction of the axis is changed, and the height of the sweet spot is decreased.

Figure 25A:
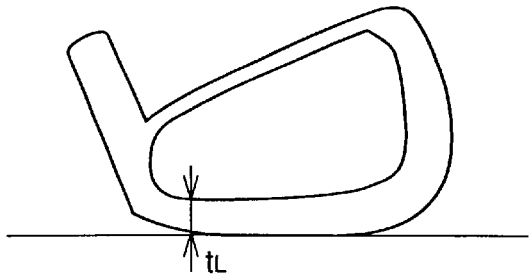
FIGS. 25A and 25B are views showing an example in which the direction of the axis is tilted and the sweet spot is lowered by increasing the thickness of the lower part of the back side heel of a short iron.
Figure 25B:
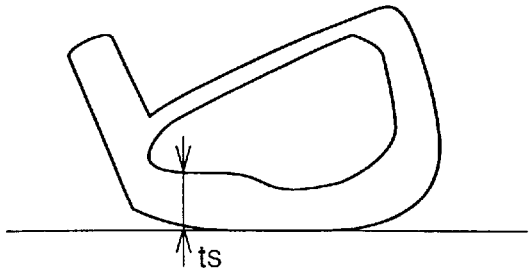

The thickness ts of the lower part of the heel on the back side of the short iron golf club shown in FIG. 25B is larger than the thickness tL of the lower part of the heel on the back side of the long iron golf club shown in FIG. 25A. By this, the axis is tilted and the height of the sweet spot is decreased.

Figure 26A:
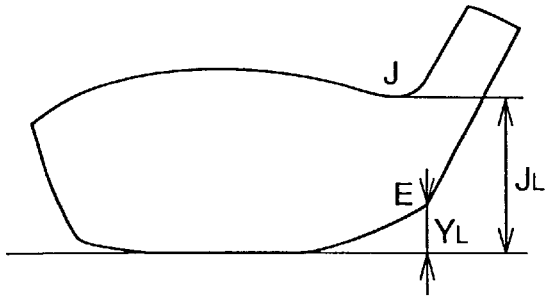
FIGS. 26A and 26B are views showing an example in which the aspect ratio is changed and the sweet spot is lowered by changing the face surface heel height and the heel part crown height of a driver and a short wood.
Figure 26B:
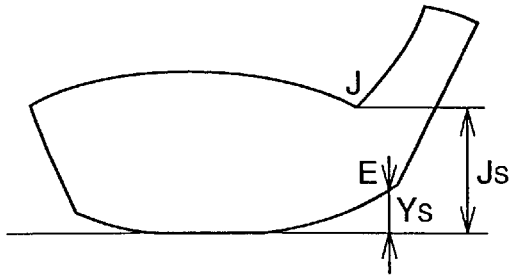

The height $Y_L$ of the heel part and the crown height $J_L$ of the heel part of the face surface of the driver shown in FIG. 26A and the height Ys of the heel part and the crown height Js of the heel part of the face surface of the short wood golf club shown in FIG. 26B are selected to satisfy relationships respectively represented by $Y_L>Y_S$ and $J_L>J_S$. By this, the axis is tilted and the height of the sweet spot is decreased.

Figure 27A:
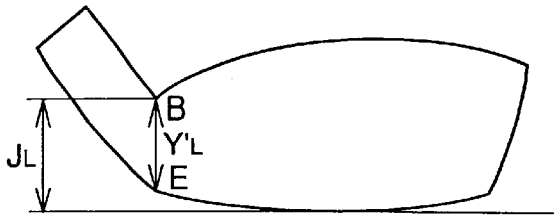
FIGS. 27A and 27B are views showing an example in which the aspect ratio is changed and the sweet spot is lowered by decreasing the back part heel height and changing the heel part crown height.
Figure 27B:
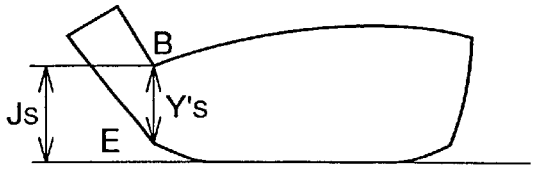

In the driver shown in FIG. 27A and in the short wood golf club shown in FIG. 27B, the heights $Y'_L$ and $Y_S$ of the heel part of the back part are decreased. The crown heights $J_L$ and $J_S$ of the heel part from the ground surface are changed. By this, the axis is tilted and the height of the sweet spot is decreased. However, in this case, these are selected to satisfy relationships represented by $Y_L>Y'_S$ and $J_L>J_S$.

Figure 28A:
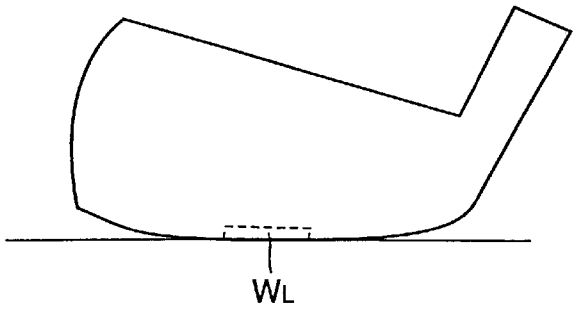
FIGS. 28A and 28B are views showing an example in which the aspect ratio is changed and the sweet spot is lowered by disposing a predetermined weight in the lower part of the sole.
Figure 28B:
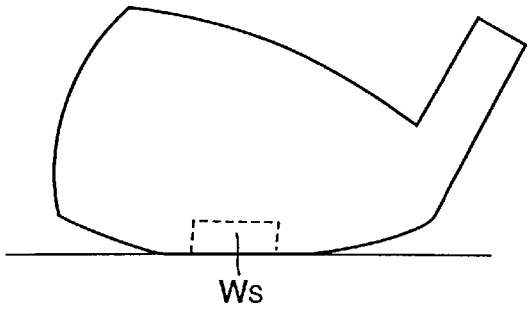

In the long iron golf club shown in FIG. 28A and in the short iron golf club shown in FIG. 28B, weight members respectively having masses $W_L$ and $W_S$ are attached to the lower part of the sole part. These satisfy a relationship represented by $W_L<W_S$. By this, the aspect ratio is successively decreased, and the height of the sweet spot is decreased.

Figure 29A:
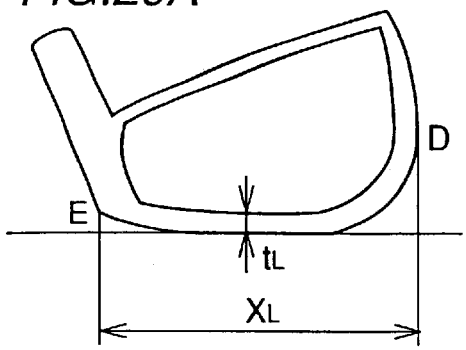
FIGS. 29A and 29B are views showing an example in which the aspect ratio and the head length are changed and the sweet spot is lowered by changing the thickness of the cavity on the back side.
Figure 29B:
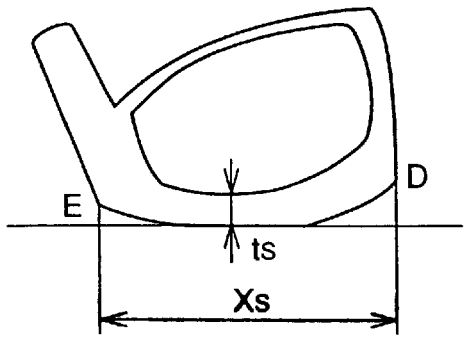

In the long iron golf club shown in FIG. 29A and in the short iron golf club shown in FIG. 29B, the thicknesses $t_L$ and $t_S$ of the cavity on the back side are increased and the head length is decreased. By this, the aspect ratio is successively decreased, and the height of the sweet spot is decreased. Here, these are selected to satisfy relationships represented by tL<ts and $X_L>X_S$.

Figure 30A:
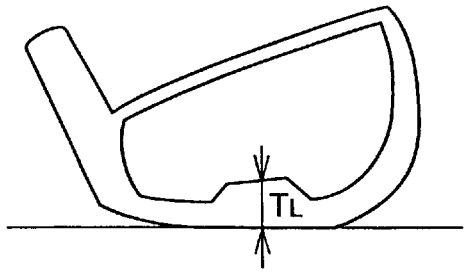
FIGS. 30A and 30B are views showing an example in which the aspect ratio is changed and the sweet spot is lowered by changing the height of the power blade on the cavity sole on the back side.
Figure 30B:
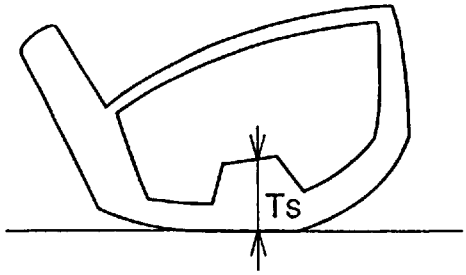

In the long iron golf club shown in FIG. 30A and in the short iron golf club shown in FIG. 30B, the heights $T_L$ and $T_S$ of the power blades on the cavity sole of the back side are set to satisfy a relationship represented by $T_L<T_S$. By this, the aspect ratio is successively decreased, and the height of the sweet spot is decreased.

Figure 31A:
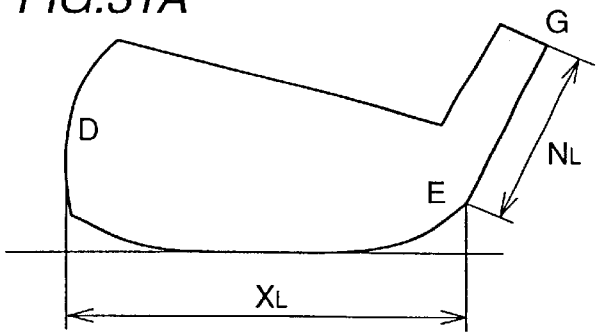
FIGS. 31A and 31B are views showing an example in which the aspect ratio is changed and the sweet spot is lowered by changing the lengths of the most protruding part on the head toe side and the heel end part of the sole and changing the neck length.
Figure 31B:
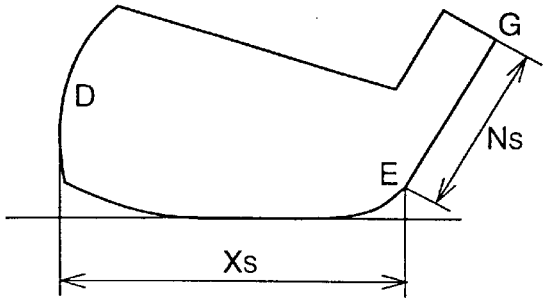

In the long iron golf club shown in FIG. 31A and in the short iron golf club shown in FIG. 31B, the lengths $X_L$ and $X_S$ from the most protruding part D of the toe part of the head to the heel end part E of the sole part as well as the neck lengths $N_L$ and $N_S$ are decreased. By this, the aspect ratio is decreased, and the height of the sweet spot is decreased.

Figure 32A:
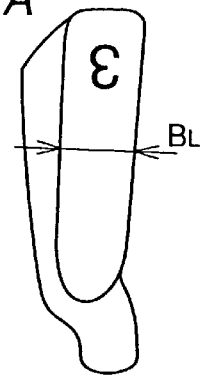
FIGS. 32A and 32B are views showing an example in which the aspect ratio is changed and the sweet spot is lowered by increasing the sole thickness and allowing the sole thicknesses of a long iron and a short iron to have a predetermined relationship.
Figure 32B:
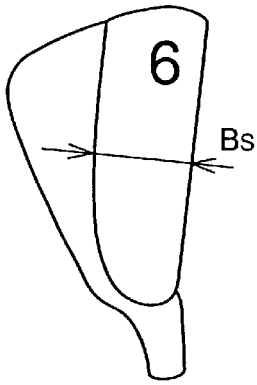

In the long iron golf club shown in FIG. 32A and in the short iron golf club shown in FIG. 32B, the aspect ratio is successively decreased and the height of the sweet spot is decreased by increasing the sole thicknesses $B_L$ and $B_S$. These are selected to satisfy a relationship represented by $B_L<B_S$.

Thus, by applying the modes shown in FIGS. 10A to 32B to golf club heads and golf club sets, the variation of the flying distance in the right-and-left direction and in the flying ball line direction can be restrained, and the initial velocity of the balls can be improved. This increases the flying distance.

As described above, according to the present invention, the sweet spot of the golf club head is approximated to the center of hitting points while restraining not only the variation of the flying distance in the right-and-left direction but also the variation of the flying distance in the flying ball line direction by taking the variation of the hitting points of a general player into account while planning to improve the inertial characteristics in the direction perpendicular to the face surface. By this, the distance of the offset caused by the variation of the hitting points can be reduced as much as possible, and the initial velocity of the balls can be improved.

Different embodiments of the present invention will be explained.

Figure 34A:
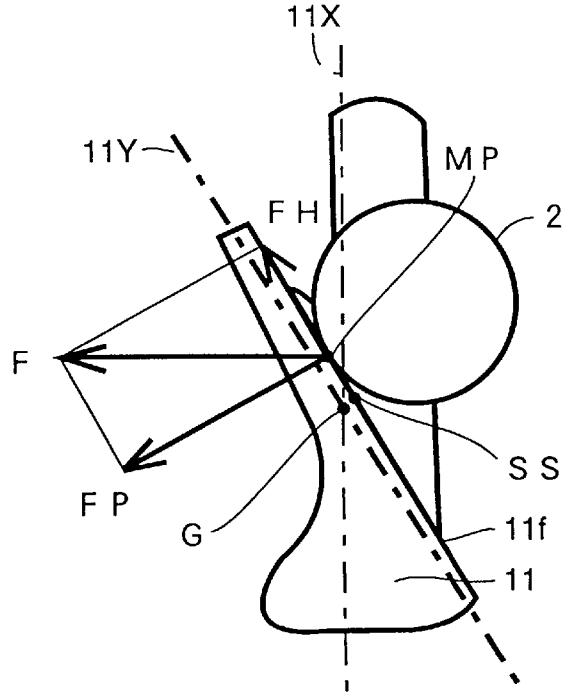
FIGS. 34A and 34B are views for explaining the principle of an iron golf club head according to the present invention.
Figure 34B:
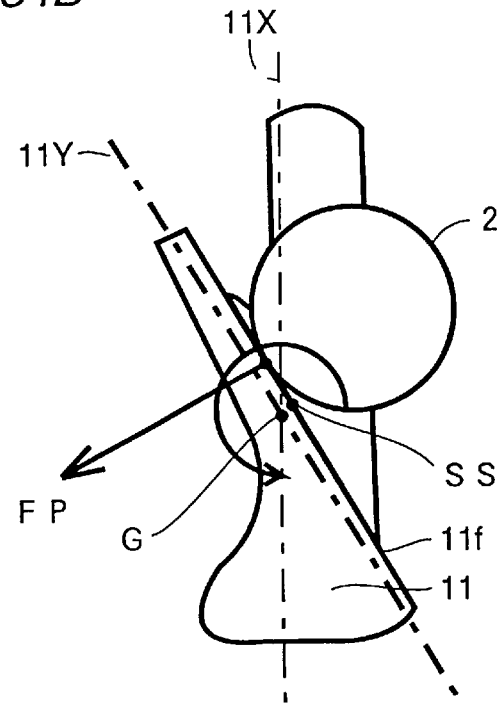

FIGS. 34A and 34B are views for explaining the principle of the present invention. FIG. 34A is a view for explaining a striking force generated on a face surface when a golf ball is hit with a golf club head. FIG. 34B is a view showing a state in which the face is rotated and the ball flies out at the striking time.

Referring to FIG. 34A, when a golf ball is struck with a golf club, an iron golf club head 11 receives a striking force F from the golf ball 2 in the proceeding direction of the swing at the hitting point position MP of the golf ball 2. In the golf club, an angle is formed between a sole and a face surface 11*f* in order to change the flying-out angle of the golf ball 2 in accordance with the identification number and to obtain a flying distance for each identification number. This angle is referred to as a loft angle. Typically, the loft angle is set to be about 10° in the case of a driver, about 20° in the case of a third iron, and about 40° in the case of a ninth iron. The loft angle increases according as the identification number increases.

Due to the presence of the loft angle, the striking force F at the striking time can be decomposed into a horizontal partial force FH and a perpendicular partial force FP with respect to the face surface 11*f*. The horizontal partial force FH is a force that rotates the golf ball 2 together with a frictional force of the face surface 11*f*, namely, it generates a back spin or a side spin. According as the swing speed increases and the impacting speed of the golf club head increases, the striking force F increases and the horizontal partial force FH increases, so that the back spin and the side spin are more likely to be generated. The ball trajectory of an iron of a professional golfer rises high above after the shot, and then falls vertically from above. This is due to the fact that, since the head speed is high, a back spin is generated, and the ball floats upward and falls down.

Also, the perpendicular partial force FP is a force that acts perpendicularly on the face surface 11*f*, as shown in FIG. 34B, and this force rotates the face surface 11*f*. By this rotation, the golf ball 2 after the shot flies out in the right-and-left direction and in the up-and-down direction. Here, the point at which the line drawn perpendicularly from the center of gravity G of the golf club head 11 to the face surface 11*f* intersects the face surface 11*f* is referred to as a sweet spot SS. The sweet spot SS is a point by which the golf ball flies most and, if the ball is struck here, the golf club head 11 rotates little. However, if a general players performs a shot, the ball hardly hits the sweet spot SS, and the player performs a shot in the peripheries of the sweet spot SS.

Figure 35A:
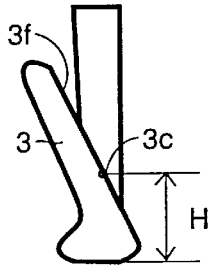
FIGS. 35A and 35B are views showing a distribution of the hitting points of a general player with a third iron.
Figure 35B:
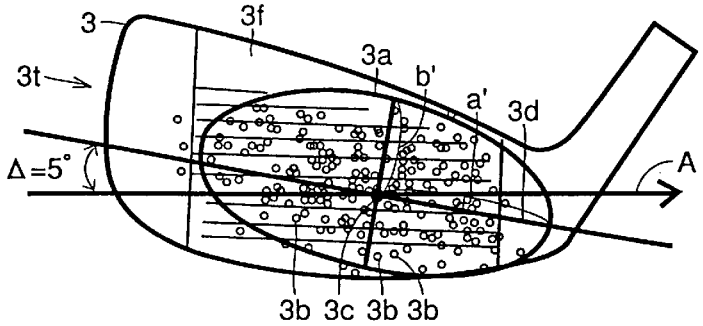
Figure 36A:
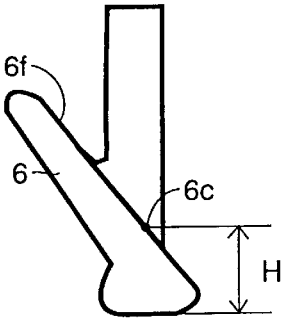
FIGS. 36A and 36B are views showing a distribution of the hitting points of a general player with a sixth iron.
Figure 36B:
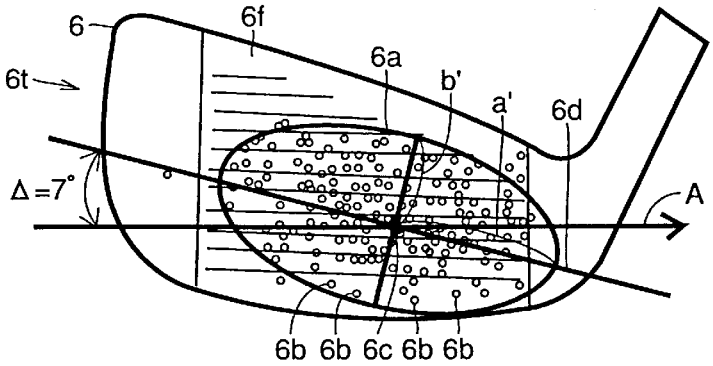
Figure 37A:
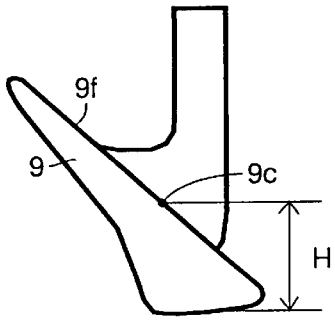
FIGS. 37A and 37B are views showing a distribution of the hitting points of a general player with a ninth iron.
Figure 37B:
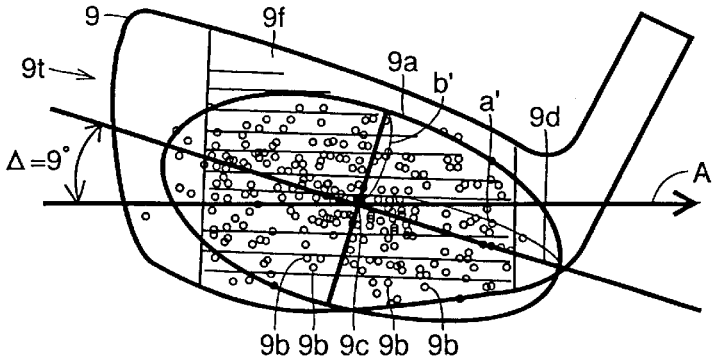

FIGS. 35A to 37B are views showing a distribution of the hitting points of a general player. FIGS. 35A and 35B show a distribution of the hitting points by a third iron golf club. FIGS. 36A and 36B show a distribution of the hitting points by a sixth iron golf club. FIGS. 37A and 37B show a distribution of the hitting points by a ninth iron golf club. As will be clear from FIGS. 35A to 37B, it is understood that a general player strikes at various positions up and down and to the right and left near the sweet spot SS. The player from whom these data have been obtained has a golf score of about 100 and is an average player. In the Figures, the points 3*b*, 6*b*, and 9*b* represent hit marks on the face surfaces 3*f*, 6*f*, and 9*f* of the golf club heads 3, 6, and 9. The hitting point centers are represented by points 3*c*, 6*c*, and 9*c*. Ellipses 3*a*, 6*a*, and 9*a* that approximate the size and the shape of the hitting point distribution by determining an interval covering not less than 95% of the hit marks are shown in a solid line. Further, the A-axis passing through the hitting point centers 3*c*, 6*c*, and 9*c* of the face surfaces 3*f*, 6*f*, and 9*f* and being parallel to the intersecting line of the face surfaces 3*f*, 6*f*, and 9*f* and the ground surface, as well as the major axes 3*d*, 6*d*, and 9*d* of the ellipses 3*a*, 6*a*, and 9*a* approximating the variation of the hitting points, are shown in solid lines.

From this result, the player strikes a golf ball at various locations up and down and to the right and left of the face surfaces 3*f*, 6*f*, and 9*f* of the golf club heads 3, 6, and 9. It is understood that the hitting points are varied in the right-and-left direction from the toe side to the heel side and in the up-and-down direction from the leading edge to the top edge. Since this variation degrades the directivity of the ball after hitting the ball, it is necessary to produce a golf club head that maintains the directivity to some extent even if the hitting points are varied.

On the other hand, as will be seen from the results of the hitting point distribution, the shape of the hitting point distribution is a shape of the ellipses 3*a*, 6*a*, and 9*a* having a major axis and a minor axis. Further, the angle that the major axes 3*d*, 6*d*, and 9*d* form with the A-axis is an angle such that the major axes 3*d*, 6*d*, and 9*d* extend upward and away from the ground surface as they approach the toe parts 3*t*, 6*t*, and 9*t*. In other words, the major axes 3*d*, 6*d*, and 9*d* extend in a toe-up direction. Further, as the identification number increases, the angle that the major axes 3*d*, 6*d*, and 9*d* form with the A-axis increase successively. Also, the shape of the ellipses 3*a*, 6*a*, and 9*a* successively approaches a circular shape. Further, it is understood that the height H of the hitting point centers 3*c*, 6*c*, and 9*c* from the ground surface decreases, as shown in FIGS. 35A to 37B. Thus, it is understood that the shape of the hitting point distribution of a general player has a specific tendency.

In other words, from the aforesaid distribution of the hitting points, the hitting points are positioned approximately within the ellipses 3*a*, 6*a*, and 9*a* having a major axis and a minor axis. The angle Δ that the major axes 3*d*, 6*d*, and 9*d* of the ellipses form with the A-axis extending parallel to the intersecting line of the face surfaces 3*f*, 6*f*, and 9*f* and the ground surface, approaches the toe parts 3*t*, 6*t*, and 9*t*. Also, according as the identification number increases, the angle Δ successively increases, and the shape of the ellipses successively approaches a circular shape. Further, the height H of the points 3*c*, 6*c*, and 9*c* representing the hitting point centers decreases.

The inertial resistance in the direction perpendicular to the face surface of the golf club head can be determined as follows.

Figure 38:
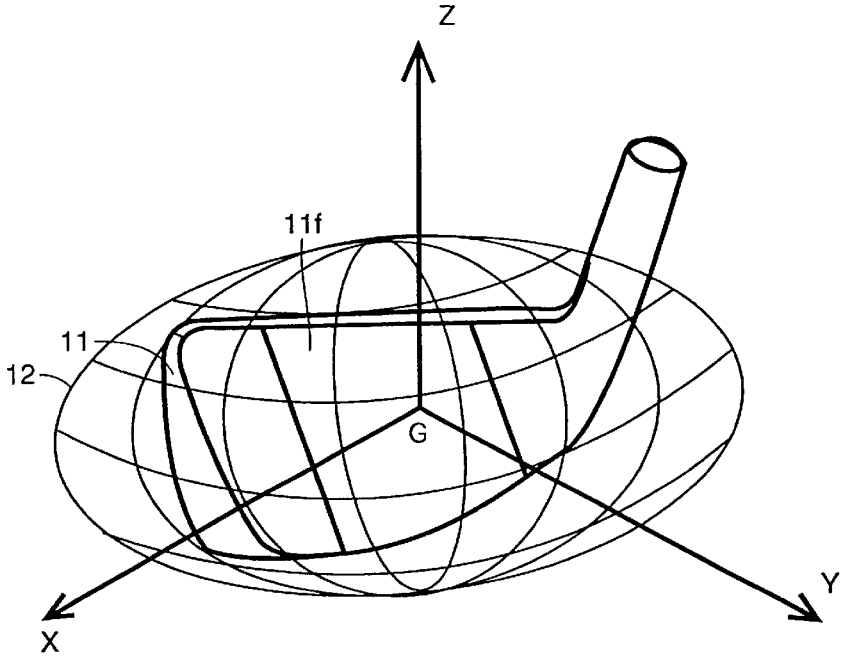
FIG. 38 is a view for explaining the ellipsoid of inertia of an iron golf club head according to the present invention and the X-axis, Y-axis, Z-axis.

FIG. 38 is a view showing a relationship between the ellipsoid of inertia of a golf club head and X-axis, Y-axis, Z-axis. Referring to FIG. 38, the axis passing through the center of gravity G and being perpendicular to the ground surface is assumed to be the Z-axis. The axis passing through the center of gravity G and being perpendicular to the Z-axis and parallel to the intersecting line of the tangential plane at the centroid (center) of the face surface 11*f* and the ground surface is assumed to be the X-axis. The tangential surface at the centroid (center) of the face surface 11*f* is approximately the same surface as the face surface 11*f*. The axis passing through the center of gravity G and being perpendicular to both the X-axis and the Z-axis is assumed to be the Y-axis.

Figure 40:
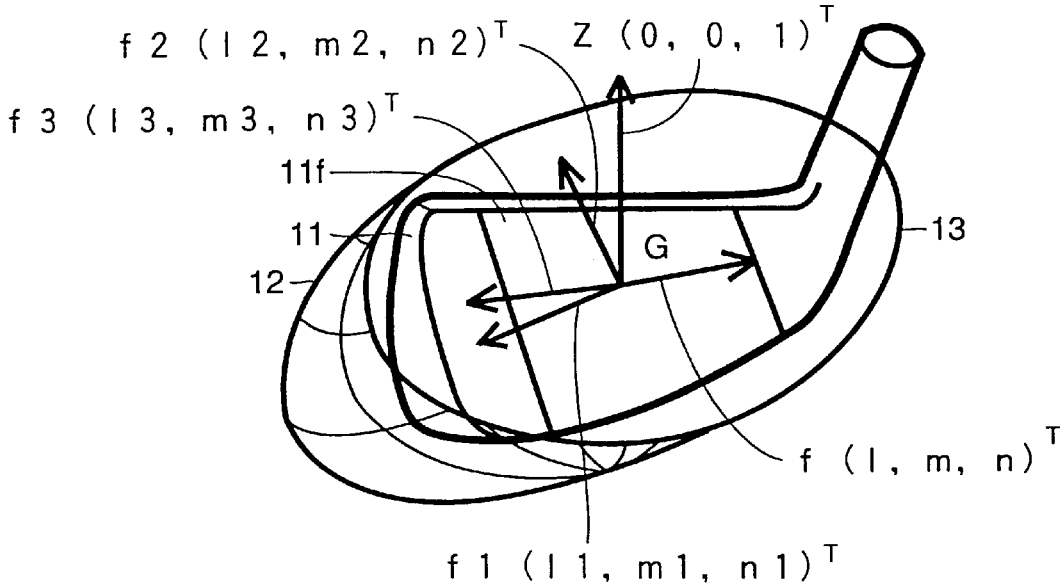
FIG. 40 is a view for explaining the ellipsoid of inertia of an iron golf club head according to the present invention and the direction vectors.

FIG. 40 is a view showing direction vectors on an ellipse plane appearing when the ellipsoid of inertia is cut. Referring to FIG. 40, the direction vector of a plane passing through the center of gravity G and being parallel to the intersecting line of the tangential plane at the centroid of the face surface 11*f* and the ground surface is assumed to be f(l, m, n)$^T$, and each of the following vectors is calculated.

$$f_1(l_1, m_1, n_1)^T = f\ X\ Z(0, 0, 1)^T$$

$$f_2(l_2, m_2, n_2)^T = f_1\ X\ f$$

$$f_3(l_3, m_3, n_3)^T = f_1\ X\ f_2 \quad (1)$$

where X designates an outer product.

Figure 39A:
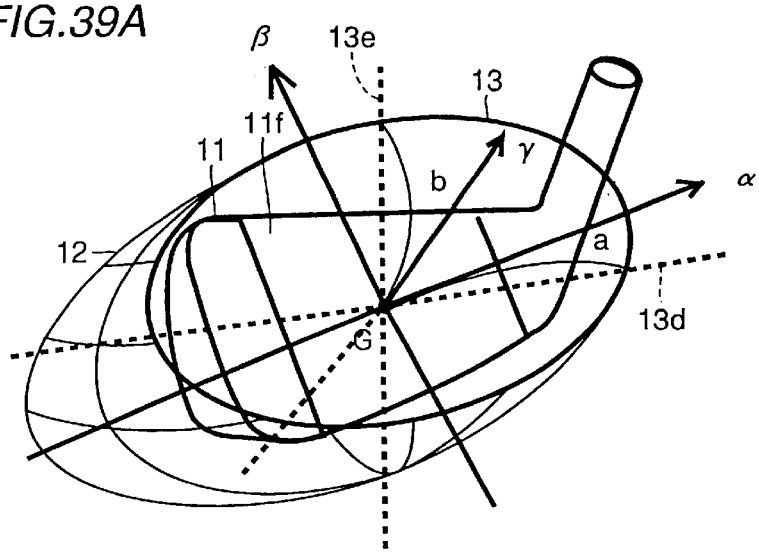
FIGS. 39A to 39C are views for explaining the ellipsoid of inertia of an iron golf club head according to the present invention and the a-axis, β-axis, γ-axis.
Figure 39B:
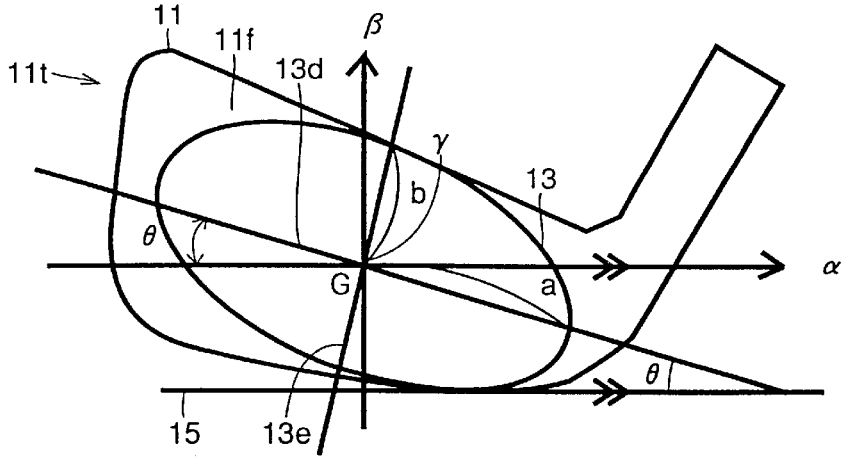
Figure 39C:
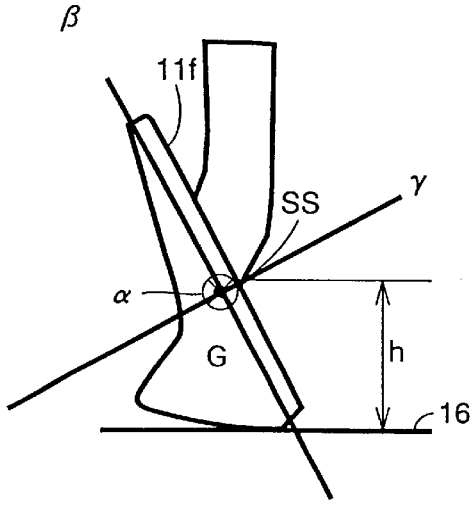

FIGS. 39A, 39B, and 39C are views showing cut surfaces when the ellipsoid of inertia is virtually cut with a plane passing through the center of gravity of a golf club head and being parallel to the face surface. Referring to FIGS. 39A, 39B, and 39C, the axis passing through the center of gravity G and being parallel to the intersecting line of the tangential plane at the centroid of the face surface 11*f* and the ground surface is assumed to be β-axis. The axis being parallel to the tangential plane at the centroid of the face surface 11*f* and perpendicular to the α-axis is assumed to be β-axis. The axis being perpendicular to the α-axis and the β-axis is assumed to be γ-axis. The conversion from the α, β, γcoordinate system to the X, Y, Z coordinate system is represented by the following equations.

$$X = l_1 \cdot \alpha + l_2 \cdot \beta + l_3 \mathbf{19}\ \gamma$$

$$Y = m_1 \cdot \alpha + m_2 \cdot + m_3 \cdot \gamma$$

$$Z = n_1 \cdot \alpha + n_2 \cdot + n_3 \gamma \quad (2)$$

Here, supposing that $I_1$, $I_2$, $I_3$ are moments of inertia with respect to the X, Y, Z axes, $I_{12}$ is a product of inertia with respect to the YZ-plane and the XZ-plane, $I_{13}$ is a product of inertia with respect to the YZ-plane and the XY-plane, $I_{23}$ is a product of inertia with respect to the XZ-plane and the XY-plane, then the following relationship is obtained.

$$I_1 \cdot X^2 + I_2 \cdot Y_2 + I_3 \cdot Z^2 + 2 \cdot I_{12} \cdot X \cdot Y + 2 \cdot I_{13} X \cdot Z + 2 I_{23} \cdot Y \cdot Z = 1 \quad (3)$$

The ellipsoid represented by the equation (3) is referred to as an ellipsoid of inertia. This shows the magnitude of the inertial resistance in each direction. Substituting the equation (3) with the equation (2) and letting the y term zero, the equation (4) of the cut ellipse plane is determined.

$$({}_1 I_1{}^2 + I_2 m_1{}^2 + I_3 n_1{}^2 + I_{12} l_1 m_1 + I_{13} l_1 n_{1+} I_{23} m_1 n_1)\alpha^2$$

$$+(I_1 l_2{}^2 + I_2 m_2{}^2 + I_3 n_2{}^2 + I_{12} l_2 m_2 + I_{13} l_2 n_2 + I_{23} m_2 n_2)\beta^2$$

$$+(I_1 l_1 l_2 + I_2 m_1 m_2 + I_3 n_1 n_2 + I_{12} l_1 m_2 + I_{12} l_2 m_1 + I_{13} l_1 n_2 + I_{132} n_1$$

$$+ I_{23} m_1 n_2 + I_{23} m_2 n_1)\alpha\beta = 1 \quad (4)$$

The magnitude of the cut surface represents the magnitude of the inertial resistance indicating the facility of rotation of this surface. Also, the cut surface represents the inertial resistance in the direction perpendicular to the cut surface. Further, as shown in FIGS. 39A, 39B, and 39C, it is apparent that the shape of the cut surface is a plane ellipse because it is a cut surface of a three-dimensional ellipsoid of inertia.

The plane ellipse appearing when the ellipsoid of inertia 12 of the golf club head 11 is cut with the face surface 11*f* represents the facility of the rotation in the perpendicular direction with respect to the face surface 11*f*. Also, in the plane ellipse 13 appearing on the cut surface when the ellipsoid of inertia 12 is cut with a plane passing through the center of gravity G and being parallel to the face surface 11*f*, the length of the major axis 13*d*, is represented by a and the length of the minor axis 13*e* is represented by b. The aspect ratio is defined by a/b. The angle formed by the major axis 13*d*, and the a axis is assumed to be θ.

The distribution of the hitting points of the player shown in FIGS. 35A to 37B has an elliptic shape with its center at the center of hitting points. Further, the major axes 3*d*, 6*d*, and 9*d* extend to go away from the ground surface as they approach the toe parts 3*t*, 6*t*, and 9*t*. In other words, in the third iron golf club head 3 shown in FIGS. 35A and 35B, the angle Δ formed by the A-axis on the face surface 3*f*and the major axis 3*d*, of the ellipse 3*a* is 5°. In the sixth iron golf club head 6 shown in FIGS. 36A and 36B, the angle Δ formed by the A-axis on the face surface 6*f* and the major axis 6*d* of the ellipse 6*a* is 7°. In the ninth iron golf club head 9 shown in FIGS. 37A and 37B, the angle Δ formed by the A-axis of the golf club head 9 on the face surface 9*f* and the major axis 9*d* of the ellipse 9*a* is 9°.

Therefore, by allowing the sweet spot to be approximately coincident with the center of the plane ellipse appearing when the ellipsoid of inertia 12 is virtually cut with the face surface 11*f*, the distance between the hitting points and the sweet spot can be made as small as possible even if the hitting points are varied. This can restrain the rotation of the golf club head. Further, since the ball is hit in the neighborhood of the sweet spot, the initial velocity of the ball is improved to increase the flying distance.

Furthermore, by allowing the angle θ formed by the major axis 13*d*, of the plane ellipse 13 shown in FIG. 39B and the intersecting line 15 of the cut surface and the ground surface to be coincident with the angle Δ formed by the A-axis and the major axes 3*d*, 6*d*, and 9*d* of the ellipses 3*a*, 6*a*, and 9*a* indicating the hitting point distribution shown in FIGS. 35A to 37B, the deviation of the golf club head in the up-and-down direction and the right-and-left direction can be restrained. Further, the major axis 13*d*, of the ellipse 13, like the major axes 3*d*, 6*d*, and 9*d*, is set to extend away from the ground surface as it approaches the toe part lit. Further, by allowing the aspect ratio a/b which is the ratio of the length a of the major axis 13*d*, and the length b of the minor axis 13*e* of the ellipse 13, to be coincident with the aspect ratio of the ellipses 3*a*, 6*a*, and 9*a* indicating the hitting point distribution of a general player, the inertial resistance in the up-and-down direction and the inertial resistance in the right-and-left direction are allowed to conform to the variation of the hitting points of the general player. This can not only restrain the lateral deviation of the golf club head in the right-and-left direction but also restrain the variation of the flying distance in the flying ball line direction.

According as the identification number increases, the angle θ shown in FIG. 39B is successively increased. Also, the aspect ratio a/b is successively decreased according as the identification number of the golf club head increases. Also, the height h of the sweet spot SS from the ground surface 16 shown in FIG. 39C is successively decreased according as the identification number of the golf club head increases. By constructing a golf club set using these golf club heads, the variation of the flying distance in the right-and-left direction and the flying ball line direction can be restrained for a golf club of any identification number, whereby the flying distance can be increased by improving the speed of the ball.

Figure 41:
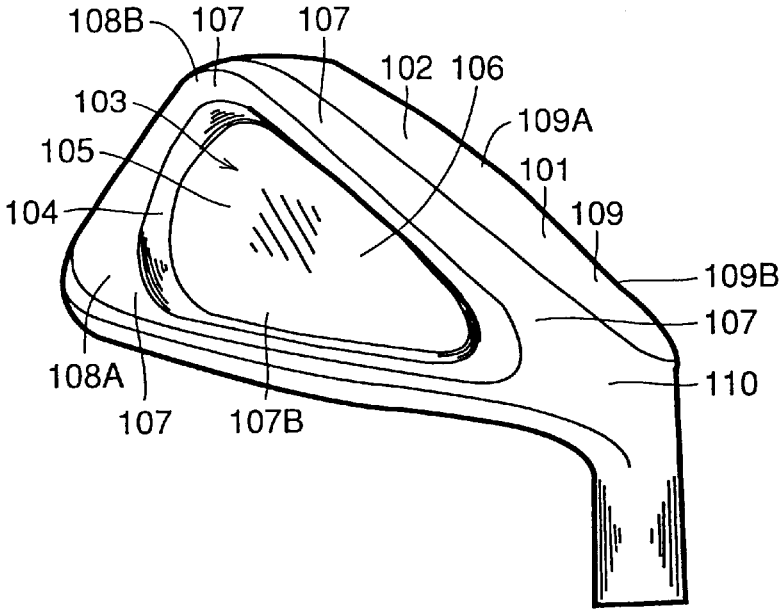
FIG. 41 is a perspective view showing an Example of an iron golf club head according to the present invention.

Specific embodiments according to the present invention will be explained. Referring to FIG. 41, an iron golf club head 101 according to the present invention has a back cavity 106. A through-hole 104 is formed in a face part 103 of a head body 102. A face insert member 105 having a smaller specific gravity than the metal constituting the head body 102 is mounted in the through-hole 104. In a peripheral weight disposing part 107 of the back cavity 106, much weight is distributed and disposed at sites in the upper part 108A of the toe and from the central part 109A of the sole part 109 to the heel part 110.

In other words, in the iron golf club head 101 shown in FIG. 41, the first weight member is disposed in the upper part 108A of the toe of the head body 102. The second weight member is disposed in the heel side part 109B of the sole of the head body 102.

Figure 42:
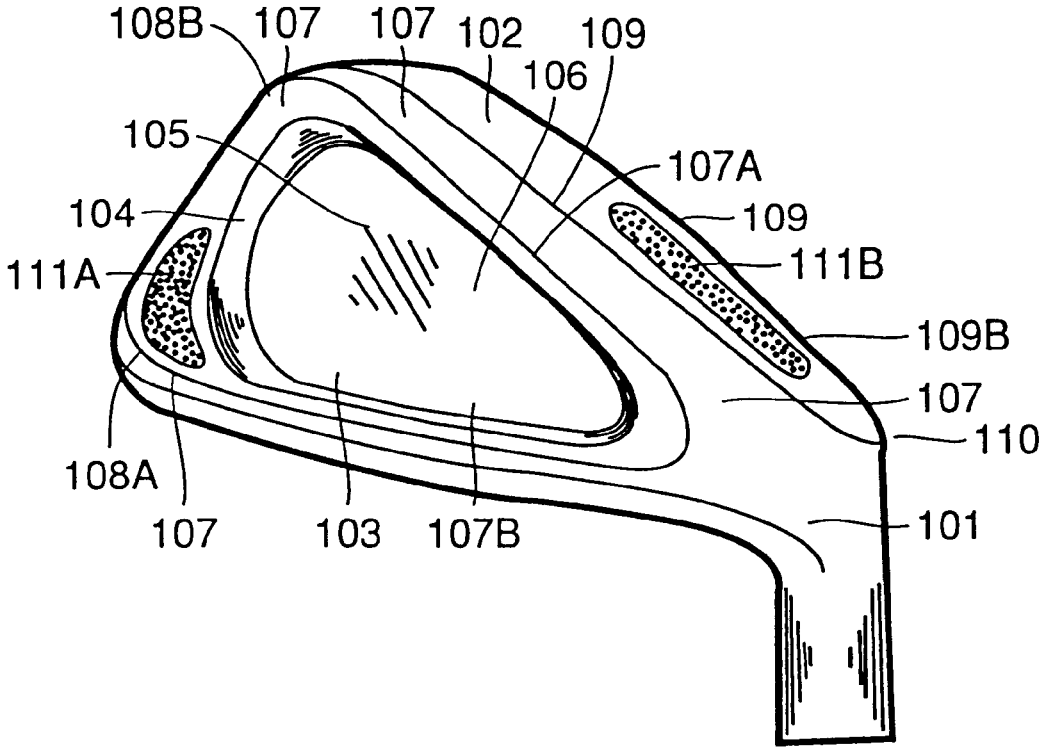
FIG. 42 is a perspective view showing an Example of an iron golf club head according to the present invention.

Referring to FIG. 42, an iron golf club head 101 according to the present invention has a back cavity 106. A through-hole 104 is formed in a face part 103 of a head body 102. A face insert member 105 having a smaller specific gravity than the metal constituting the head body 102 is mounted in the through-hole 104. In a peripheral weight disposing part 107 of the back cavity 106, weight members 111A and 111B having a larger specific gravity than the metal constituting the head body 102 are fitted and integrated by engagement at parts in the upper part 108A of the toe and from the central part 109A of the sole part 109 to the heel part 110.

In other words, the iron golf club head 101 shown in FIG. 42 has a weight member 111 A serving as the first weight member provided in the upper part 108A of the toe of the head body 102, and a weight member 111B serving as the second weight member provided in the heel side part 109B of the sole of the head body 102. The weight members 111A and 111B have a larger specific gravity than the material constituting the head body 102. Also, the weight members 111A and 111B have a larger density than other parts of the head body 102. Also, the density of the upper part 108A of the toe and the heel side part 109B of the sole may be made larger than other parts, for example, by disposing a metal densely on the upper part 108A of the toe and the heel side part 109B of the sole and by forming a hollow hole in the metal at other parts.

Figure 43A:
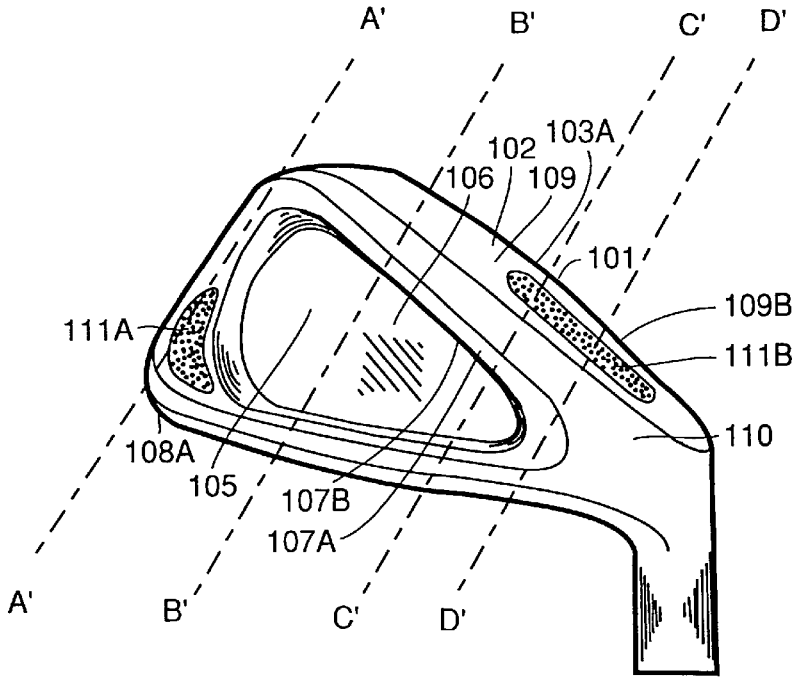
FIG. 43A is a perspective view showing an Example that clearly describes a cut part of an iron golf club head according to the present invention.
Figure 43B:
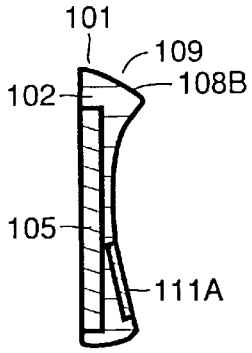
FIGS. 43B to 43E are cross section views of an essential part showing cross sections of the A'—A' part to the D'—D' part in FIG. 43A.
Figure 43C:
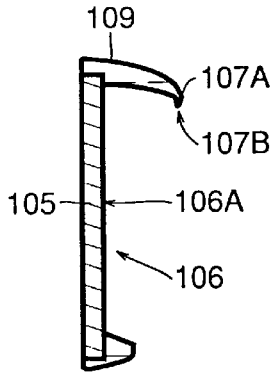
Figure 43D:
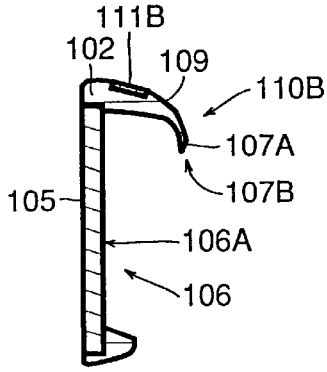
Figure 43E:
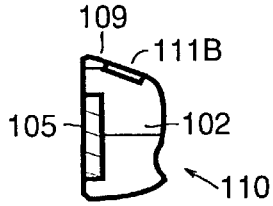

As shown in FIGS. 43A to 43E, in the peripheral weight disposing part 107 of the back cavity 106, the height of the rear back 107A is constructed to become successively higher from the lower part 108B of the toe to the sole part 110B. Namely, the depth of the back cavity 106 increases according as it approaches from the lower part 108B of the toe to the heel part 110. Here, as shown in FIGS. 43B and 43E, it is a characteristic of the present invention that the rear back 107A of the peripheral weight disposing part 107 of the back cavity 106 is not provided in the lower part 108B of the toe and in the heel part 110 of the sole part 109. By providing such a construction, more weight can be distributed and disposed at sites in the upper part 108A of the toe and from the central part 109A of the sole part 109 to the heel part 110.

Further, as shown in FIGS. 43A to 43E, the width of the sole part 109 successively decreases according as it approaches from the lower part 108B of the toe to the heel part 110.

Further, examples of the present invention will be explained in detail. The head body 102 is made of stainless steel. Pure titanium is used as the face insert member 105, and this is press-fit and fixed.

Also, a tungsten alloy having a larger specific gravity than the head body 102 is used as the weight members 111A and 111B. The weight member 111A is press-fit and integrated by engagement to the upper part 108A of the toe of the peripheral weight disposing part 107 of the back cavity 106, and its mass is 3 g. The weight member 111B is press-fit and integrated by engagement to the sites from the central part 109A of the sole part 109 to the heel part 110, and its mass is 8 g.

Here, lead, beryllium copper alloy, brass, and others can be used besides the aforesaid tungsten alloy as the weight member 111 having a larger specific gravity than the head body 102. These are press-fit and integrated by engagement to the sites in the upper part 108A of the toe and from the central part 109A of the sole part 109 to the heel part 110 of the peripheral weight disposing part 107 of the back cavity 106.

In the face part 103 or in the upper opening part 107B of the peripheral weight disposing part 107 of the back cavity 106, the distance from the face surface part 106A of the back cavity 106 to the upper opening part 107 is about 15 mm, for example, in the case of the fifth iron golf club head. The height of the rear back 107A of the peripheral weight disposing part 107 of the back cavity 106 is 7 mm at a position shifted by 20 mm from the central part 103A of the face to the toe part side. The height of the rear back 107A is 9 mm at the central part 103A of the face. The height of the rear back 107A is 12 mm at a position shifted by 12 mm from the central part 103A of the face to the heel part side, and successively increases as it approaches the heel part 110.

As a result of this, the weights are disposed in the upper part 108A of the toe and in the lower part of the heel part 110. As a result of it, the angle formed by the major axis of the plane ellipse appearing when the ellipsoid of inertia is cut and the intersecting line of the cut surface and the ground surface increases as it approaches the upper part 8A of the toe, and the height of the sweet spot decreases.

Next, as the material constituting the head body 102, one can use a metal material such as iron, stainless steel, aluminum, titanium, magnesium, tungsten, copper, nickel, zirconium, cobalt, manganese, zinc, silicon, tin, or chromium, which are materials often used in generally producing a golf club head. Also, an alloy material of these metals, FRP (fiber reinforced plastics), synthetic resin, ceramics, rubber, and others can be used. It may be produced from a single material of these or may be produced from a combination of two or more kinds of these materials.

Also, as a production method, use of a precision casting method is highly convenient because the cost will be low and the dimension precision is high. In addition, the head body can be produced by die-casting, pressing, or forging. It is also possible to produce each of the parts by pressing, forging, precision casting, metal injection, die-casting, cut-processing, powder-metallurgy, or the like and bonding these by welding, adhesion, press-fit, fitting engagement, press-contact, screwing, soldering, or the like to fabricate a golf club head.

Figure 44:
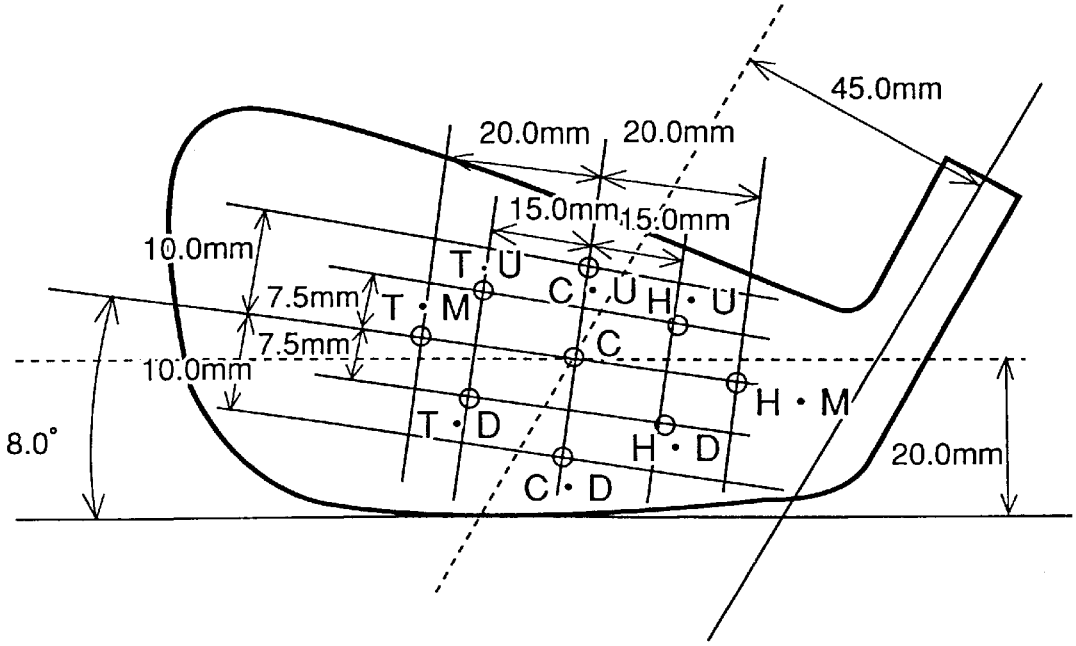
FIG. 44 is a view showing hitting point positions of an iron golf club head.
Figure 45A:
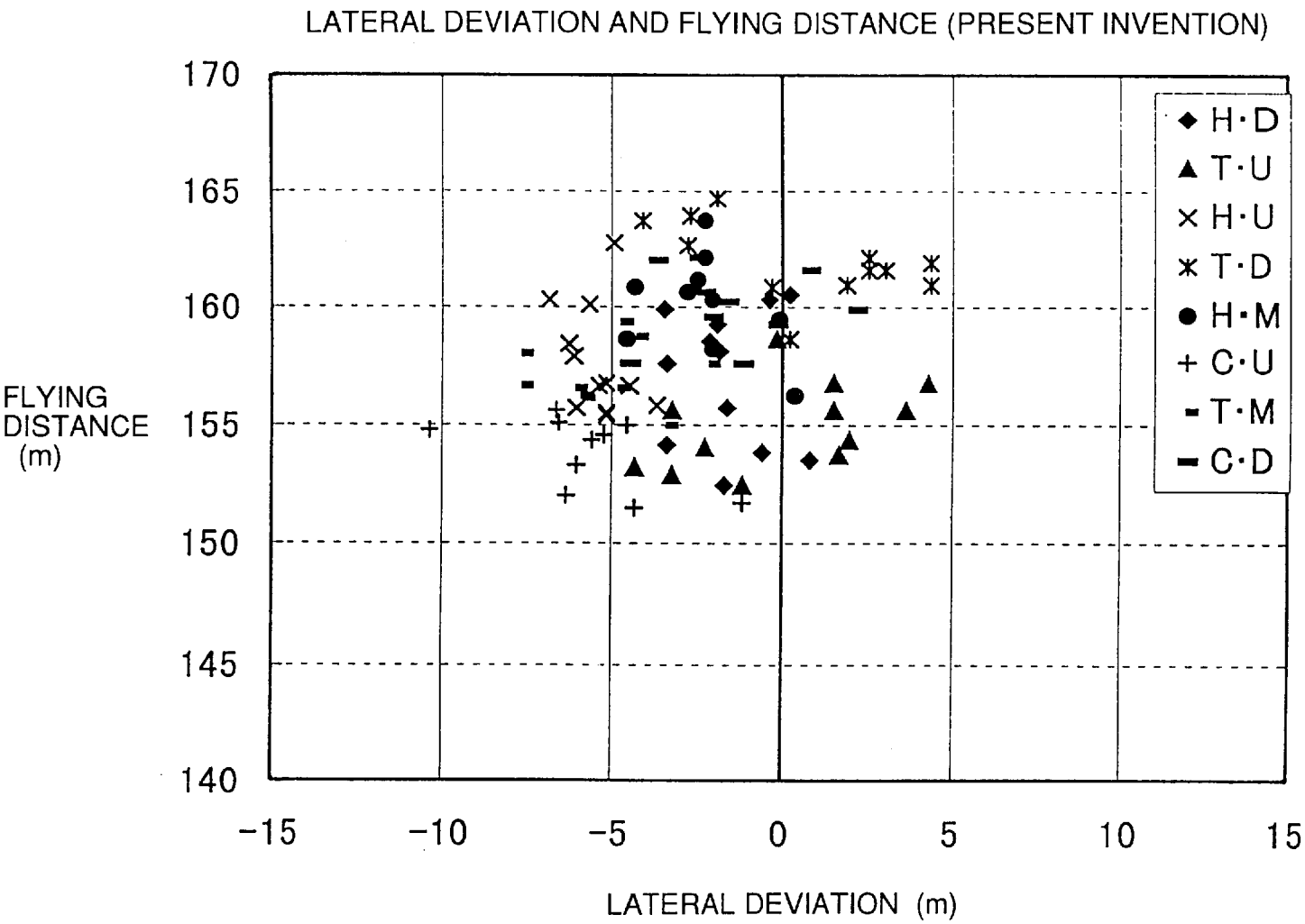
FIG. 45A is a graph showing a flying distance and a variation of an iron golf club head according to the present invention.
Figure 45B:
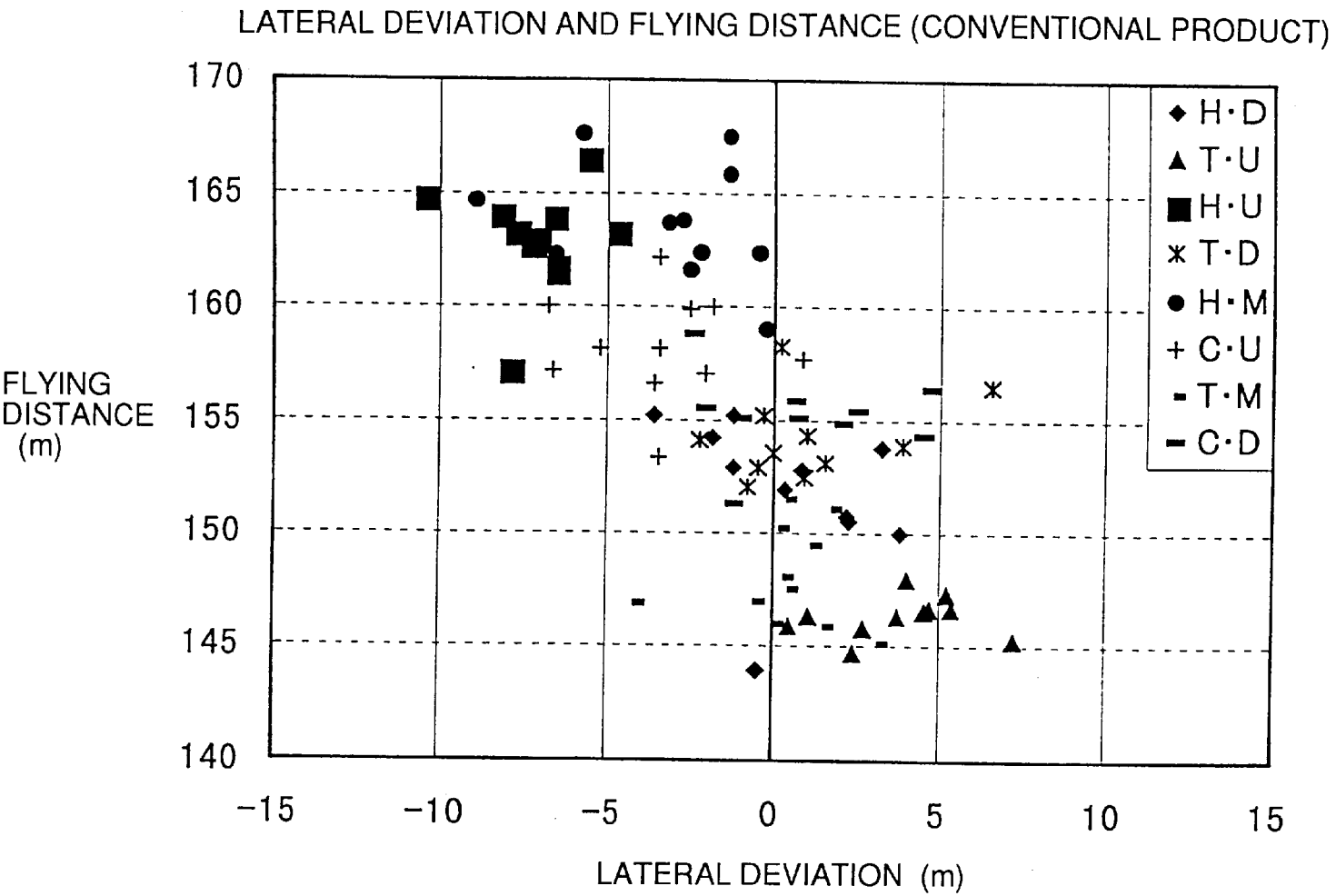
FIG.45B PRIOR ART
FIG. 45B is a graph showing a flying distance and a variation of a conventional iron golf club head.

FIGS. 44 to 45B are views for comparing the variations of the flying distance between the golf club head according to the present invention and a conventional golf club head. Particularly, FIG. 45A shows data for the golf club head according to the present invention, and relates to the third iron having a loft angle of 21°. The plane ellipse appearing when the ellipsoid of inertia of the golf club head is cut with a plane parallel to the face surface is made approximately coincident with the distribution of the hitting points of a general player. FIG. 45B shows data in the case of a conventional golf club head.

A test was performed with a golf robot. The speed of the iron golf club head was set to be 34.5 m/sec. Taking the variation of the hitting points of the general player into account, the hitting point positions were set to be from sweet spot (C) to toe tip part (T·M), upper part of toe tip (T·U), lower part of toe (T·D), upper part of heel (H·U), lower part of heel (H·D), foot part of heel (HEM), upper part of center (C·U), and lower part of center (C·D), as shown in FIG. 44. The results of striking at respective points are shown. Here, the specifications of the inventive product and the conventional product are shown in Table 4.

TABLE 4

| Sample | Angle formed by the major axis of the plane ellipse appearing on the cut surface of the ellipsoid of inertia and the intersecting line of the cut surface and the ground surface | Aspect ratio of the plane ellipse appearing on the cut surface of the ellipsoid of inertia | Sweet spot height |
|---|---|---|---|
| Inventive product | 8° | 2.2 | 20.0 mm |
| Conventional product | 0° | 2.1 | 20.7 mm |

On the other hand, the iron golf club head used in collecting the data shown in FIG. 45A has the same mass (248 g) as the iron golf club head used for collecting the data shown in FIG. 45B. Referring to FIG. 44, when the ellipsoid of inertia is cut with a plane passing through the center of gravity and being parallel to the face surface, the aspect ratio of the plane ellipse appearing on the cut surface is 2.2; the angle formed by the major axis and the intersecting line of the cut surface and the ground surface extends in a toe-up direction to be 8°; and the height of the center of hitting points was 20 mm.

From the results of the flying distance measurement test by the robot, in the case of a golf club head in which the plane ellipse is made coincident with the distribution of the hitting points of the general player, the variation to the right and left is about 15 m, as shown in FIG. 45A, thereby reducing the variation by 17%, while in the golf club head that does not conform to the distribution of the hitting points of the general player, the variation to the right and left is about 18 m, as shown in FIG. 45B.

On the other hand, with respect to the variation in the flying ball line direction, the variation is about 24 m in the case of the conventional product, as shown in FIG. 45B. In contrast, the variation in the flying ball line direction is about 13 m in the case of the inventive product, as shown in FIG. 45A, thereby reducing the variation by 46%. Further, when the average flying distance is compared, the average flying distance is 155 m in the case of the conventional product, as shown in FIG. 45B. In contrast, the average flying distance is 157 m in the case of the inventive product, as shown in FIG. 45A, thereby increasing the flying distance by about 2 m.

Here, FIGS. 45A and 45B show average values when balls were hit each for eleven times.

Also, when the results of striking on the upper part of the toe tip are observed, it is well understood that there is a difference in the rotation performance. Namely, with the conventional product, the decrease in the flying distance in the flying ball line direction due to striking on the upper part of the toe tip is conspicuous, as shown in FIG. 45B, and further, the balls fall in the right direction as compared with the average lateral deviation. In contrast, with the inventive product, the decrease in the flying distance due to striking on the upper part of the toe tip is small, as shown in FIG. 45A, and the lateral deviation is also small. This means that, with the inventive product, the rotation of the golf club head is restrained as compared with the conventional Product, and it is understood that the rotation performance of the head is excellent.

Here, the golf club head shown in FIG. 44 is provided with a weight member such as in the golf club head shown in FIG. 42.

Different embodiments of the present invention will be explained.

Figure 46A:
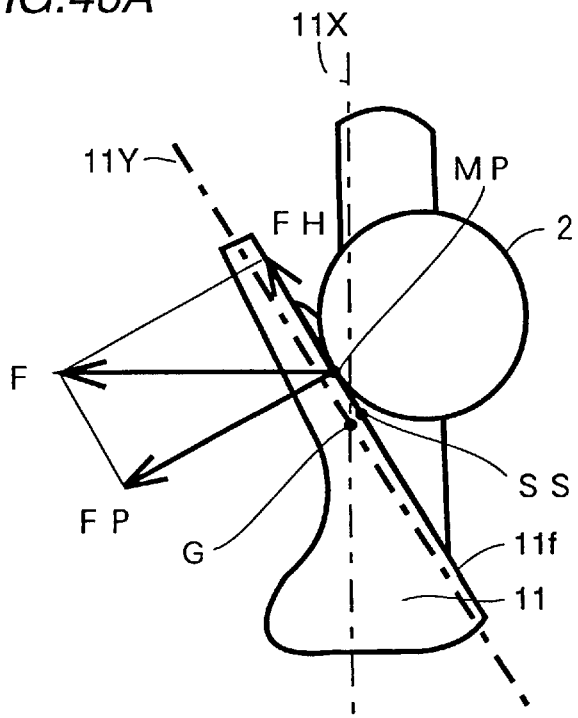
FIGS. 46A and 46B are views for explaining the principle of an iron golf club head according to the present invention.
Figure 46B:
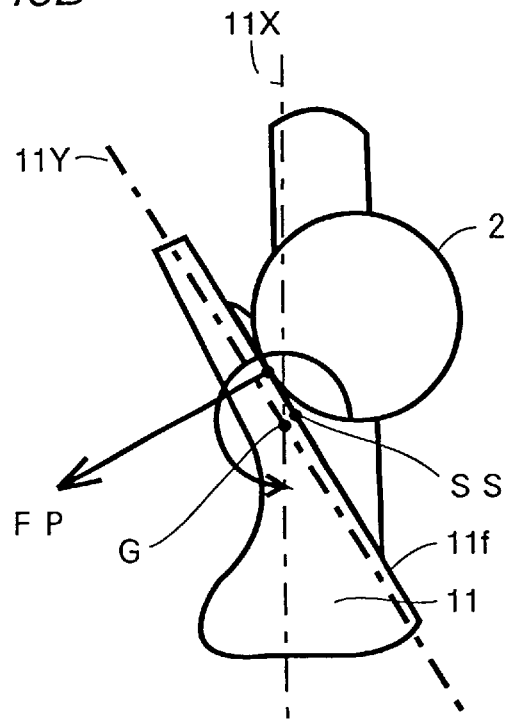

FIGS. 46A and 46B are views for explaining the principle of the present invention. FIG. 46A is a view for explaining a striking force generated on a face surface when a golf ball is hit with a golf club head. FIG. 46B is a view showing a state in which the face is rotated and the ball flies out at the striking time.

Referring to FIG. 46A, when a golf ball is struck with a golf club, an iron golf club head 11 receives a striking force F from the golf ball 2 in the proceeding direction of the swing at the hitting point position MP of the golf ball 2. In the golf club, an angle is formed between a sole and a face surface 11*f* in order to change the flying-out angle of the golf ball 2 in accordance with the identification number and to obtain a flying distance for each identification number. This angle is referred to as a loft angle. Typically, the loft angle is set to be about 10° in the case of a driver, about 20° in the case of a third iron, and about 40° in the case of a ninth iron. The loft angle increases according as the identification number increases.

Due to the presence of the loft angle, the striking force F at the striking time can be decomposed into a horizontal partial force FH and a perpendicular partial force FP with respect to the face surface 11*f*. The horizontal partial force FH is a force that rotates the golf ball 2 together with a frictional force of the face surface 11*f*, namely, it generates a back spin or a side spin. According as the swing speed increases and the impacting speed of the golf club head increases, the striking force F increases and the horizontal partial force FH increases, so that the back spin and the side spin are more likely to be generated. The ball trajectory of an iron of a professional golfer rises high above after the shot, and then falls vertically from above. This is due to the fact that, since the head speed is high, a back spin is generated, and the ball floats upward and falls down.

Also, the perpendicular partial force FP is a force that acts perpendicularly on the face surface 11*f*, as shown in FIG. 46B, and this force rotates the face surface 11*f*. By this rotation, the golf ball 2 after the shot flies out in the right-and-left direction and in the up-and-down direction. Here, the point at which the line drawn perpendicularly from the center of gravity G of the golf club head 11 to the face surface 11*f* intersects the face surface 11*f* is referred to as a sweet spot SS. The sweet spot SS is a point by which the golf ball flies most and, if the ball is struck here, the golf club head 11 rotates little. However, if a general players performs a shot, the ball hardly hits the sweet spot SS, and the player performs a shot in the peripheries of the sweet spot SS.

Figure 47A:
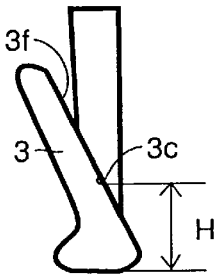
FIGS. 47A and 47B are views showing a distribution of the hitting points of a general player with a third iron.
Figure 47B:
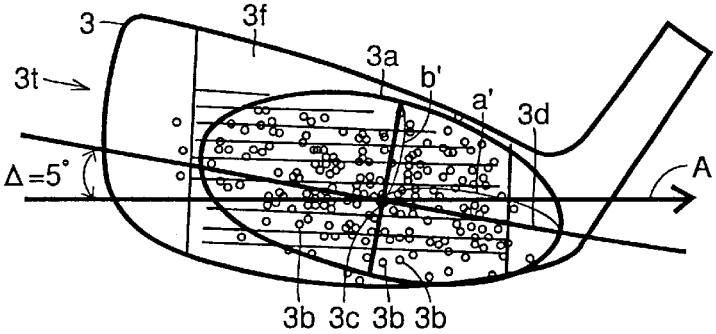
Figure 48A:
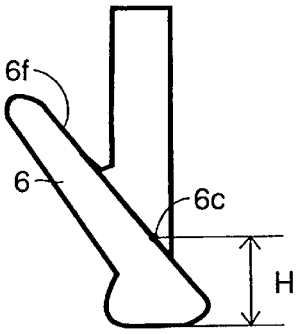
FIGS. 48A and 48B are views showing a distribution of the hitting points of a general player with a sixth iron.
Figure 48B:
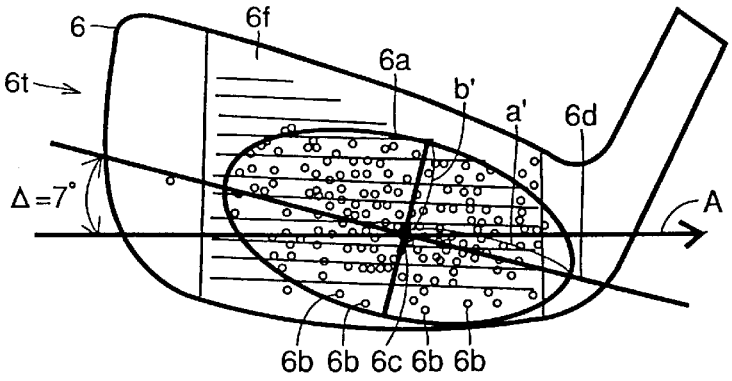
Figure 49A:
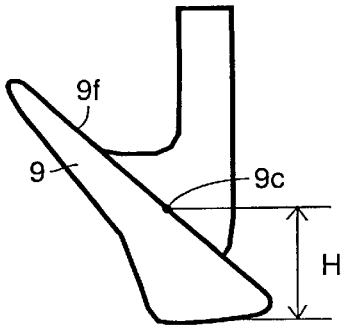
FIGS. 49A and 49B are views showing a distribution of the hitting points of a general player with a ninth iron.
Figure 49B:
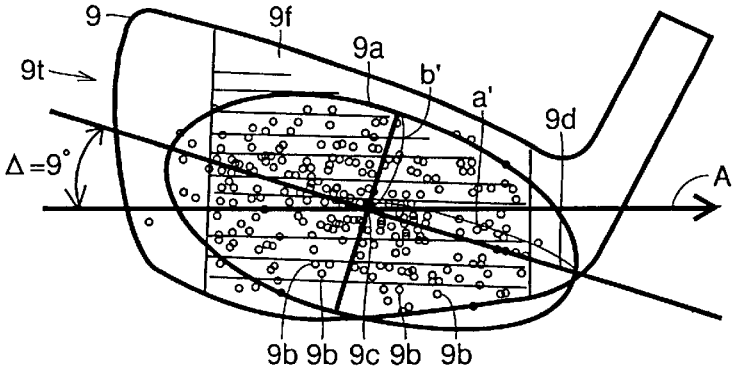

FIGS. 47A to 49B are views showing a distribution of the hitting points of a general player. FIGS. 47A and 47B show a distribution of the hitting points by a third iron golf club. FIGS. 48A and 48B show a distribution of the hitting points by a sixth iron golf club. FIGS. 49A and 49B show a distribution of the hitting points by a ninth iron golf club. As will be clear from FIGS. 47A to 49B, it is understood that a general player strikes at various positions up and down and to the right and left near the sweet spot SS. The player from whom these data have been obtained has a golf score of about 100 and is an average player. In the Figures, the points 3*b*, 6*b*, and 9*b* represent hit marks on the face surfaces 3*f*, 6*f*, and 9*f* of the golf club heads 3, 6, and 9. The hitting point centers are represented by points 3*c*, 6*c*, and 9*c*. Ellipses 3*a*, 6*a*, and 9*a* that approximate the size and the shape of the hitting point distribution by determining an interval covering not less than 95% of the hit marks are shown in a solid line. Further, the A-axis passing through the hitting point centers 3*c*, 6*c*, and 9*c* of the face surfaces 3*f*, 6*f*, and 9*f* and being parallel to the intersecting line of the face surfaces 3*f*, 6*f*, and 9*f* and the ground surface, as well as the major axes 3*d*, 6*d*, and 9*d* of the ellipses 3*a*, 6*a*, and 9*a* approximating the variation of the hitting points, are shown in solid lines.

From this result, the player strikes a golf ball at various locations up and down and to the right and left of the face surfaces 3*f*, 6*f*, and 9*f* of the golf club heads 3, 6, and 9. It is understood that the hitting points are varied in the right-and-left direction from the toe side to the heel side and in the up-and-down direction from the leading edge to the top edge. Since this variation degrades the directivity of the ball after hitting the ball, it is necessary to produce a golf club head that maintains the directivity to some extent even if the hitting points are varied.

On the other hand, as will be seen from the results of the hitting point distribution, the shape of the hitting point distribution is a shape of the ellipses 3*a*, 6*a*, and 9*a* having a major axis and a minor axis. Further, the angle that the major axes 3*d*, 6*d*, and 9*d* form with the A-axis is an angle such that the major axes 3*d*, 6*d*, and 9*d* extend upward and away from the ground surface as they approach the toe parts 3*t*, 6*t*, and 9t. In other words, the major axes 3*d*, 6*d*, and 9*d* extend in a toe-up direction. Further, according as the identification number increases, the angle that the major axes 3*d*, 6*d*, and 9*d* form with the A-axis increases successively. Also, the shape of the ellipses 3*a*, 6*a*, and 9*a* successively approaches a circular shape. Further, it is understood that the height H of the hitting point centers 3*c*, 6*c*, and 9*c* from the ground surface decreases, as shown in FIGS. 47A to 49B. Thus, it is understood that the shape of the hitting point distribution of a general player has a specific tendency.

In other words, from the aforesaid distribution of the hitting points, the hitting points are positioned approximately within the ellipses 3*a*, 6*a*, and 9*a* having a major axis and a minor axis. The angle Δ that the major axes 3*d*, 6*d*, and 9*d* of the ellipses form with the A-axis extending parallel to the intersecting line of the face surfaces 3*f*, 6*f*, and 9*f* and the ground surface, approaches the toe parts 3*t*, 6*t*, and 9*t*. Also, according as the identification number increases, the angle Δ successively increases, and the shape of the ellipses successively approaches a circular shape. Further, the height H of the points 3*c*, 6*c*, and 9*c* representing the hitting point centers decreases.

The inertial resistance in the direction perpendicular to the face surface of the golf club head can be determined as follows.

Figure 50:
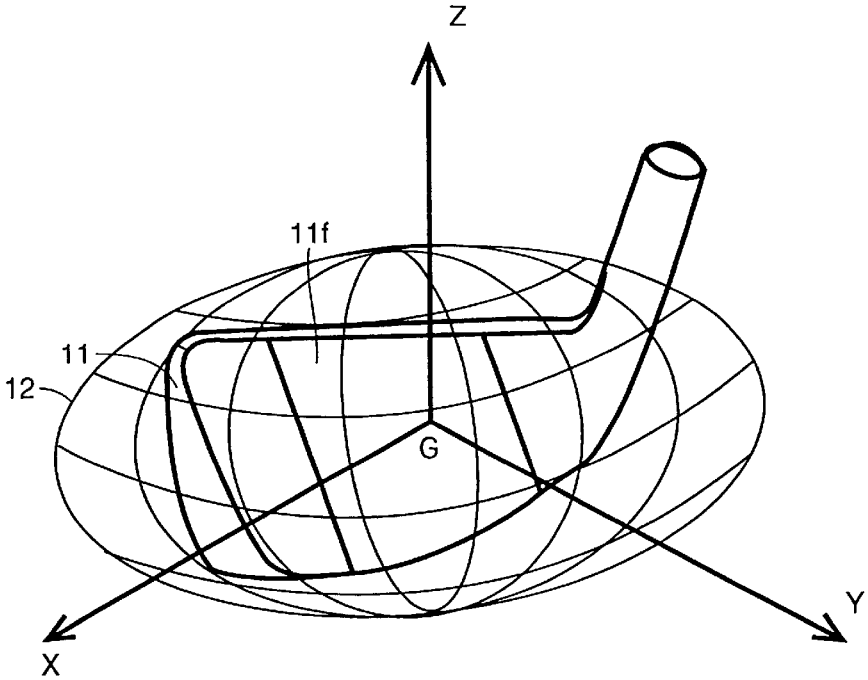
FIG. 50 is a view for explaining the ellipsoid of inertia of an iron golf club head according to the present invention and the X-axis, Y-axis, Z-axis.

FIG. 50 is a view showing a relationship between the ellipsoid of inertia of a golf club head and X-axis, Y-axis, Z-axis. Referring to FIG. 50, the axis passing through the center of gravity G and being perpendicular to the ground surface is assumed to be the Z-axis. The axis passing through the center of gravity G and being perpendicular to the Z-axis and parallel to the intersecting line of the tangential plane at the centroid (center) of the face surface 11*f* and the ground surface is assumed to be the X-axis. The tangential surface at the centroid (center) of the face surface 11*f* is approximately the same surface as the face surface 11*f*. The axis passing through the center of gravity G and being perpendicular to both the X-axis and the Z-axis is assumed to be the Y-axis.

Figure 52:
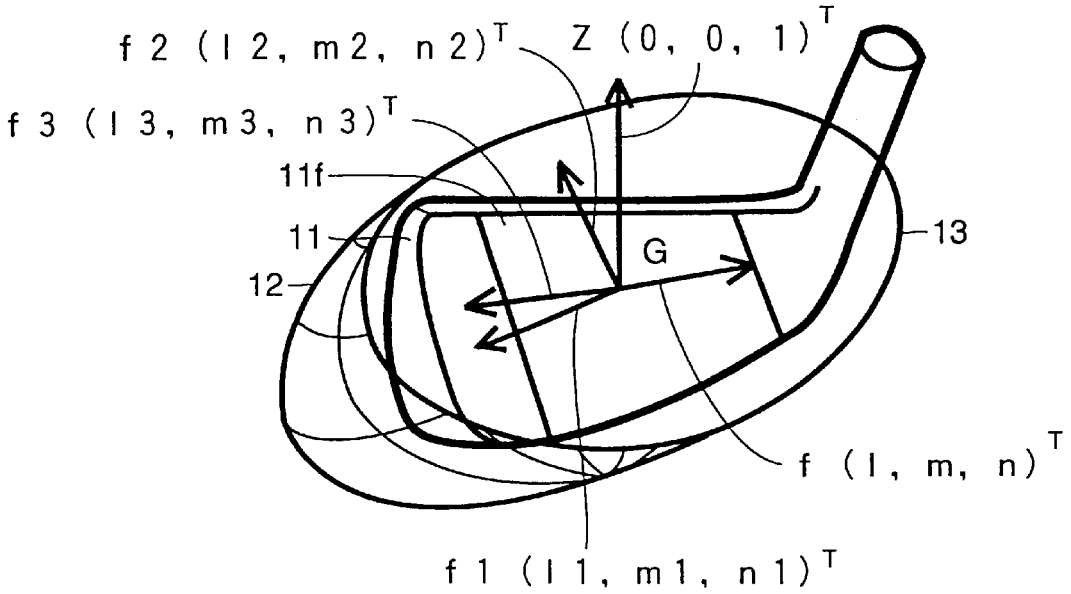
FIG. 52 is a view for explaining the ellipsoid of inertia of an iron golf club head according to the present invention and the direction vectors.

FIG. 52 is a view showing direction vectors on an ellipse plane appearing when the ellipsoid of inertia is cut. Referring to FIG. 52, the direction vector of a plane passing through the center of gravity G and being parallel to the intersection of the tangential plane at the centroid of the face surface 11*f* and the ground surface is assumed to be f(l, m, n)$^T$, and each of the following vectors is calculated.

$$f_1(_1, m_1, n_1)^T = f\,X\,Z(0, 0, 1)^T$$

$$f_2(l_2, m_2, n_2)^T = f_1 X f$$

$$f_3(l_3, m_3, n_3)^T = f, X f_2 \tag{1}$$

where X designates an outer product.

Figure 51A:
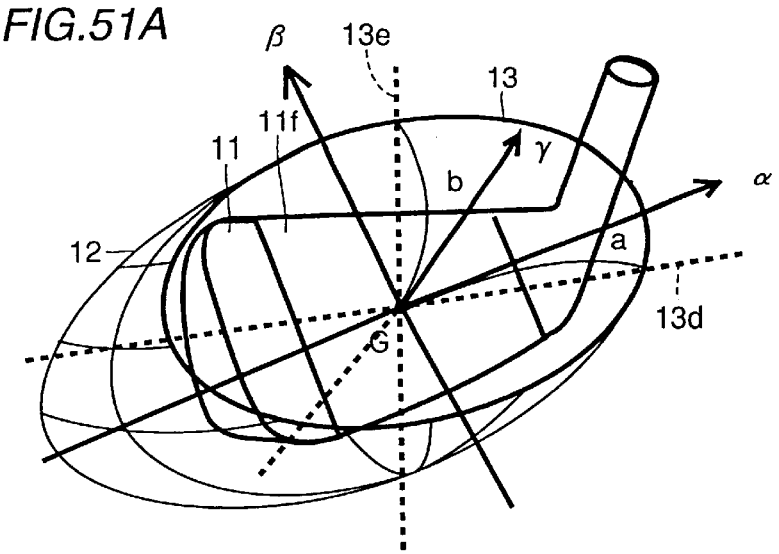
FIGS. 51A to 51C are views for explaining the ellipsoid of inertia of an iron golf club head according to the present invention and the α-axis, β-axis, γ-axis.
Figure 51B:
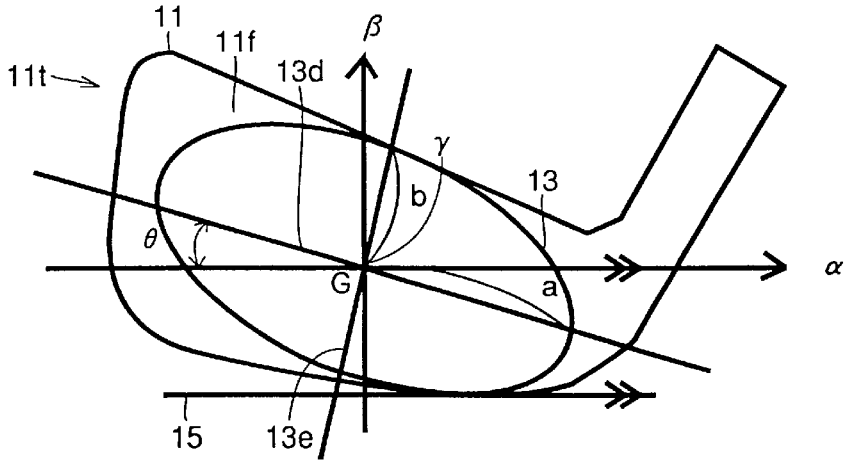
Figure 51C:
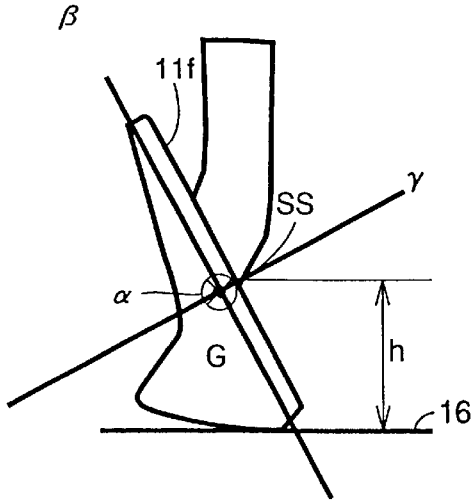

FIGS. 51A, 51B, and 51C are views showing cut surfaces when the ellipsoid of inertia is virtually cut with a plane passing through the center of gravity of a golf club head and being parallel to the face surface. Referring to FIGS. 51A, 51B, and 51C, the axis passing through the center of gravity G and being parallel to the intersecting line of the tangential plane at the centroid of the face surface 11*f* and the ground surface is assumed to be α-axis. The axis being parallel to the tangential plane at the centroid of the face surface 11*f* and perpendicular to the α-axis is assumed to be β-axis. The axis being perpendicular to the α-axis and the P-axis is assumed to be γ-axis. The conversion from the αβ, γ coordinate system to the X, Y, Z coordinate system is represented by the following equations.

$$X = l_1 \cdot \alpha + l_2 \cdot \alpha + l_3 \cdot \gamma$$

$$Y = m_1 \cdot \alpha + m_2 \cdot \beta + m_{3 \cdot \gamma}$$

$$Z = n_1 \cdot \alpha + n_2 \cdot + n_{3 \cdot \gamma} \tag{2}$$

Here, supposing that $I_1$, $I_2$, $I_3$ are moments of inertia with respect to the X, Y, Z axes, 112 is a product of inertia with respect to the YZ-plane and the XZ-plane, $I_{13}$ is a product of inertia with respect to the YZ-plane and the XY-plane, $I_{23}$ is a product of inertia with respect to the XZ-plane and the XY-plane, then the following relationship is obtained.

$$I_1 \cdot X^2 + I_2 \cdot Y^2 + I_{3 \cdot Z}{}^2 + 2 \cdot I_{12} \cdot X \cdot Y + 2 \cdot I_{13} \cdot X \cdot Z + 2 I_{23} \cdot Y \cdot Z = 1 \tag{3}$$

The ellipsoid represented by the equation (3) is referred to as an ellipsoid of inertia. This shows the magnitude of the inertial resistance in each direction. Substituting the equation (3) with the equation (2) and letting the y term zero, the equation (4) of the cut ellipse plane is determined.

$$(I_1 l_1{}^2 + I_2 m_1{}^2 + I_3 n_1{}^2 + I_{12} l_1 m_1 + I_{13} l_1 n_1 + I_{23} m_1 n_1)\alpha^2$$

$$+ (I_1 l_2{}^2 + I_2 m_2{}^2 + I_3 n_2{}^2 I_{12} l_2 m_2 + I_{13} l_2 n_2 + I_{23} m_2 n_2)\beta^2$$

$$+(I_1l_1l_2+I_2m_1m_2I_3n_1n_2+I_{12}m_2+I_{12}l_2m_1+I_{13}l_1n_2+I_{13}l_2n_1$$

$$+I_{23}m_1n_2+I_{23}m_2n_1)\alpha\beta 1 \quad (4)$$

The magnitude of the cut surface represents the magnitude of the inertial resistance indicating the facility of rotation of this surface. Also, the cut surface represents the inertial resistance in the direction perpendicular to the cut surface. Further, as shown in FIGS. 51A, 51B, and 51C, it is apparent that the shape of the cut surface is a plane ellipse because it is a cut surface of a three-dimensional ellipsoid of inertia.

The plane ellipse appearing when the ellipsoid of inertia 12 of the golf club head 11 is cut with the face surface 11*f* represents the facility of the rotation in the perpendicular direction with respect to the face surface 11*f*. Also, in the plane ellipse 13 appearing on the cut surface when the ellipsoid of inertia 12 is cut with a plane passing through the center of gravity G and being parallel to the face surface 11*f*, the length of the major axis 13*d* is represented by a and the length of the minor axis 13*e* is represented by b. The aspect ratio is defined by a/b. The angle formed by the major axis 13*d* and the a axis is assumed to be θ.

The distribution of the hitting points of the player shown in FIGS. 47A to 49B has an elliptic shape with its center at the center of hitting points. Further, the major axes 3*d*, 6*d*, and 9*d* extend to go away from the ground surface as they approach the toe parts 3*t*, 6*t*, and 9*t*. In other words, in the third iron golf club head 3 shown in FIGS. 47A and 47B, the angle Δ formed by the A-axis on the face surface 3*f* and the major axis 3*d*, of the ellipse 3*a* is 5°. In the sixth iron golf club head 6 shown in FIGS. 48A and 48B, the angle Δ formed by the A-axis on the face surface 6*f* and the major axis 6*d* of the ellipse 6*a* is 7°. In the ninth iron golf club head 9 shown in FIGS. 49A and 49B, the angle Δ formed by the A-axis of the golf club head 9 on the face surface 9*f* and the major axis 9*d* of the ellipse 9*a* is 9°.

Therefore, by allowing the sweet spot to be approximately coincident with the center of the plane ellipse appearing when the ellipsoid of inertia 12 is virtually cut with the face surface 11*f*, the distance between the hitting points and the sweet spot can be made as small as possible even if the hitting points are varied. This can restrain the rotation of the golf club head. Further, since the ball is hit in the neighborhood of the sweet spot, the initial velocity of the ball is improved to increase the flying distance.

Furthermore, by allowing the angle θ formed by the major axis 13*d*, of the plane ellipse 13 shown in FIG. 51B and the intersecting line 15 of the cut surface and the ground surface to be coincident with the angle Δ formed by the A-axis and the major axes 3*d*, 6*d*, and 9*d* of the ellipses 3*a*, 6*a*, and 9*a* indicating the hitting point distribution shown in FIGS. 47A to 49B, the deviation of the golf club head in the up-and-down direction and the right-and-left direction can be restrained. Further, the major axis 13*d* of the ellipse 13, like the major axes 3*d*, 6*d*, and 9*d*, is set to extend away from the ground surface as it approaches the toe part lit. Further, by allowing the aspect ratio a/b which is the ratio of the length a of the major axis 13*d* to the length b of the minor axis 13*e* of the ellipse 13, to be coincident with the aspect ratio a'/b' of the ellipses 3*a*, 6*a*, and 9*a* indicating the hitting point distribution of a general player, the inertial resistance in the up-and-down direction and the inertial resistance in the right-and-left direction are allowed to conform to the variation of the hitting points of the general player. This can not only restrain the lateral deviation of the golf club head in the right-and-left direction but also restrain the variation of the flying distance in the flying ball line direction.

According as the identification number increases, the angle θ shown in FIG. 51B is successively increased. Also, the aspect ratio a/b is successively decreased according as the identification number of the golf club head increases. Also, the height h of the sweet spot SS from the ground surface 16 shown in FIG. 51C is successively decreased according as the identification number of the golf club head increases. By constructing a golf club set using these golf club heads, the variation of the flying distance in the right-and-left direction and the flying ball line direction can be restrained for a golf club of any identification number, whereby the flying distance can be increased by improving the speed of the ball.

Figure 53:
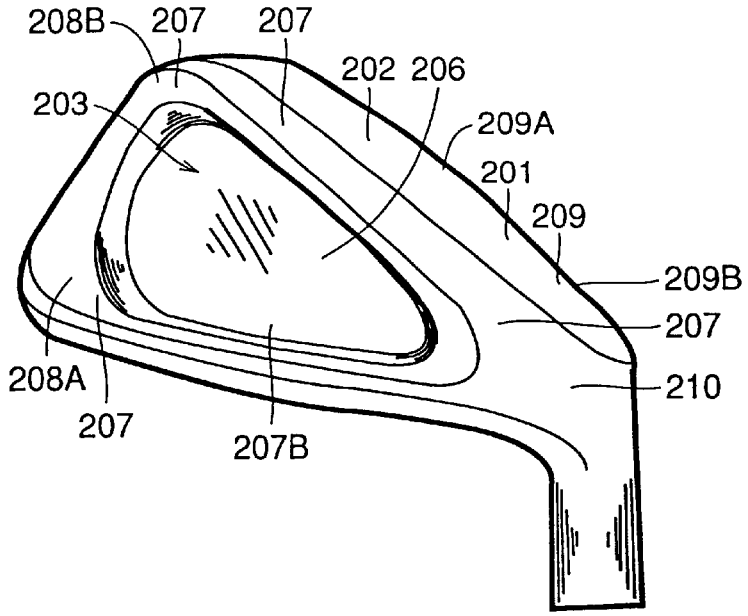
FIG. 53 is a perspective view showing an Example of an iron golf club head according to the present invention.

Different examples of the present invention will be explained. Referring to FIG. 53, an iron golf club head 201 according to the present invention has a back cavity 206.

In the peripheral weight disposing part 207 of the back cavity 206, more weight is distributed and disposed in the upper part 208 of the toe and at sites from the central part 209A of the sole part 209 to the heel part 210. In other words, the iron golf club head 201 shown in FIG. 53 has the first weight member provided in the upper part 208A of the toe and the second weight member provided in the heel part 209B of the sole.

Here, the head body 202 constituting the iron golf club head 201 is produced by using stainless steel, pure titanium, titanium alloy, and others. At that time, in the peripheral weight disposing part 207 of the back cavity 206, the thickness is increased at sites in the upper part 208A of the toe and from the central part 209A of the sole part 209 to the heel part 210, and a design can be made in such a manner that the weight distribution is larger on these sites in design.

Figure 54:
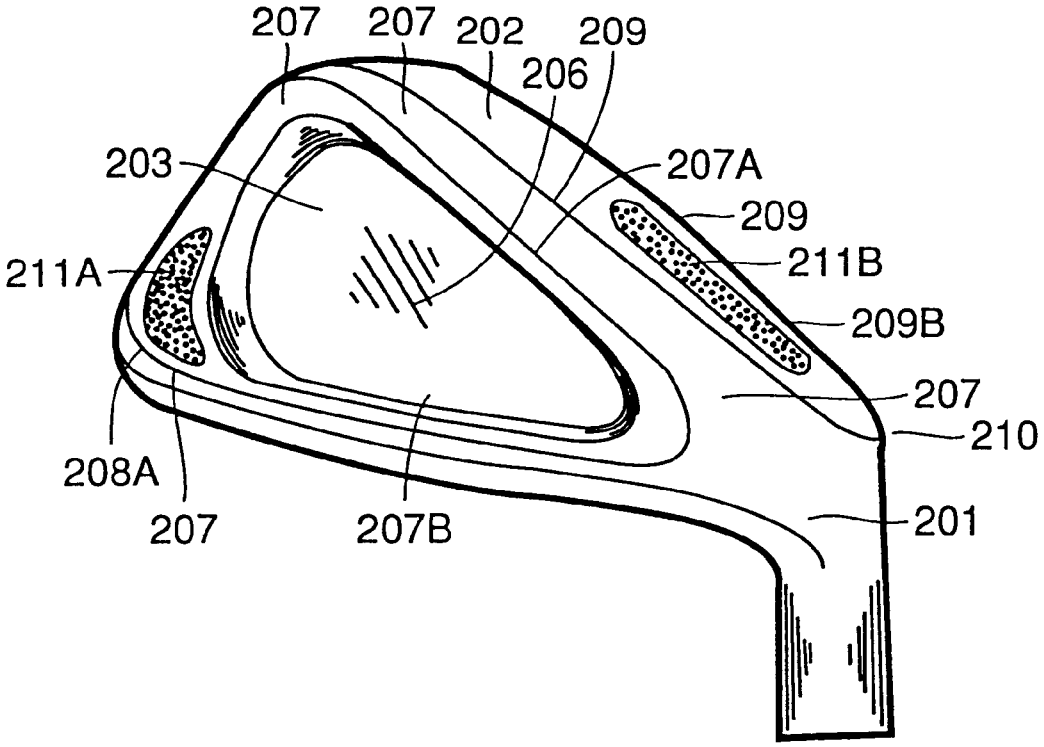
FIG. 54 is a perspective view showing an Example of an iron golf club head according to the present invention.

Referring to FIG. 54, an iron golf club head 201 according to the present invention has a back cavity 206. In the peripheral weight disposing part 207 of the back cavity 206, weight members 211A and 211B having a larger specific gravity than the metal constituting the head body 202 are integrated by engagement to the sites in the upper part 208A of the toe and from the central part 209A of the sole part 209 to the heel part 210. Namely, the iron golf club head 201 has a weight member 211A serving as the first weight member provided in the upper part 208A of the toe of the head body 202 and a weight member 211B serving as the second weight member provided in the heel side part 209B of the sole. The weight members 211A and 211B have a larger specific gravity than the material constituting the head body 202, and has a larger density than other parts of the head body.

Referring to FIGS. 55A to 55E, in the iron golf club head 201, the shape of the peripheral weight disposing part 207 of the back cavity 206 is constructed in such a manner that the height of the rear back 207A successively increases at sites from the lower part 208B of the toe to the back surface part 210B of the heel of the sole part 209. In other words, in the iron golf club head 201, the depth of the back cavity 206 increases as it approaches from the lower part 208B of the toe to the heel part 210. Also, the width of the sole part 209 decreases according as it approaches from the lower part 208B of the toe to the heel part 210.

Figure 55A:
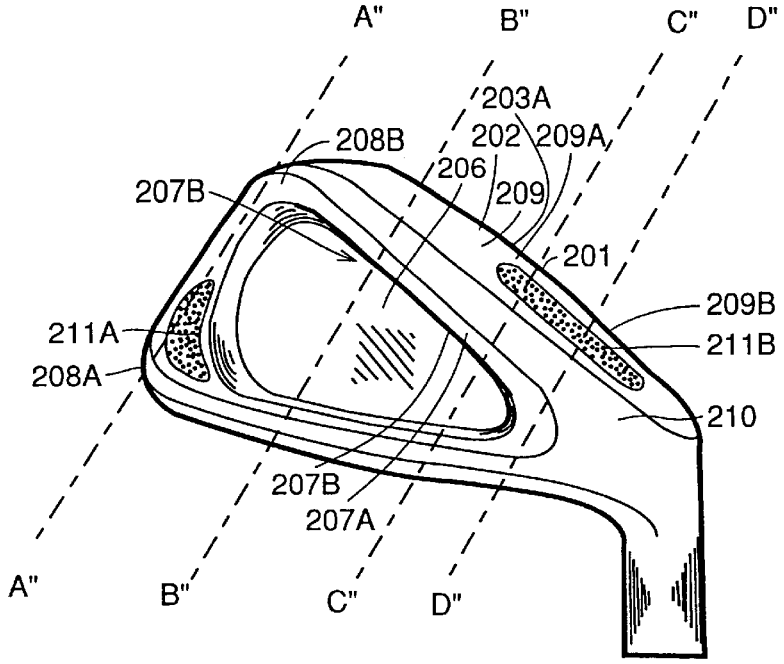
FIG. 55A is a perspective view showing an Example that clearly describes a cut part of an iron golf club head according to the present invention.
Figure 55B:
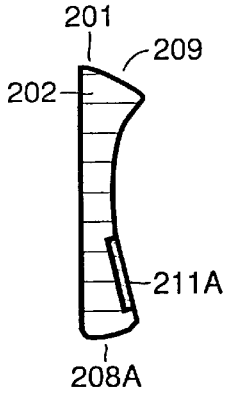
FIGS. 55B to 55E are cross section views of an essential part showing cross sections of the A"—A" part to the D"—D" part in FIG. 55A.
Figure 55C:
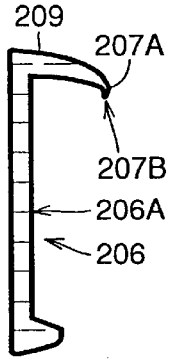
Figure 55D:
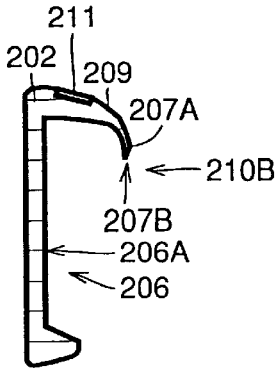
Figure 55E:
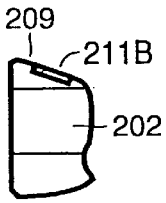

Here, as shown in FIGS. 55B and 55E, it is a characteristic of the present invention that the rear back 207A of the peripheral weight disposing part 207 of the back cavity 206 is not provided in the lower part 208B of the toe and in the heel part 210 of the sole part 209. By providing such a construction, more weight can be distributed and disposed at sites in the upper part 208A of the toe and from the central part 209A of the sole part 209 to the heel part 210.

Further, as shown in FIGS. 55A to 55E, the width of the sole part 209 successively decreases according as it approaches from the lower part 208B of the toe to the heel part 210.

Further, the aforesaid examples will be explained in detail. The head body 202 is made of pure titanium or titanium alloy. The weight members 211A and 211B are constructed with a tungsten alloy having a larger specific gravity than the head body 202. The weight member 211A is press-fit and integrated by engagement to the upper part 208A of the toe of the peripheral weight disposing part 207 of the back cavity 206. The weight member 211B is press-fit and integrated by engagement to the sites from the central part 209A of the sole part 209 to the heel part 210 of the peripheral weight disposing part 207 of the back cavity 206.

Here, lead, beryllium copper alloy, and brass can be used besides the aforesaid tungsten alloy as a material having a larger specific gravity than the head body 202. These members are press-fit and integrated by engagement to the sites in the upper part 208A of the toe and from the central part 209A of the sole part 209 to the heel part 210 of the peripheral weight disposing part 207 of the back cavity 206.

In the face part 203 or in the upper opening part 207B of the peripheral weight disposing part 207 of the back cavity 206, the distance from the face surface part 206A of the back cavity 206 to the upper opening part 207B is about 15 mm, for example, in the case of the fifth iron golf club head. The height of the rear back 207A of the peripheral weight disposing part 207 of the back cavity 206 is 7 mm at a position shifted by 20 mm from the central part 203A of the face to the toe part side. The height of the rear back 207A is 9 mm at the central part 203A of the face. The height of the rear back 207A is 12 mm at a position shifted by 12 mm from the central part 203A of the face to the heel part side, and successively increases.

As a result of this, the weights are disposed in the upper part 208A of the toe and in the lower part of the heel part 210, and the angle formed by the major axis of the plane ellipse appearing when the ellipsoid of inertia of the golf club head is cut with a plane parallel to the face surface and the intersecting line of the cut surface and the ground surface increases as it approaches the upper part 208A of the toe. Also, the height of the sweet spot decreases.

Next, as the material constituting the head body 202, one can use a metal material such as iron, stainless steel, aluminum, titanium, magnesium, tungsten, copper, nickel, zirconium, cobalt, manganese, zinc, silicon, tin, or chromium, which are materials often used in generally producing a golf club head, or an alloy material of these. Also, FRP (fiber reinforced plastics), synthetic resin, ceramics, rubber, and others can be used, and it may be produced from a single material of these or may be produced from a combination of two or more kinds of these materials.

Also, as a production method, use of a precision casting method is highly convenient because the cost will be low and the dimension precision is high. In addition, the golf club head body can be produced by die-casting, pressing, or forging. It is also possible to produce each of the parts by pressing, forging, precision casting, metal injection, die-casting, cut-processing, powder-metallurgy, or the like and bonding these by welding, adhesion, press-fit, fitting engagement, press-contact, screwing, soldering, or the like to fabricate a golf club head.

Figure 56:
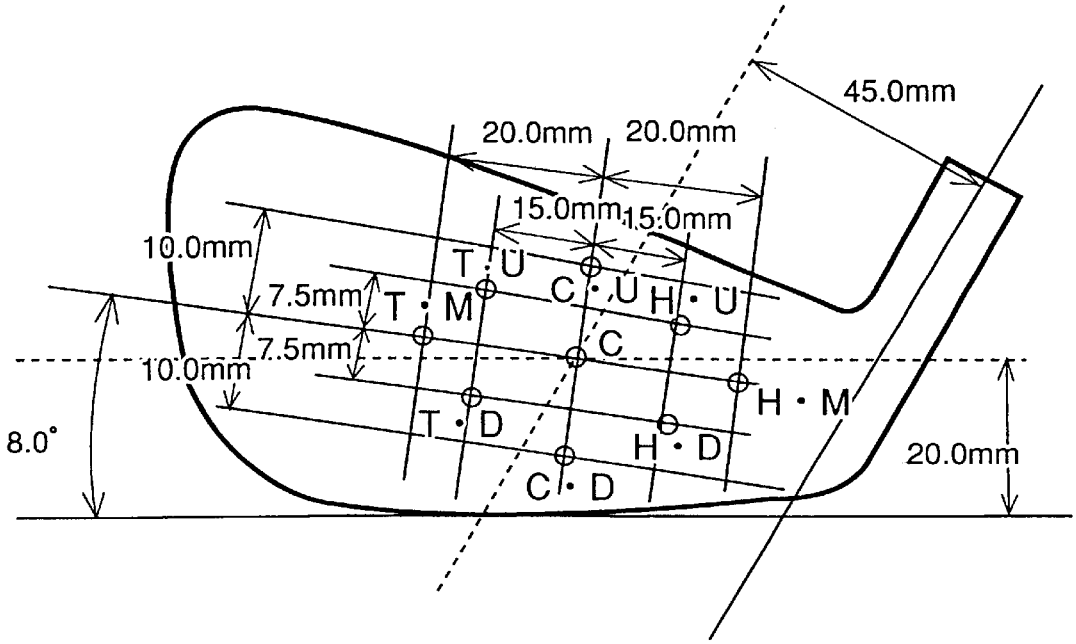
FIG. 56 is a view showing hitting point positions of an iron golf club head.
Figure 57:
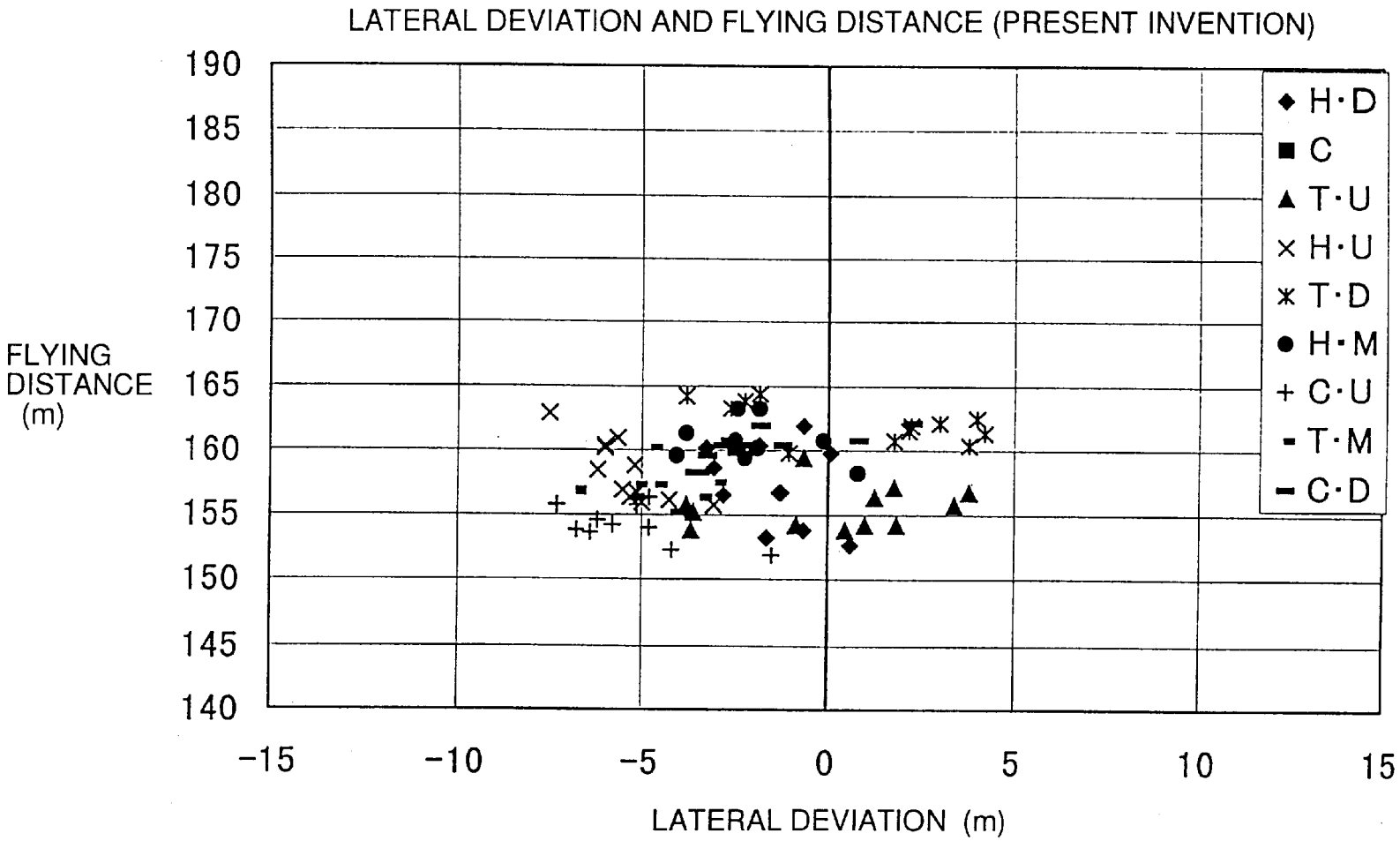
FIG. 57 is a graph showing a flying distance and a variation of an iron golf club head according to the present invention.
Figure 58:
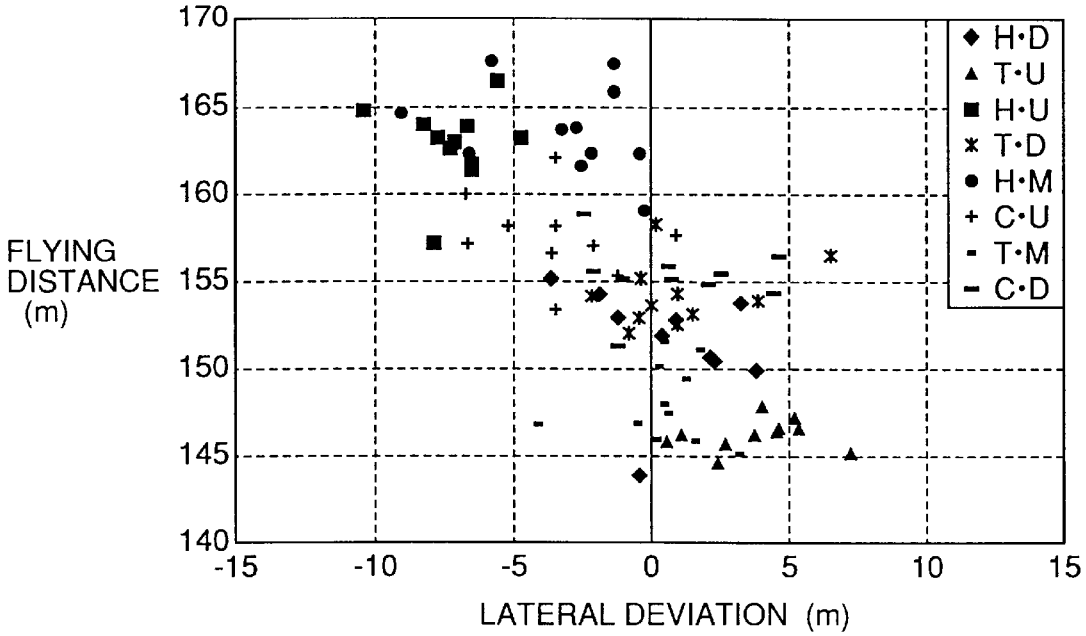
FIG.58 PRIOR ART
FIG. 58 is a graph showing a flying distance and a variation of a conventional iron golf club head.

FIGS. 56 to 58 are views for comparing the variations of the flying distance between the golf club head according to the present invention and a conventional golf club head. Particularly, FIG. 57 shows data for the golf club head according to the present invention, and relates to the third iron having a loft angle of 21°. The plane ellipse appearing when the ellipsoid of inertia of the golf club head is cut with a plane parallel to the face surface is made approximately coincident with the distribution of the hitting points of a general player. FIG. 58 shows data in the case of a conventional golf club head.

A test was performed with a golf robot. The speed of the iron golf club head was set to be 34.5 m/sec. Taking the variation of the hitting points of the general player into account, the hitting point positions were set to be from sweet spot (C) to toe tip part (T·M), upper part of toe tip (T·LT), lower part of toe (T·D), upper part of heel (H·U), lower part of heel (H·D), foot part of heel (HEM), upper part of center (C·U), and lower part of center (C·D), as shown in FIG. 56. The result of striking at each is shown in Table 5.

Were set to be lower part (H·D), foot part of heel (H·M), upper part of center (C·U), and lower part of center (C·D). The results of striking at respective points are shown. Here, the specifications of the inventive product and the conventional product are shown in Table 5.

TABLE 5

| Sample | Angle formed by the major axis of the plane ellipse appearing on the cut surface of the ellipsoid of inertia and the intersecting line of the cut surface and the ground surface | Aspect ratio of the plane ellipse appearing on the cut surface of the ellipsoid of inertia | Sweet spot height |
|---|---|---|---|
| Inventive product | 8° | 2.2 | 20.0 mm |
| Conventional product | 0° | 2.1 | 20.7 mm |

On the other hand, the iron golf club head used in collecting the data shown in FIG. 57 has the same mass (248 g) as the iron golf club head used for collecting the data shown in FIG. 58. Referring to FIG. 56, when the ellipsoid of inertia is cut with a plane passing through the center of gravity and being parallel to the face surface, the aspect ratio of the plane ellipse appearing on the cut surface is 2.2; the angle formed by the major axis and the intersecting line of the cut surface and the ground surface extends in a toe-up direction to be 8°; and the height of the center of hitting points was 20 mm.

From the results of the flying distance measurement test using the robot, in the conventional product that does not conform to the distribution of the hitting points of the general player, the variation to the right and left by the iron golf club head is about 18 m, as shown in FIG. 58. In contrast, in the inventive product in which the plane ellipse is made coincident with the distribution of the hitting points of the general player, the variation to the right and left by the iron golf club head is about 15 m, as shown in FIG. 57, thereby reducing the variation by 17%.

Also, with respect to the variation in the flying ball line direction, while the variation is about 24 m in the conventional product as shown in FIG. 58, it is about 13 m in the inventive product as shown in FIG. 57, thereby reducing the variation by 46%. Further, when the average flying distance is compared, while it is 155 m in the conventional product as shown in FIG. 58, it is 157 m in the inventive product as shown in FIG. 57. Namely, an increase in the flying distance by about 2 m was seen.

Here, FIGS. 57 and 58 show average values-when balls were hit each for ten times.

Also, when the results of striking on the upper part of the toe tip are observed, it is well understood that there is a difference in the rotation performance. Namely, with the conventional product, the decrease in the flying distance in the flying ball line direction due to striking on the upper part of the toe tip is conspicuous, as shown in FIG. 58, and further, the balls fall in the right direction as compared with the average lateral deviation. In contrast, with the inventive product, the decrease in the flying distance due to striking on the upper part of the toe tip is small, as shown in FIG. 57, and the lateral deviation is also small. This is because, with the inventive product, the rotation of the head is restrained, and it is understood that the rotation performance of the head is excellent.

Also, in the present invention, a labor in the process for fitting a multiple-stage face insert member by engagement, such as in the conventional iron golf club head, is not needed. Also, there is no need to fit the weight member to plural sites of the head body by engagement, so that labor is not needed in the production process, nor does it lead to increase in the cost.

Furthermore, in the case of producing the head body by a precision casting method using a lost wax, there is no fear that warping is generated in the cast product itself in the completed head body, because there are few recesses for fitting engagement of these, thereby improving the yield.

Figure 59A:
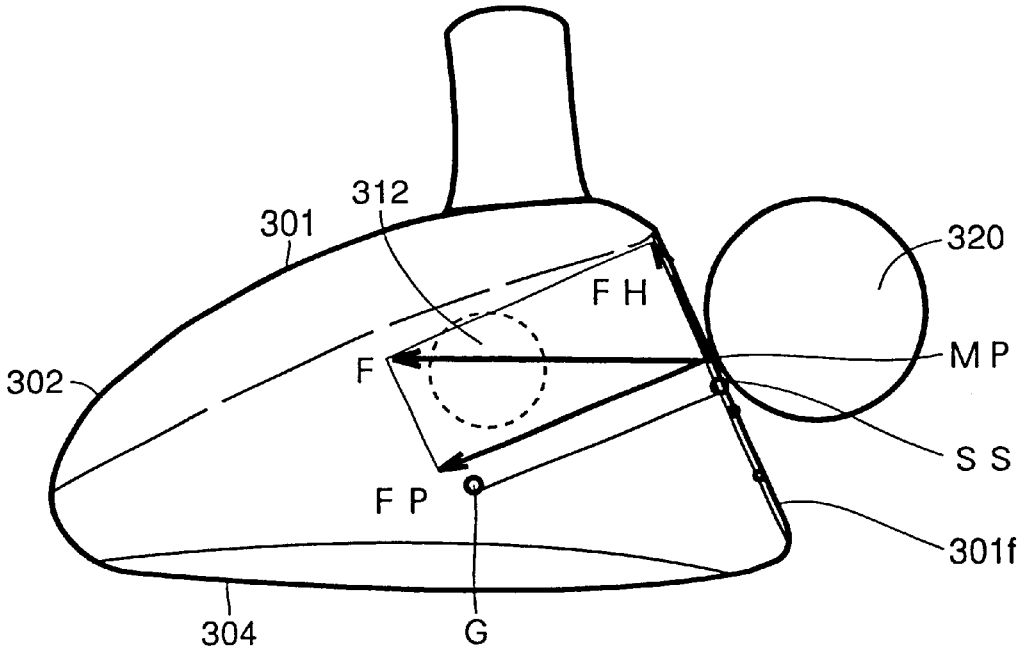
FIGS. 59A and 59B are views for explaining the principle of a wood golf club head according to the present invention.
Figure 59B:
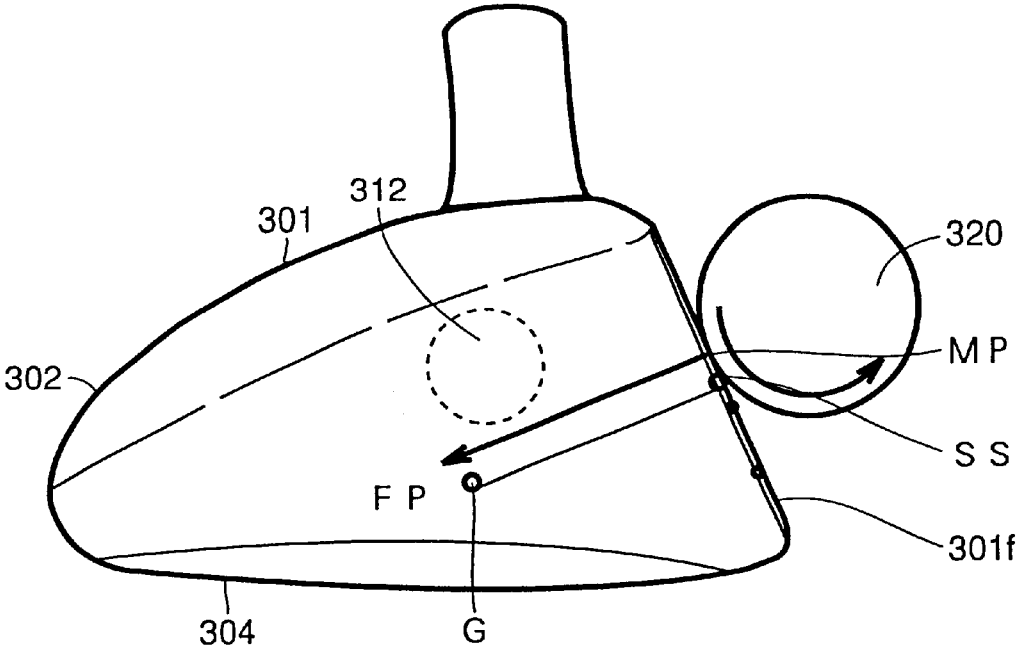

Also, wood golf club heads according to the present invention will be explained. FIG. 59A is a view for explaining a striking force generated on a face surface when a golf ball 320 is hit with a wood golf club head, and FIG. 59B is a view showing a state in which the golf ball is rotated and flies out from the face surface at the striking time. Referring to FIG. 59A, when a golf ball 320 is struck with a wood golf club head 301, the wood golf club head 301 receives a striking force F from the golf ball 320 in the proceeding direction of the swing at the hitting point position MP of the golf ball 320. In the wood golf club head 301, an angle called loft angle is set so that the face surface 30 if forms a certain angle with respect to the ground surface when the sole part 304 is set on the ground surface and addressed, in order to change the flying-out angle of the golf ball 320 in accordance with the identification number and to obtain a flying distance for each identification number. Typically, the loft angle is about 10° in the case of a driver (the first wood golf club head); the loft angle is about 13° in the case of a brassie (the second wood golf club head); the loft angle is about 15° in the case of a spoon (the third wood golf club head); the loft angle is about 18° in the case of a baffy (the fourth wood golf club head); the loft angle is about 21° in the case of a cleek (the fifth wood golf club head); and the loft angle increases according as the identification number increases.

Due to the presence of the loft angle, the striking force F at the striking time can be decomposed into a horizontal partial force FH and a perpendicular partial force FP with respect to the face surface 301*f*. The horizontal partial force FH is a force that rotates the golf ball 302 together with a frictional force of the face surface 301*f*, namely, a force that generates a back spin or a side spin. According as the swing speed increases and the impacting speed of the golf club head 301 increases, the striking force F increases and the horizontal partial force FH increases, so that the back spin and the side spin are more likely to be generated. It seems that the ball trajectory of a wood golf club head of a professional golfer or the like rises high above after the shot, and then falls vertically from above. This is due to the fact that, since the head speed is high, a back spin is generated, and the ball floats upward and falls down.

The perpendicular partial force FP is a force that acts perpendicularly on the face surface 301*f*, as shown in FIG. 59B, and this force rotates the face surface 301*f*. By this rotation, the golf ball 302 after the shot flies out in the right-and-left direction and in the up-and-down direction. Here, the point at which the line drawn perpendicularly from the center of gravity G of the head body 302 to the face surface 30 if intersects the face surface 301*f* is referred to as a sweet spot SS. The sweet spot SS is a point by which the golf ball flies most and, if the ball is struck here, the head body 302 rotates little. However, if a general players performs a shot, the ball hardly hits the sweet spot SS, and in most cases the player performs a shot in the peripheries of the sweet spot SS.

Figures 60A, 60B:
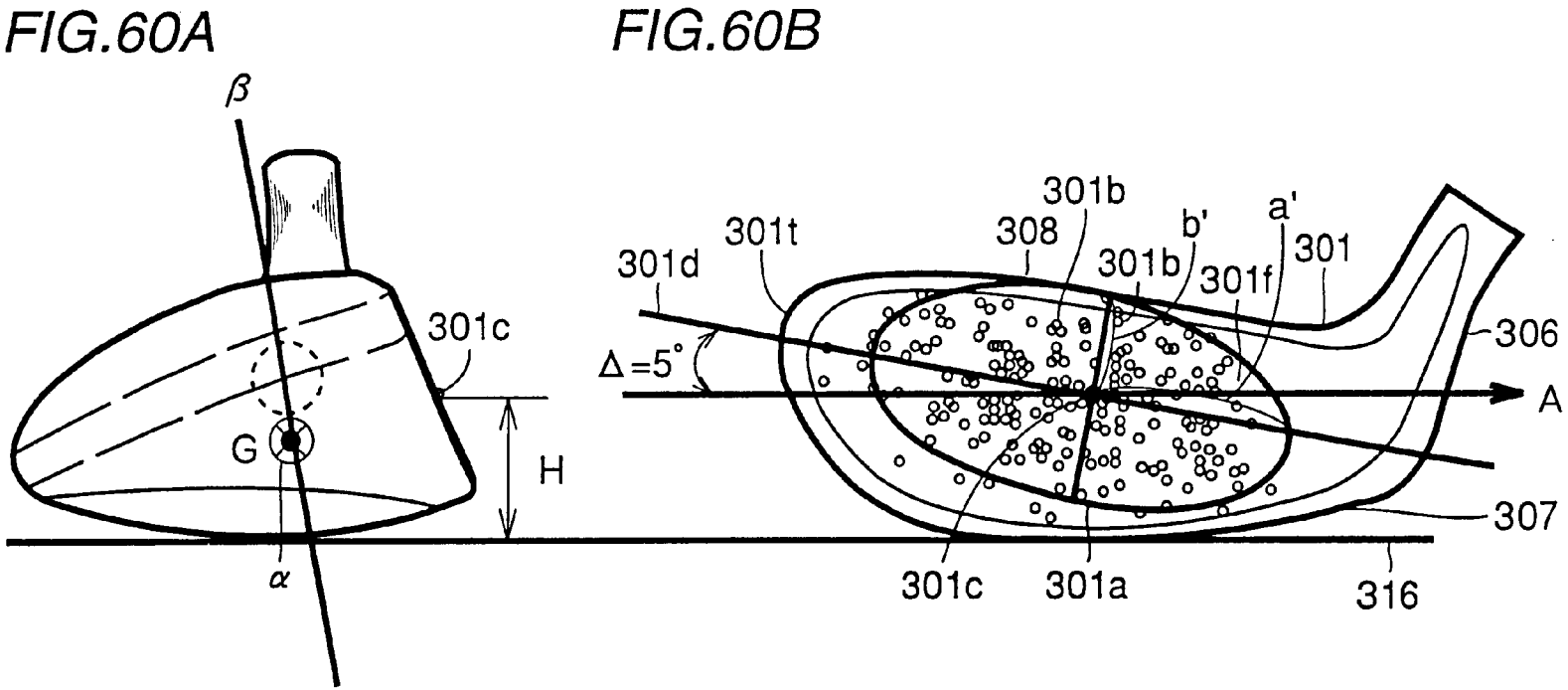
FIGS. 60A and 60B are views showing a distribution of the hitting points of a general player with a wood golf club head.

FIGS. 60A and 60B are views showing a distribution of the hitting points of a general player. Particularly, FIGS. 60A and 60B show a distribution of the hitting points by a spoon (the third wood golf club). As will be clear from FIGS. 60A and 60B, it is understood that a general player strikes at various positions up and down and to the right and left near the sweet spot SS. The player from whom these data have been obtained has a golf score of about 100 and is a general player. In the Figures, the points 301*b* represent hit marks on the face surfaces 301*f* of the wood golf club head 301. The center of hitting points is denoted by 301*c*. An ellipse 301*a* that approximates the size and the shape of the hitting point distribution by determining an interval covering not less than 95% of the hit marks of the hitting points is shown in a solid line. Further, the face surface 301*f*, the A-axis being parallel to the intersecting line 316 of the face surface 301*f* and the ground surface, as well as the major axis 301*d* of the ellipse 301 approximating the variation of the hitting points, are shown in solid lines.

From this result, it is understood that the golf ball 320 is struck at various locations up and down and to the right and left of the face surface 301*f* of the wood golf club head 301, and that the hitting points are varied in the right-and-left direction of the toe part 301*t* and the heel part 306 and in the up-and-down direction of the leading edge part 307 and the top edge 308. Since this variation degrades the directivity of the golf ball 302 after hitting the ball, it is necessary to produce a wood golf club head that maintains the directivity to some extent even if the hitting points are varied.

On the other hand, as will be seen from the results of the hitting point distribution, the shape of the hitting point distribution is a shape of the ellipse 301*a* having a major axis and a minor axis. Further, the major axis 301*d* extends upward and away from the ground surface as it approaches the toe part 301*t*. Also, according as the identification number increases, the angle that the major axis forms with the intersecting line of the cut surface and the ground surface successively increases, and the shape of the ellipse successively approaches a circular 10 shape. Further, the height H of the hitting point center from the ground surface decreases. Thus, it is understood that the shape of the hitting point distribution of a general player has a specific tendency.

Figure 61:
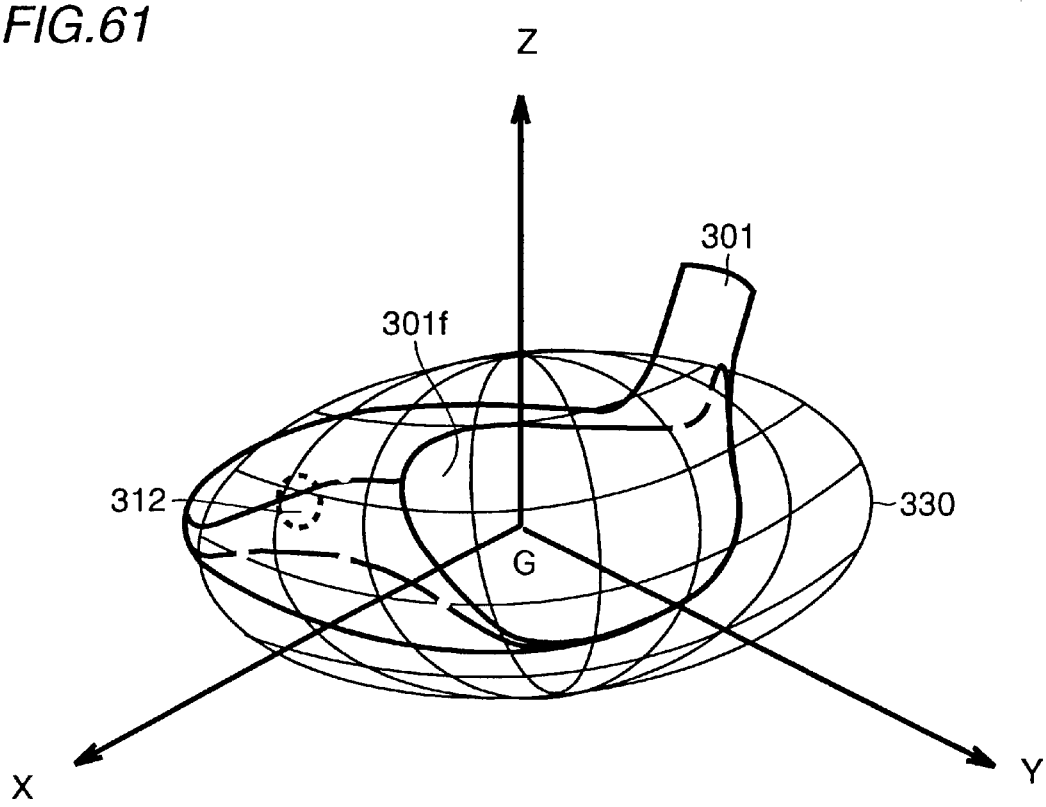
FIG. 61 is a view for explaining the ellipsoid of inertia of a wood golf club head according to the present invention and the X-axis, Y-axis, Z-axis.
Figure 62A:
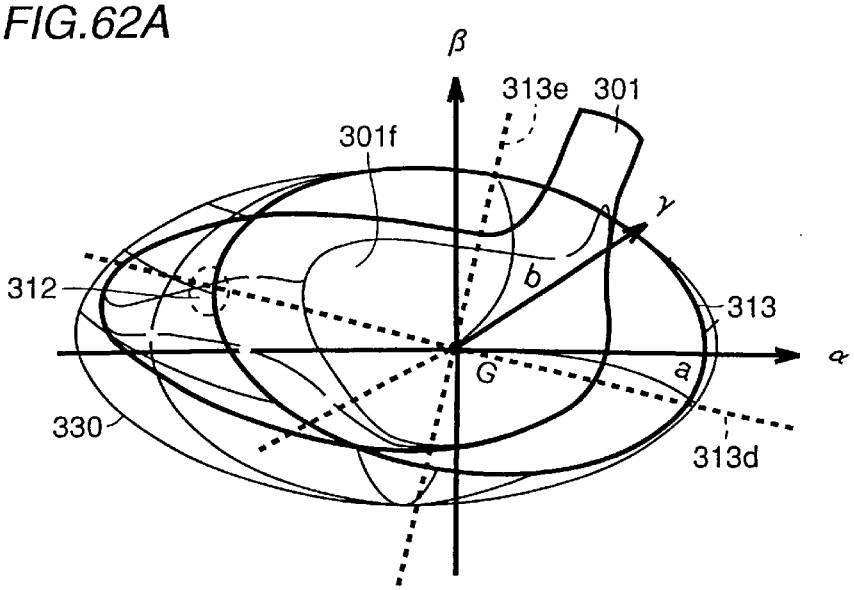
FIGS. 62A to 62C are views for explaining the ellipsoid of inertia of a wood golf club head according to the present invention and the a-axis, β-axis, γ-axis.
Figure 62B:
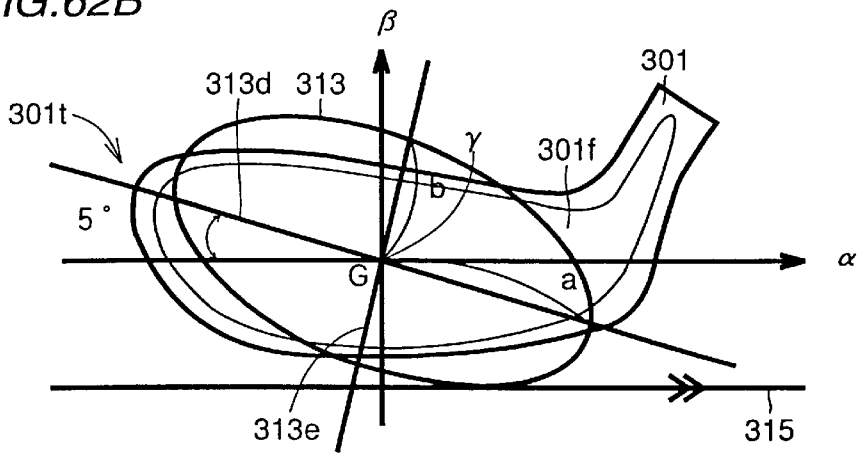
Figure 62C:
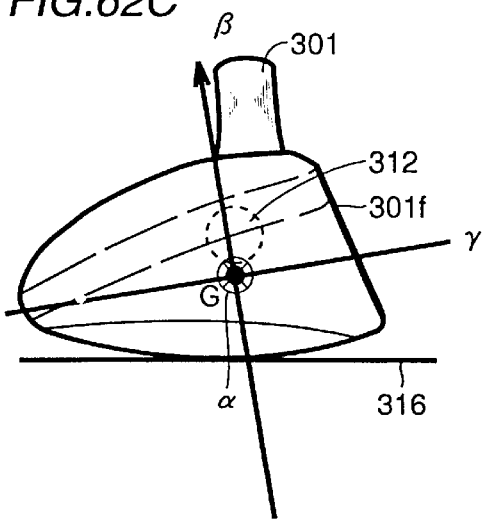
Figure 63:
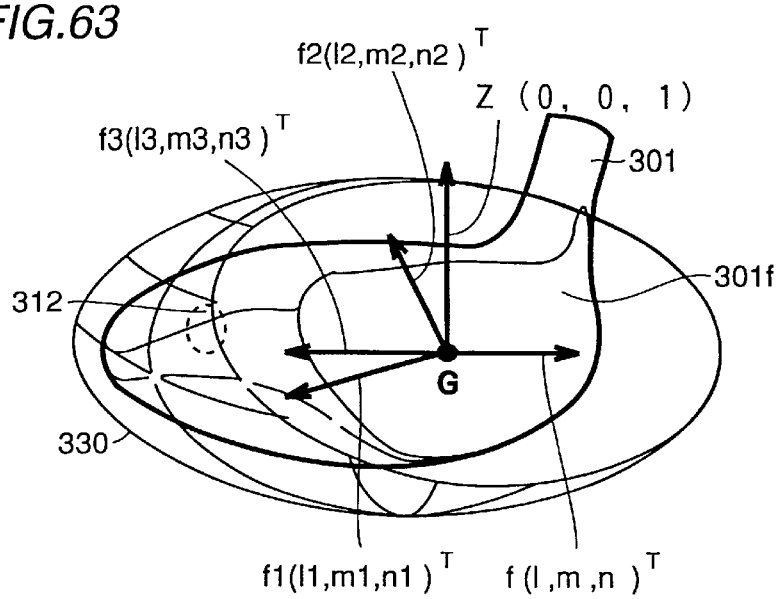
FIG. 63 is a view for explaining the ellipsoid of inertia of a wood golf club head according to the present invention and the direction vectors.
Figure 64:
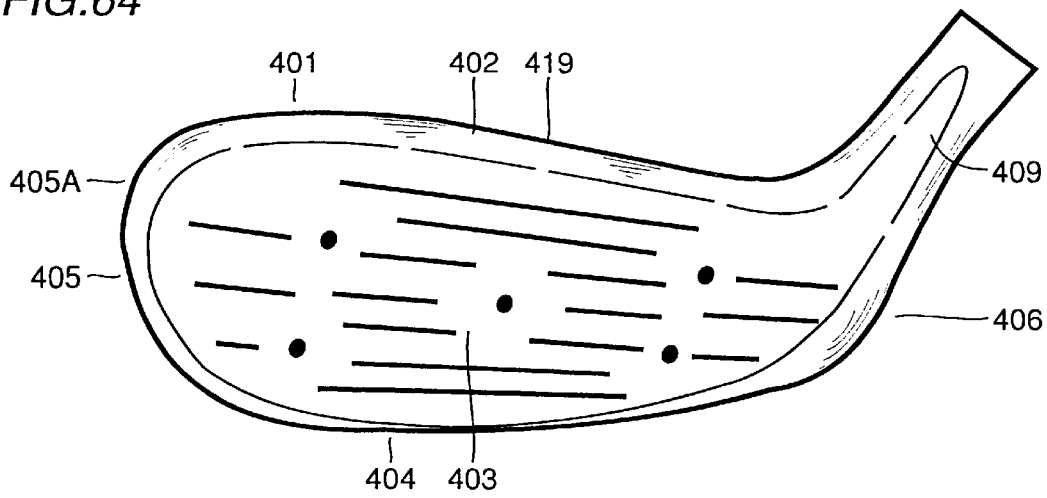
FIG. 64 is a front view showing an Example of a wood golf club head according to the present invention.
Figure 65:
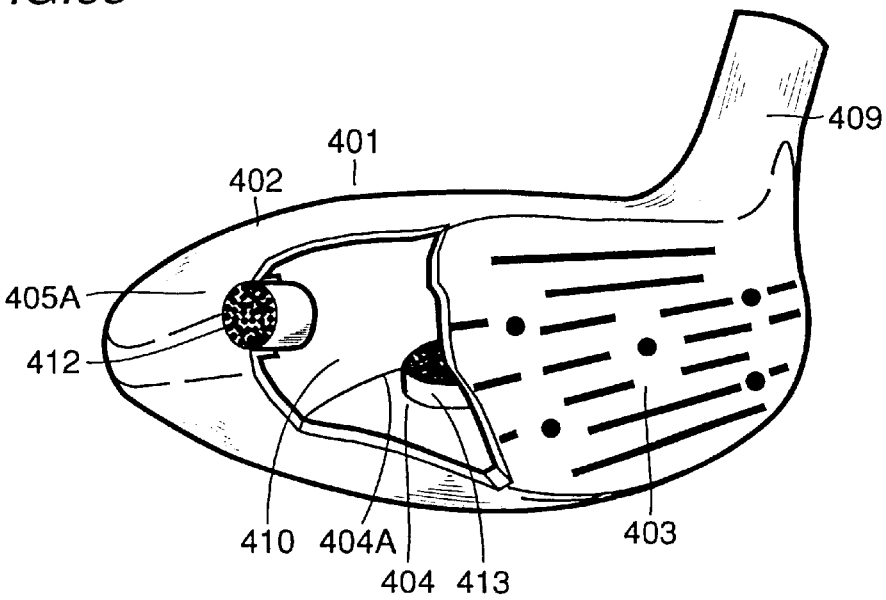
FIG. 65 is a perspective view including a partial cross section showing an Example of a wood golf club head according to the present invention.
Figure 66:
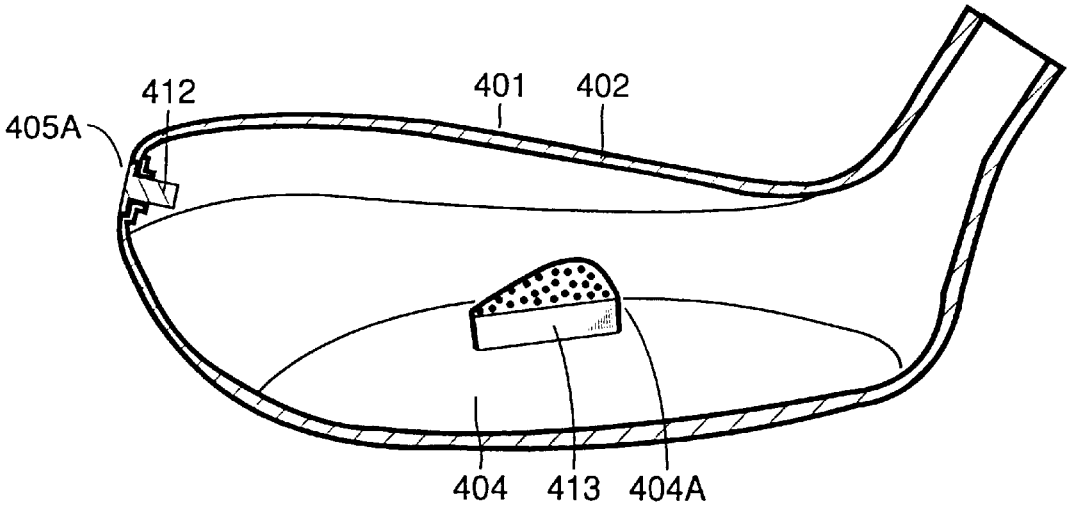
FIGS. 66 to 76 are cross section views showing an Example of a wood golf club head according to the present invention.

FIGS. 61 to 63 are views for explaining an ellipsoid of inertia in the case where the wood golf club head 301 is set on a plane by setting the lie angle and the loft angle to be predetermined angles.

Referring to FIG. 61, the axis passing through the center of gravity G and being perpendicular to the ground surface is assumed to be the Z-axis. The axis passing through the center of gravity G and being perpendicular to the Z-axis and parallel to the intersecting line of the angential plane at the centroid (center) of the face surface 301*f* and the ground surface is assumed to be the X-axis. The tangential plane at the centroid (center) of the face surface 301*f* is approximately the same surface as the face surface 301*f*. The axis passing through the center of gravity G and being perpendicular to both the X-axis and the Z-axis is assumed to be the Y-axis.

FIG. 63 is a view showing direction vectors on an ellipse plane appearing when the ellipsoid of inertia of the golf club head is cut.

Referring to FIG. 63, the direction vector of a plane passing through the center of gravity G and being parallel to the intersection of the tangential plane at the centroid of the face surface 301*f* and the ground surface is assumed to be f(l, m, n)$^T$, and each of the following vectors is calculated.

$$f_1(l_1, m_1, n_1)^T = f\,X\,Z(0, 0, 1)^T$$

$$f_2(l_2, m_2, n_2)^T = f_1 X f$$

$$f_3(l_3, m_3, n_3)^T = f_1 X f_2 \quad (1)$$

where X designates an outer product.

Referring to FIGS. 62A, 62B, and 62C, the axis passing through the center of gravity G and being parallel to the intersection of the tangential plane at the centroid of the face surface 301f and the ground surface is assumed to be α-axis. The axis being parallel to the tangential plane at the centroid of the face surface 301*f* and perpendicular to the α-axis is assumed to be β-axis. The axis being :perpendicular to the α-axis and the β-axis is assumed to be γ-axis. The conversion from the α, β, γ coordinate system to the X, Y, Z coordinate system is represented by the following equations.

$$X = l_1 \cdot \alpha + l_2 \cdot \beta + l_{3 \cdot \gamma}$$

$$Y = m_1 \cdot \alpha + m_2 \cdot \beta + m_{3 \cdot \gamma}$$

$$Z = n_1 \cdot \alpha + n_2 \cdot \beta + n_{3 \cdot \gamma} \quad (2)$$

Here, supposing that $I_1$, $I_2$, $I_3$ are moments of inertia with respect to the X, Y, Z axes, 112 is a product of inertia with respect to the YZ-plane and the XZ-plane, $I_{13}$ is a product of inertia with respect to the YZ-plane and the XY-plane, $I_{23}$ is a product of inertia with respect to the XZ-plane and the XY-plane, then the following relationship is obtained.

$$I_1 \cdot X^2 + I_2 \cdot Y^2 + I_3 \cdot Z^2 + 2 \cdot I_{12} \cdot X \cdot Y + 2 \cdot I_{13} \cdot X \cdot Z + 2 \cdot I_{23} \cdot Y \cdot Z = 1 \quad (3)$$

The ellipsoid represented by the equation (3) is referred to as an ellipsoid of inertia. This shows the magnitude of the inertial resistance in each direction. Substituting the equation (3) with the equation (2) and letting the y term zero, the equation. (4) of the cut ellipse plane is determined.

$$(I_1 l_1^2 + I_2 m_1^2 + I_3 n_1^2 + I_{12} l_1 m_1 + I_{13} l_1 n_1 + I_{23} m_1 n_1)\alpha^2$$

$$(I_1 l_2^2 + I_2 m_2^2 + I_3 n_2^2 + I_{12} l_2 m_2 + I_{13} l_2 n_2 + I_{23} m_2 n_2)\beta^2$$

$$(I_1 l_{12} + I_2 m_1 m_2 + I_3 n_1 n_2 + I_{12} l_1 m_2 + I_{12} l_2 m_1 + I_{13} l_1 n_2 + I_{13} l_2 n_1$$

$$+ (I_{23} m_1 n_2 + I_{23} m_2 n_1)\alpha\beta = 1 \quad (4)$$

The magnitude of the cut surface represents the magnitude of the inertial resistance indicating the facility of rotation of this surface. Also, the cut surface represents the inertial resistance in the direction perpendicular to the cut surface. Further, as shown in FIGS. 62A, 62B, and 62C, it is apparent that the shape of the cut surface is a plane ellipse because it is a cut surface of a three-dimensional ellipsoid of inertia.

The plane ellipse appearing when the ellipsoid of inertia 330 of the golf club head 301 is cut with the face surface 301*f* represents the facility of the rotation in the perpendicular direction with respect to the face surface 301*f*. Also, in the plane ellipse 313 appearing on the cut surface when the ellipsoid of inertia 330 is cut with a plane passing through the center of gravity G and being parallel to the face surface 301*f*, the length of the major axis 313*d*, is represented by a and the length of the minor axis 313e is represented by b. The aspect ratio is defined by a/b. The angle formed by the major axis 313*d*, and the α-axis is assumed to be θ.

The aforesaid distribution of the hitting points of the general player shown in the FIGS. 60A and 60B has an elliptic shape with its center at the hitting point center 30*c*, and the major axis 301*d* extends to go away from the ground surface as it approaches the toe part 301*t*. In other words, as shown in FIG. 60B, in the third wood golf club head, the major axis 301*d* of the ellipse 301*a* approximating the variation of the hitting points forms an angle Δ of 5° with respect to the A-axis on the face surface 301*f*.

Therefore, by allowing the sweet spot to be approximately coincident with the elliptic center of the plane ellipse appearing when this ellipsoid of inertia is virtually cut with a plane passing through the center of gravity and being parallel to the face surface, the distance between the hitting points and the sweet spot due to the variation of the hitting points can be made as small as possible, whereby the rotation of the golf club head can be restrained. Further, since the ball is hit in the neighborhood of the sweet spot, the velocity of the golf ball is improved to increase the flying distance.

Furthermore, the angle formed by the major axis of the plane ellipse and the intersecting line of the cut surface and the ground surface is allowed to be coincident with the angle of the hitting point distribution of the player (angle in the toe-up direction). By these, the variation of the lateral deviation in the right-and-left direction is restrained. Further, by allowing the aspect ratio which is the ratio of the major axis to the minor axis of the plane ellipse, to be coincident with the aspect ratio of the ellipse of the hitting point distribution of a general player to be approximately equal to the inertial resistance in the up-and-down direction, not only the variation of the lateral deviation in the right-and-left direction can be restrained but also the variation of the flying distance in the flying ball line direction can be restrained.

Here, generally in wood golf club heads, according as the identification number increases, i.e. according as they become a short wood, the angle formed by the major axis of the ellipse indicating the hitting point distribution and the intersecting line of the cut surface and the ground surface successively increases. Therefore, the angle formed by the major axis of the plane ellipse and the intersecting line of the cut surface and the ground surface is successively increased. Also, the shape of the plane ellipse, i.e. the aspect ratio which is a ratio of the major axis to the minor axis, is successively decreased, and the sweet spot is allowed to be coincident with the hitting point position, whereby the variation of the flying distance in the right-and-left direction and in the flying ball line direction is restrained for a golf club head of any identification number, and the flying distance increases by improving the speed of the ball.

Examples pertaining to the present invention will be explained. Referring to FIGS. 64 to 68, a wood golf club head 401 made of metal and having a hollow outer shell structure is constructed in such a manner that the weight distribution will be toe-and-low-back-weight by providing weight members 412 and 413 having a larger specific gravity than the material constituting the head body 402 in the upper part 405A of the toe and in the back part 404A of the center of the sole part 404. In other words, the wood golf club head 401 according to the present invention is provided with a weight member 412 disposed in the upper part 405A of the toe of the head body 402 and a weight member 413 disposed in the back part 404A of the center of the sole of the head body 402.

Also, the weight members 413 and 414 have a larger specific gravity than the material constituting the head body. Also, the weight members 413 and 414 have a larger density than other parts. The weight member 412 constitutes the first weight member, and the weight member 413 constitutes the second weight member.

Figure 67:
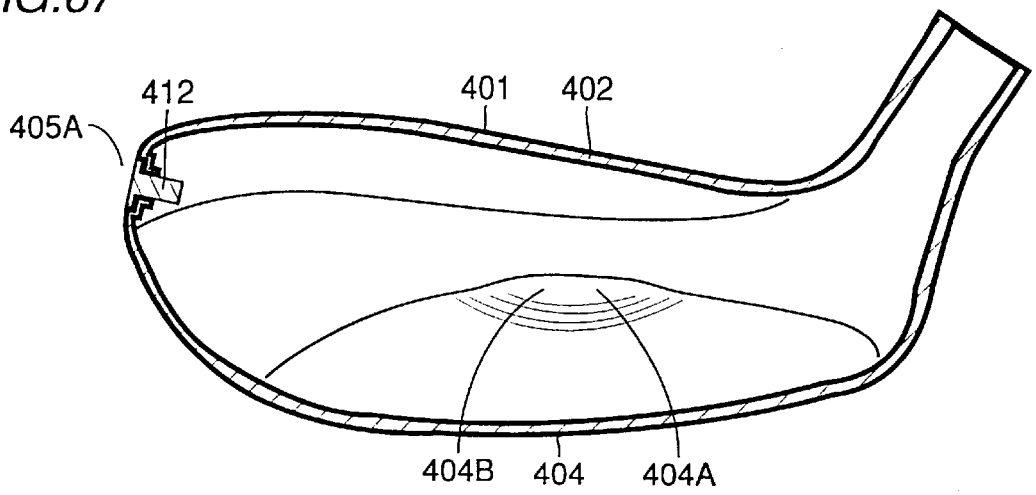
Figure 68:
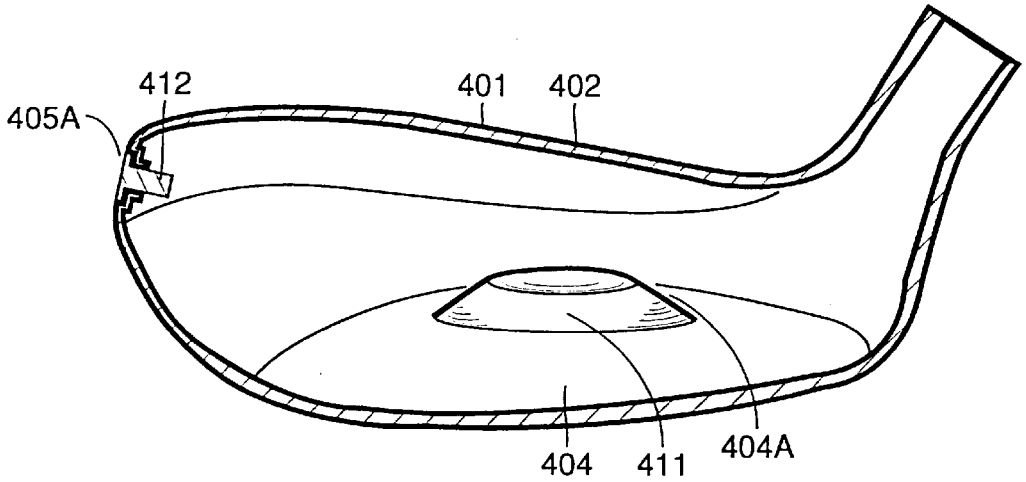

Also, a wood golf club head according to the present invention is a wood golf club head 401 made of metal and having a hollow outer shell I.,structure as shown in FIG. 67, where a weight member 412 having a higher specific gravity than the material constituting the head body 402 is disposed in the upper part 405A of the toe, and a thick part 404B is provided by partially increasing the thickness of the back part 404A of the center of the sole part 404. Alternatively, it is constructed in such a manner that the weight distribution will be toe-and-low-back-weight by forming a protruding part 411 to increase the thickness, as shown in FIG. 68. The weight member 412 constitutes the first weight member, and the thick part 411 constitutes the second weight member.

Figure 69:
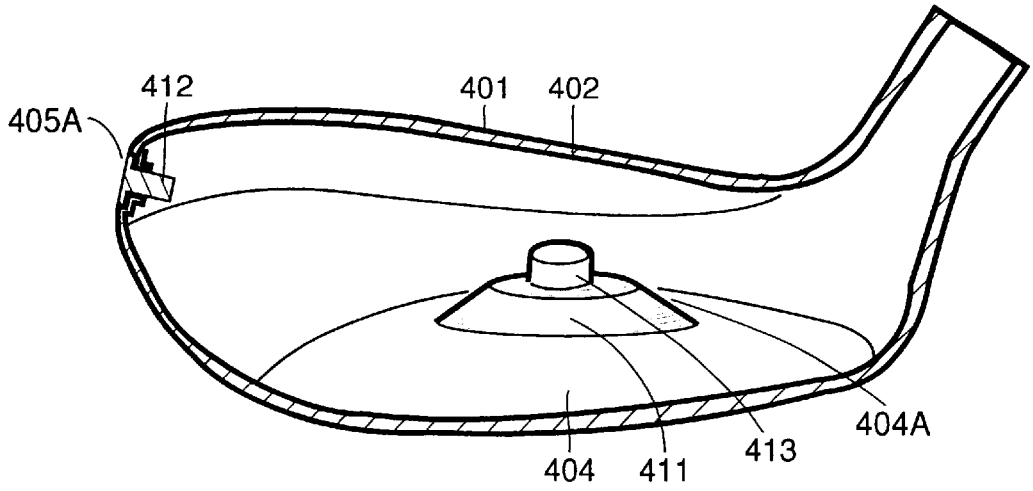

Also, a wood golf club head according to the present invention is a wood golf club head 401 made of metal and having a hollow outer shell structure as shown in FIG. 69, where a weight member 412 having a higher specific gravity than the material constituting the head body 402 is disposed in the upper part 405A of the toe, and the thickness is increased by partially increasing the thickness of the back part 404A of the center of the sole part 404 or by forming a protruding part 411, as shown in FIG. 69. With that part, a weight member 413 having a higher specific gravity than the material constituting the head body 402 is combined. By this, it is constructed in such a manner that the weight distribution will be toe-and-low-back-weight. In FIG. 68, the weight member 412 constitutes the first weight member, and the protruding part 411 constitutes the second weight member. In FIG. 69, the weight member 412 constitutes the first weight member, and the protruding part 411 and the weight member 413 constitute the second weight member.

Here, the thickness of the sole part 404 is preferably at least not smaller than 1 mm and not larger than 10 mm.

Figure 70:
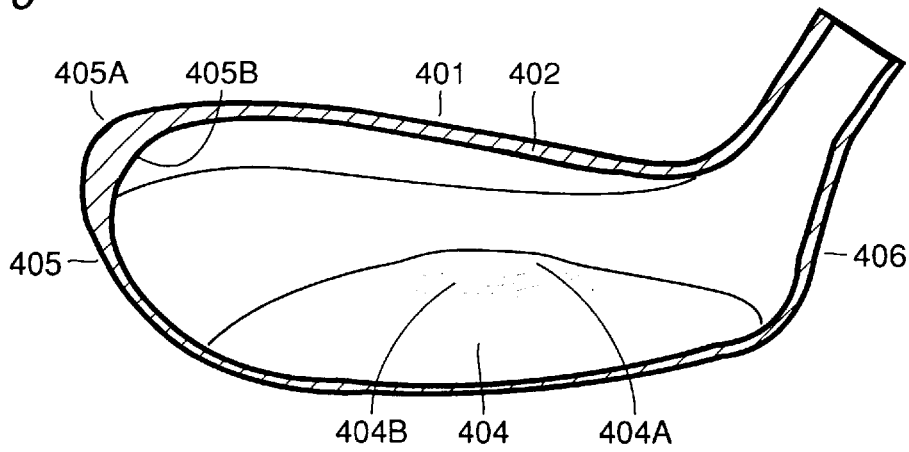

Another example of the present invention will be explained. Referring to FIG. 70, a wood golf club head 401 according to the present invention is a wood golf club head made of metal and having a hollow outer shell structure, in which a thick part 405B is provided by partially increasing the thickness of the upper part 405A of the toe, and a thick part 404B is provided by partially increasing the thickness of the back part 404A of the center of the sole part. By this, it is constructed in such a manner that the weight distribution will be toe-and-low-back-weight. The thick part 405B constitutes the first weight member, and the thick part 404B constitutes the second weight member.

Figure 71:
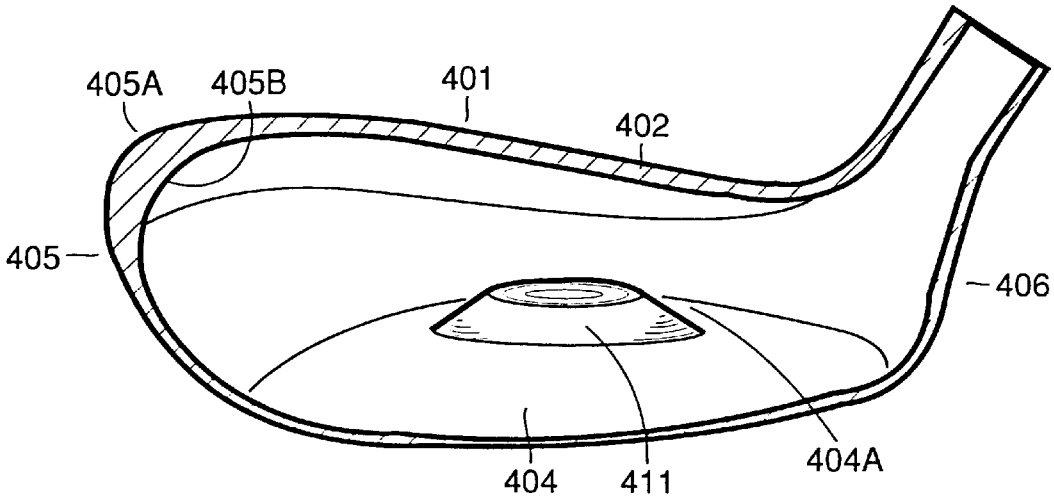

Another example of the present invention will be explained. Referring to FIG. 71, in a wood golf club head; 401 made of metal and having a hollow outer shell structure, a thick art 405B is formed by increasing the thickness of the upper part of the toe, and a protruding part 411 serving as the second weight member is disposed in the back part 404A of the center of the sole part 404. By this, the weight distribution will be toe-and-low-back weight. The thick part 405B constitutes the first weight member, and the protruding part 411 constitutes the second weight member.

Figure 72:
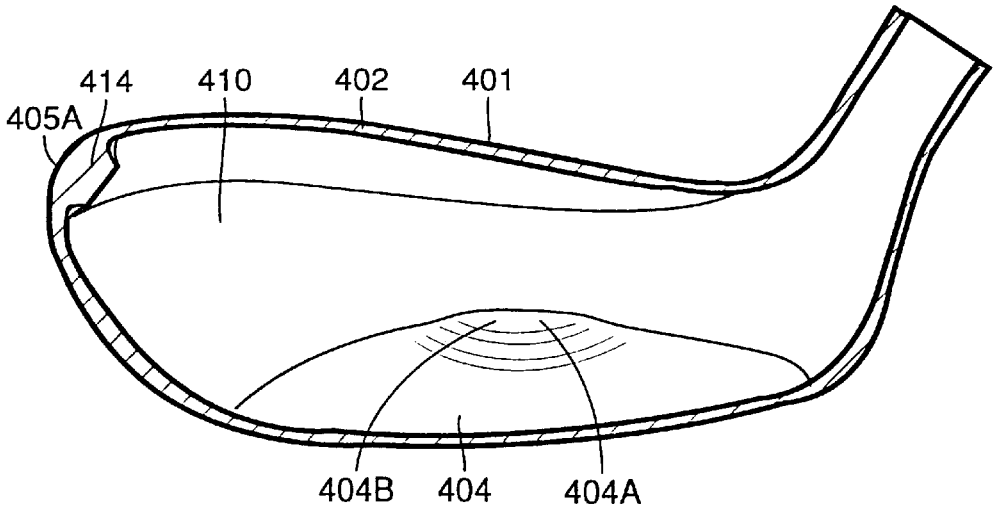

Another example of the present invention will be explained. Referring to FIG. 72, in a wood golf club he'ad 401 made of metal and having a hollow outer shell structure, a protruding part 414 is disposed in the upper part 405A of the toe in the inside 410 of the head body, and a thick part 404B is disposed in the back part 404A of the center of the sole part 404. By this, it is constructed in such a manner that the weight distribution will be toe-and-low-back-weight. The protruding part 414 constitutes the first weight member, and the thick part -404B constitutes the second weight,m ember.

Another example of the present invention will be explained.

Figure 73:
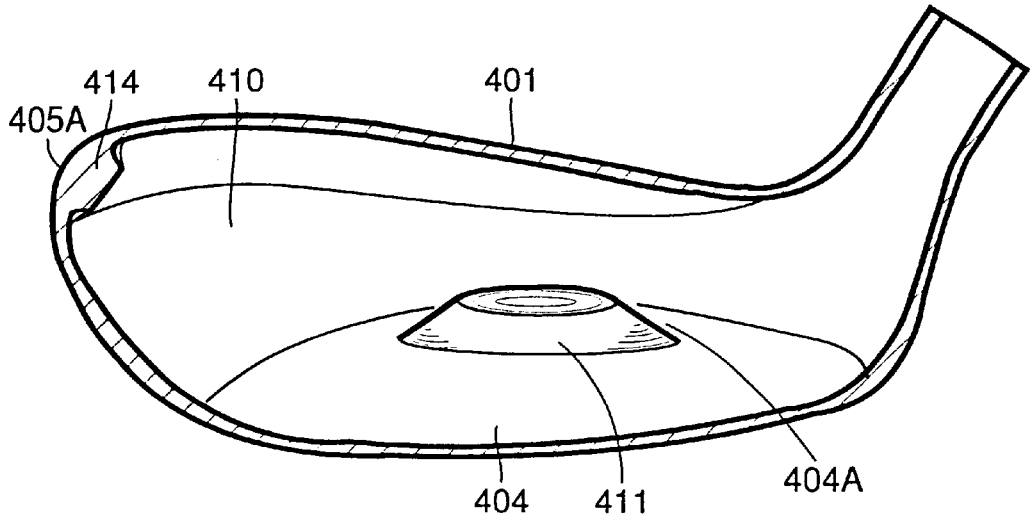

Referring to FIG. 73, in a wood golf club head 401 made of metal and having a hollow outer shell structure, a protruding part 414 is disposed in the upper part 405A of the toe in the inside 410 of the head body, and a protruding part 411 is disposed in the back part 404A of the center of the sole-part 404. By this, it is constructed in such a manner that the weight distribution will be toe-and-low-back-weight. The protruding part 414 constitutes the first weight member, and the protruding part 411 constitutes the second weight member.

Figure 74:
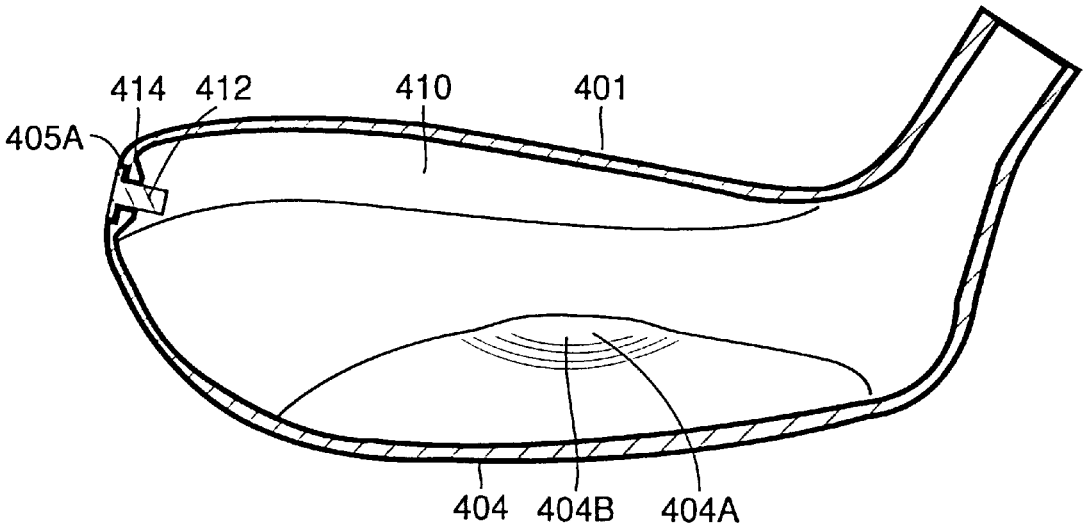

Another example of the present invention will be explained. Referring to FIG. 74, in a wood golf club head 401 made of metal and having a hollow outer shell structure, a protruding part 414 is formed in the upper part 405A of the toe in the inside 410 of the head body, and a weight member 412 having a larger specific gravity than the material constituting the head body 402 is disposed in the protruding part 414. Also, a thick part 404B is disposed in the back part 404A of the center of the sole part 404. By this, it is constructed in such a manner that the weight distribution will be toe-and-low-back-weight. The protruding par 414 and the weight member 412 constitute the first weight member, and the thick part 404B constitutes the second weight member.

Figure 75:
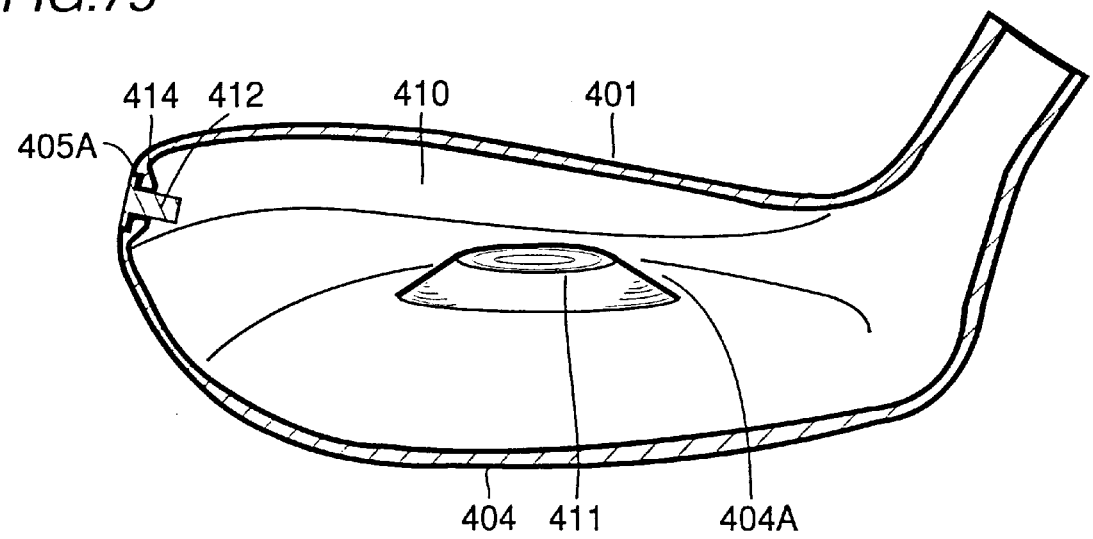

Another example of the present invention will be explained. Referring to FIG. 75, in a wood golf club head 401 made of metal and having a hollow outer shell structure, a protruding part 414 is formed in the upper part 405A of the toe in the inside 410 of the head body, and a weight member 412 having a larger specific gravity than the material constituting the head body is disposed in the protruding part 414. A protruding part 411 is formed in the back part 404A of the center of the sole part 404. By this, it is constructed in such a manner that the weight distribution will be toe-and-low-back-weight. The protruding part 414 and the weight member 412 constitute the first weight member, and the protruding part 411 constitutes the second weight member.

Figure 76:
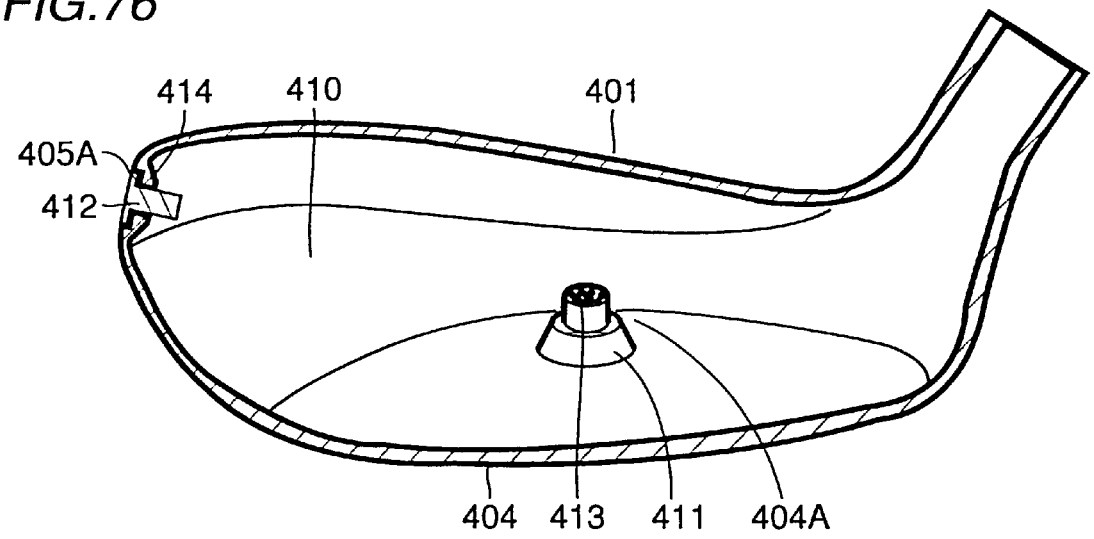

Another example will be explained. Referring to FIG. 76, in a wood golf club head 401 made of metal and having a hollow outer shell structure, a protruding part 414 is formed in the upper part 405A of the toe in the inside 410 of the head body, and a weight member 412 having a larger specific gravity than the material constituting the head body is disposed in the protruding part 414. A protruding part 411 is formed in the back part 404A of the center of the sole part 404, and a weighted member 413 having a larger specific gravity than the material constituting the head body is disposed thereon. By this, the weight distribution will be toe-and-low-back-weight. The protruding part 414 and the weight member 412 constitute the first weight member, and the. protruding part 411 and the weight member 413 constitute the second weight member.

Figure 77:
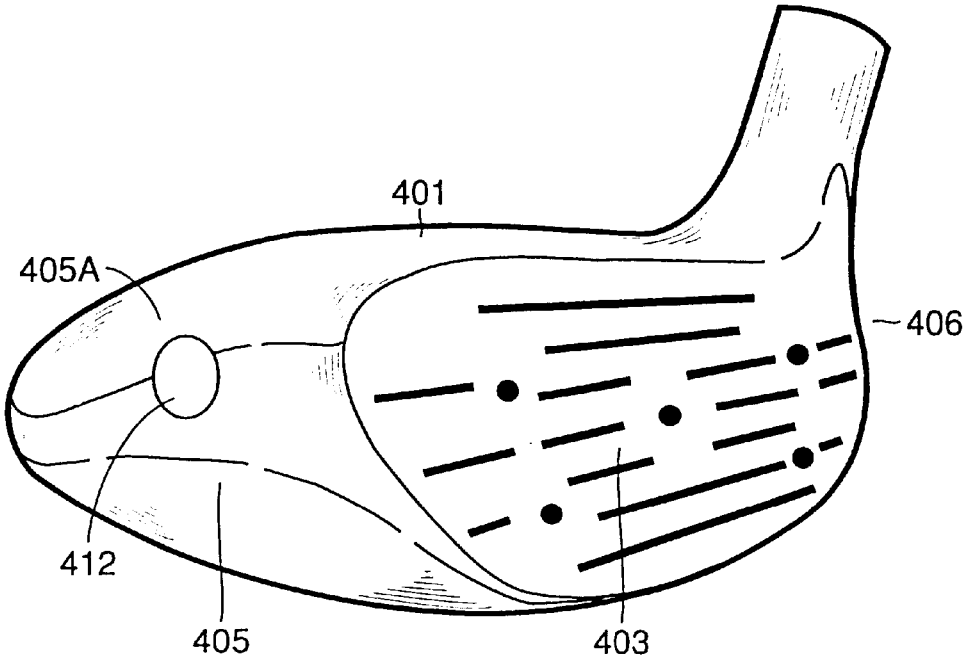
FIGS. 77 and 78 are perspective views showing an Example of a wood golf club head according to the present invention.
Figure 78:
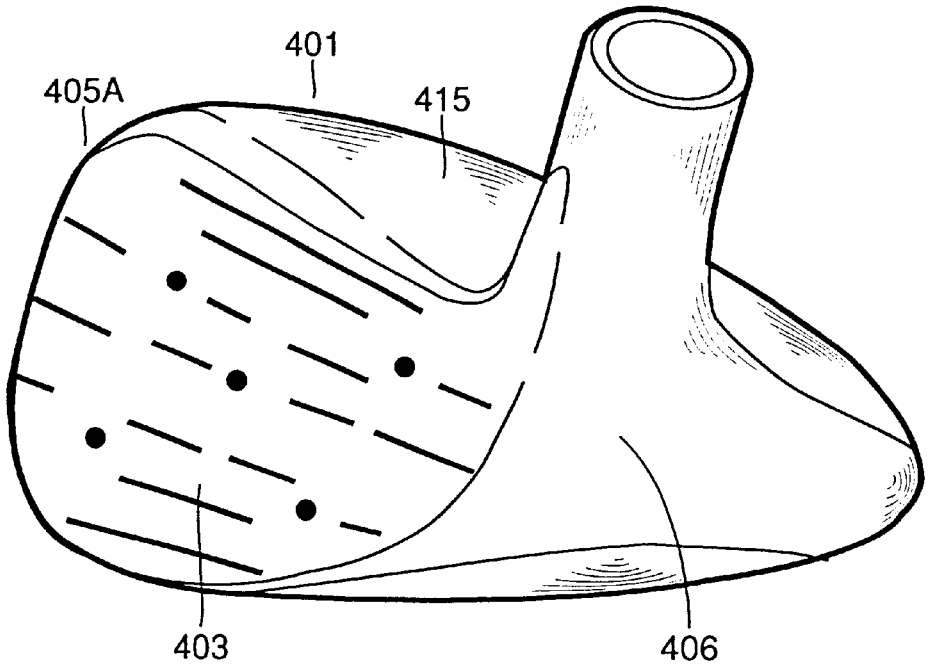
Figure 79:
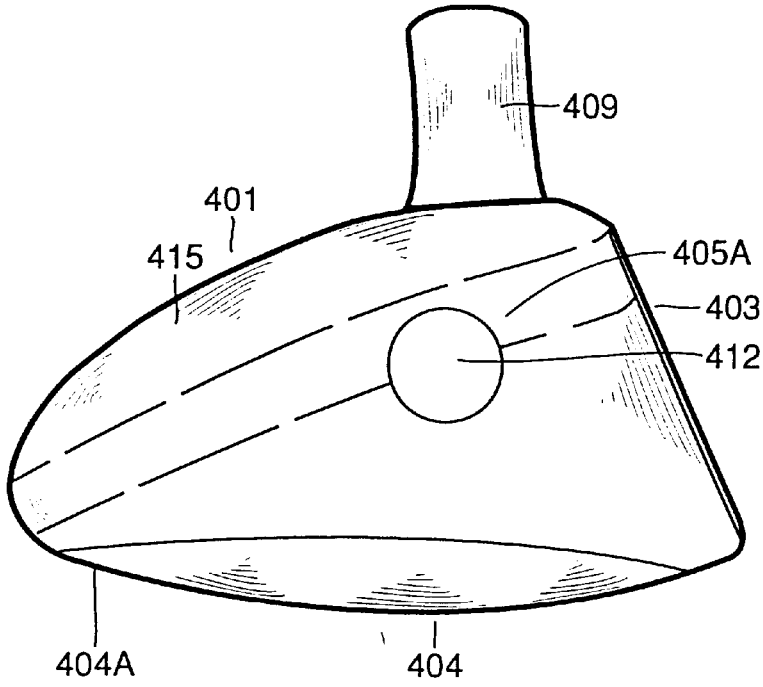
FIG. 79 is a left view showing an Example of a wood golf club head according to the present invention.
Figure 80:
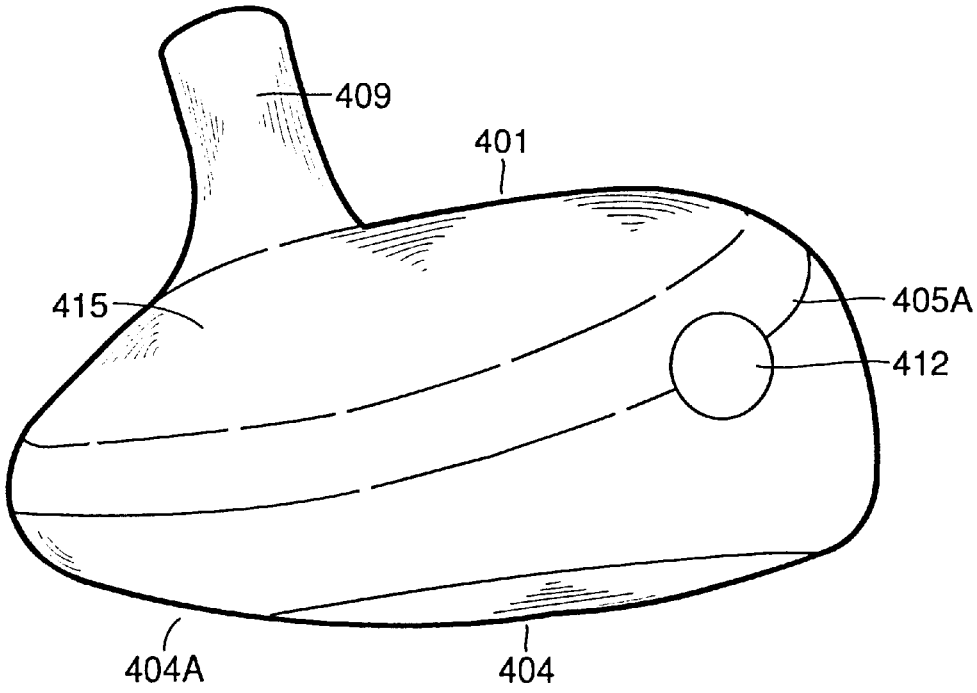
FIG. 80 is a perspective view of a back surface showing an Example of a wood golf club head according to the present invention.

Here, the shape of the wood golf club head of the present invention will be shown in FIGS. 77 to 80. FIG. 77 is a perspective view seen from the toe part; FIG. 78 is a perspective view seen from the heel part; FIG. 79 is a left side view; and FIG. 80 is a perspective view of a back surface seen from the toe part.

Here, in the wood golf club head of the present invention, the material of the head body 402 is, for example, 6-4 titanium, and a tungsten alloy can be used as the material having a larger specific gravity than the head body 402. A tungsten alloy of 8 g is press-fit and fixed into the upper part 405A of the toe and a tungsten alloy of 15 g is press-fit-and fixed into the back part 404A of the center of the sole part Also, the thickness of the upper part 405A of the toe is preferably about 2 mm, and a weight is disposed in the upper part 405A of the toe by allowing the thickness of the upper part 405A of the toe to be larger than the thickness (1.2 mm) of the crown part 415. Further, the thickness of the sole part 404 is set to be about 4 mm.

Here, in the wood golf club head of the present invention, as a mode of the component (weight member) having a larger specific gravity than the head body 402, those having a T-letter shape, a cylindrical shape, a male screw shape, a plate shape, a rectangular shape, a hemispherical shape, a toe part shape of the head body, a sole part shape, a curvature shape approximated to the head body, and other suitable shapes can be selected.

These can be fixed to the inside or the outside of the head body by welding, adhesion, fitting engagement, screwing, caulking, press-fitting, or the like.

Figure 81A:
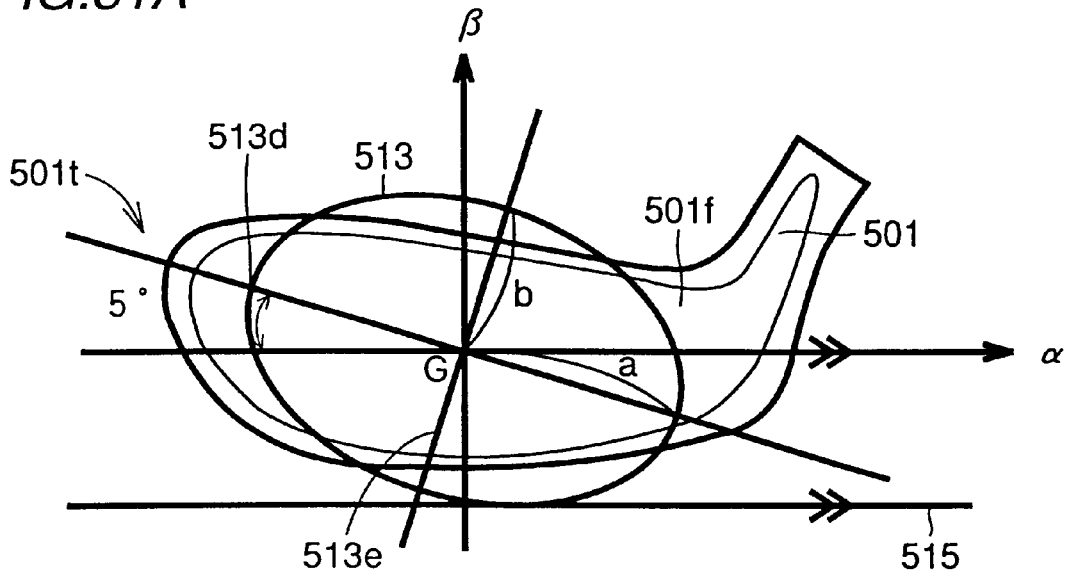
FIGS. 81A and 81B are views showing a ratio of the major axis to the minor axis and an extending direction of the major axis of a plane ellipse appearing when the ellipsoids of a wood golf club head according to the present invention and a conventional wood golf club head are virtually cut with a face surface.
Figure 81B:
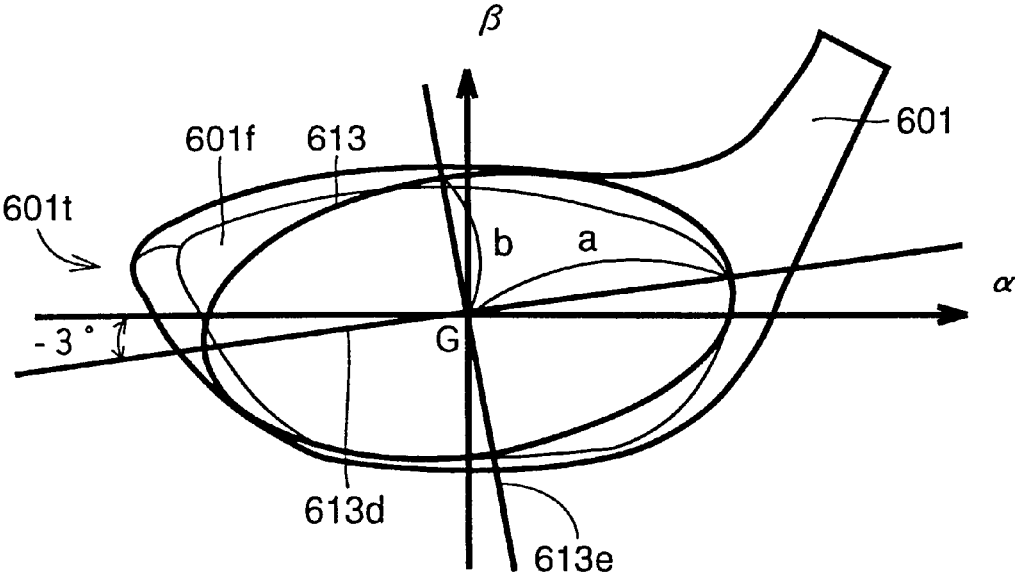

FIGS. 81A and 81B show constructions of third wood golf club heads of the inventive product and the conventional product. In the inventive product shown in FIG. 81A, when the ellipsoid of inertia of the golf club head 501 is cut with a plane passing through the center of gravity and being parallel to the face surface 501*f*, the ratio (aspect ratio: a/b) of the major axis 513*d*, to the minor axis 513*e* of the plane ellipse 513 appearing on the cut surface is 1.4, and the major axis 513*d*, extends upward and away from the ground surface as it approaches the toe part 501*t*. Also, the angle formed by the major axis 513*d*, and the α-axis which is parallel to the intersecting line of the cut surface and the ground surface, is 5°.

On the other hand, in the case of the conventional product shown in FIG. 81B, the ratio (aspect ratio: a/b) of the major axis 613*d*, to the minor axis 613*e* of the plane ellipse appearing when the ellipsoid of inertia of the golf club head 601 is cut with a plane passing through the center of gravity and being parallel to the face surface 601*f*, is 1.5. Also, the major axis 613*d*, extends to approach the ground surface as it approaches the toe part 601*t*, and the angle formed by the major axis 613*d*, and the α-axis was −3°. In other words, in the inventive product, the major axis 513*d*, had a toe-up angle, while in the conventional product, the major axis 613*d*, had a toe-down angle.

As the material of the wood golf club head according to the present invention, iron, stainless steel, aluminum, titanium, magnesium, tungsten, copper, nickel, zirconium, cobalt, manganese, zinc, silicon, tin, chromium, FRP (fiber reinforced plastics), synthetic resin, ceramics, rubber, and others, which are materials generally used in a wood golf club head, may be mentioned. It can be produced from a single material of these or can be produced from a combination of two or more of these materials.

Also, as a production method, if a precision casting method is used, the cost is low and the dimension precision is high. In addition, the head body can be produced by die-casting, pressing, or forging. On the other hand, it is also possible to produce each of the parts by pressing, forging, precision casting, metal injection, die-casting, cut-processing, powder-metallurgy, or the like and bonding these by welding, adhesion, press-fit, fitting engagement, press-contact, screwing, soldering, or the like to fabricate a golf club head.

Figure 82:
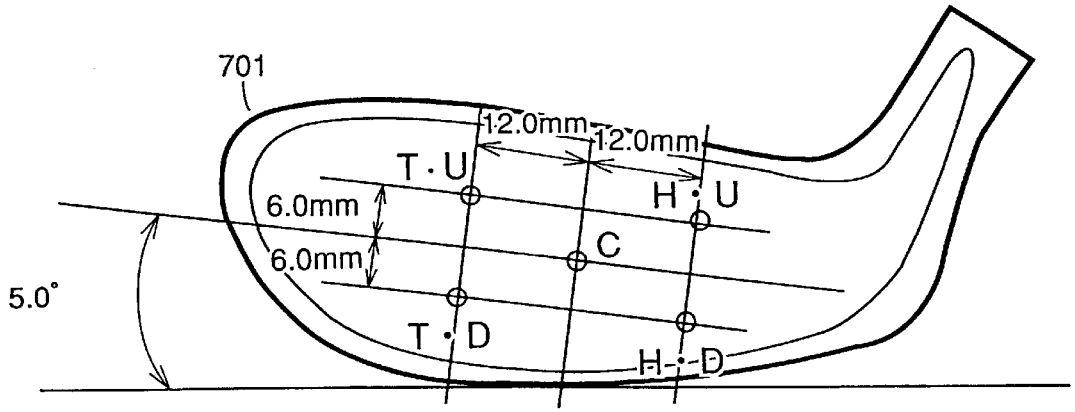
FIG. 82 is a view showing hitting point positions of a wood golf club head.
Figure 83:
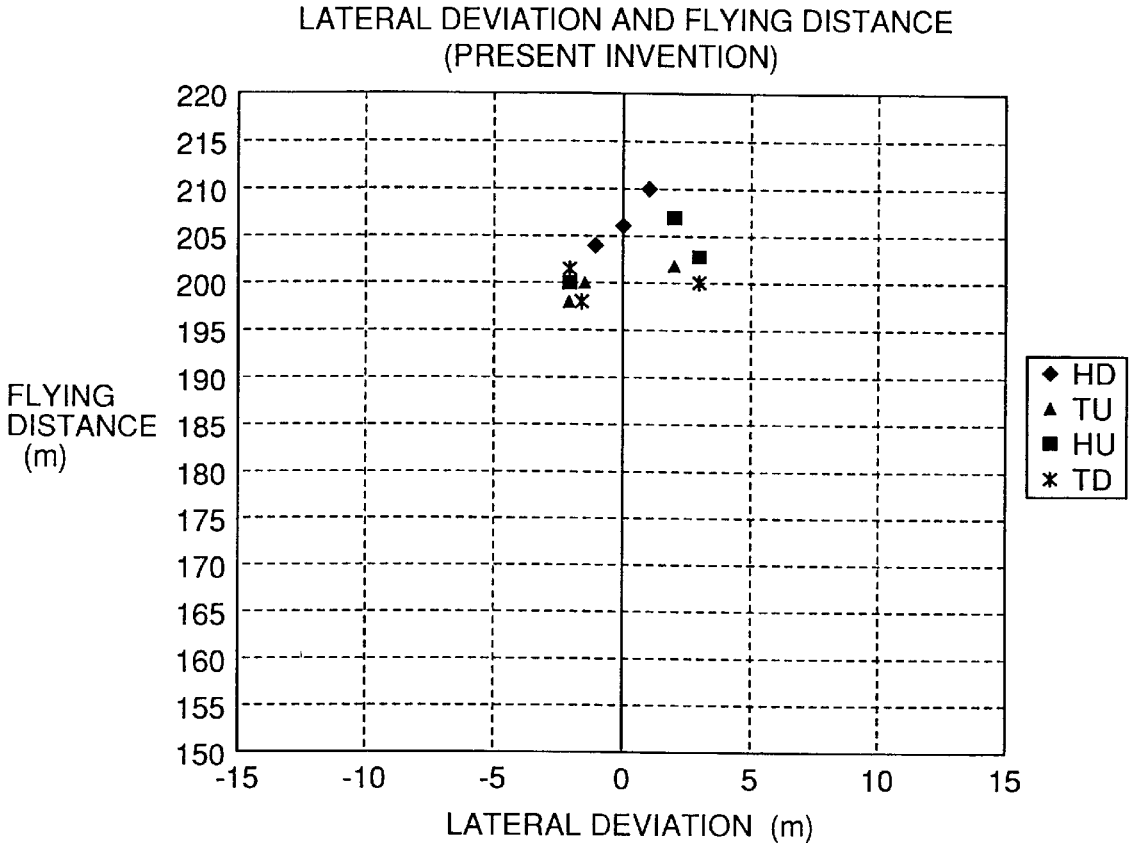
FIG. 83 is a graph showing a flying distance and a variation of a wood golf club head according to the present invention.
Figure 84:
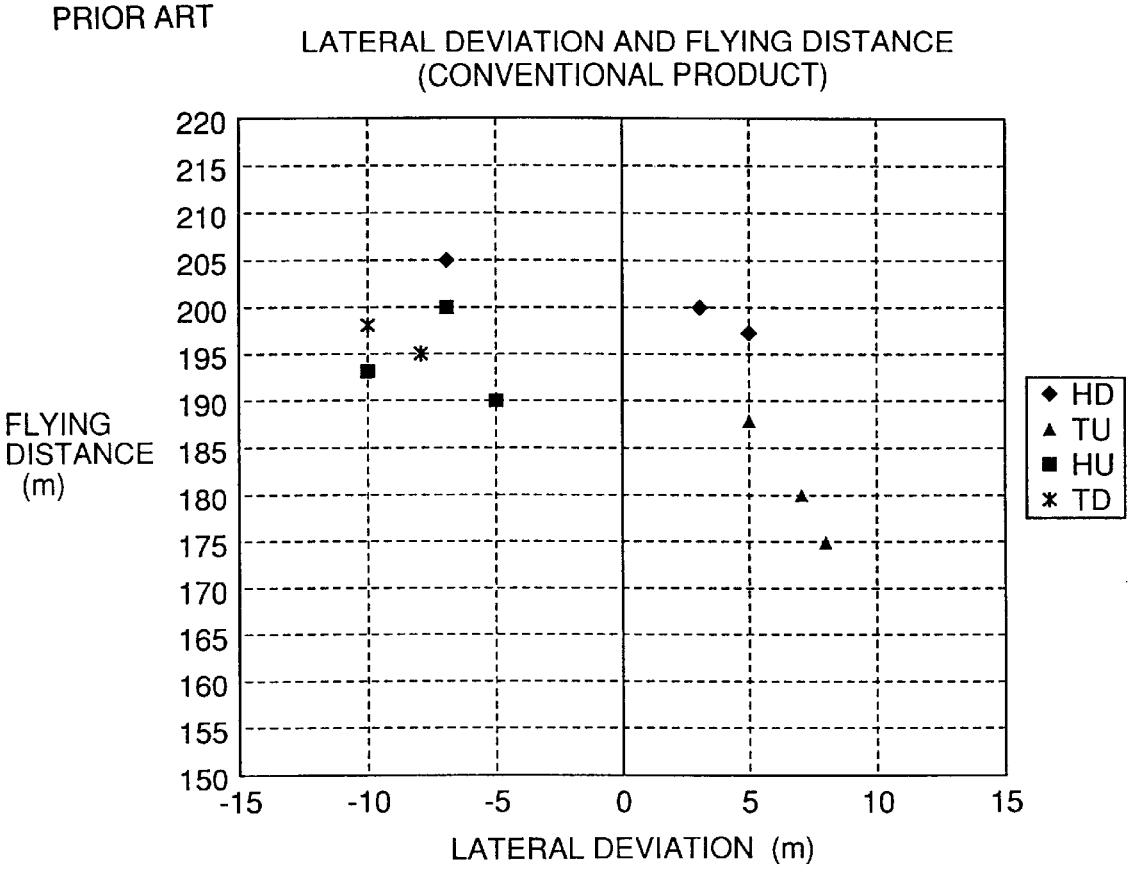
FIG.84 PRIOR ART
FIG. 84 is a graph showing a flying distance and a variation of a conventional wood golf club head.

FIGS. 82 to 84 are views for comparing the variations of the flying distance between the wood golf club head according to the present invention and a conventional wood golf club head. Particularly, FIG. 83 is according to the inventive product, and is a spoon (the third wood golf club head) having a loft angle of 15°, where the plane ellipse appearing when the ellipsoid of inertia is cut is made approximately coincident with the distribution of the hitting points of a general player. On the other hand, FIG. 84 is according to the conventional product.

A test was performed with a golf robot. The speed of the wood golf club head was set to be 40 m/sec and, by taking the variation of the hitting points of the general player into account, the hitting point positions of the wood golf club head were tilted by 5° from the sweet spot to the upper part of the toe to provide upper part of toe (T·U), lower part of toe (T·D), upper part of heel (H·U), and lower part of heel (H·D), as shown in FIG. 82. Each of the points was set at a position located away by 12 mm in the toe-and-heel direction, and by 6 mm in the up-and-down direction. Here, in the wood golf club head shown in FIG. 82, a weight member was disposed in the same manner as in the wood golf club head shown in FIG. 65.

FIG. 83 is a view showing variation of the flying distance by a wood golf club head according to the present invention. FIG. 84 is a view showing variation of the flying distance by a wood golf club head according to a conventional product. The wood golf club heads that were put to use both have the same mass (215 g). From the results of the flying distance measurement test by the robot, with the conventional product in which the shape of the plane ellipse does not conform to the hitting point distribution of a general player, the variation to the right and left by the wood golf club head is about 18 m at the maximum, as shown in FIG. 84. In contrast, with the inventive product in which the plane ellipse conforms to the hitting point distribution of the general player, the variation to the right and left by the wood golf club head is about 5 m, as shown in FIG. 83, thereby reducing the variation by 72%.

On the other hand, with respect to the variation in the flying ball line direction, the variation of the flying distance by the wood golf club head was 12 m at the maximum in the case of the inventive product as shown in FIG. 83, while the variation by the wood golf club head was about 30 m at the maximum in the case of the conventional product as shown in FIG. 84. By this, a reduction of variation by 60% is seen. Further, when the average flying distance is compared, while the average value of the flying distance by the wood golf club was 193 m in the case of the conventional product as shown in FIG. 84, the average value of the flying distance was 205 m in the case of the inventive product as shown in FIG. 83, whereby increase in the flying distance by about 12 m was seen.

Here, FIGS. 83 and 84 show average values when balls were hit each for three times.

Also, when the results of striking on the upper part of the toe are observed, it is well understood that there is a difference in the rotation performance. Namely, in the: case of the conventional wood golf club head, the decrease in the flying distance in the flying ball line direction due to striking on the upper part of the toe is conspicuous, as shown in FIG. 84, and further, the golf balls fall in the right direction as compared with the average lateral deviation. In contrast, in the case of the wood golf club head of the inventive product, the decrease in the flying distance due to striking on the upper part of the toe is small, as shown in FIG. 83, and the lateral deviation is also small. This means that, with the inventive product, the rotation of the head is restrained as compared with the conventional product, and it is understood that the rotation performance of the head is excellent.

As described above, in the wood golf club heads according to the present invention, the rotation of the head itself is restrained, as compared with the conventional wood golf club head, even if the balls are hit at the upper part of the toe at the time of hitting the balls. This produces an effect that a wood golf club head can be provided in which the decrease in the flying distance is small, the lateral deviation is small, and an excellent flying distance can be achieved. Industrial Applicability The present invention is used for golf club heads and golf club sets.

What is claimed is:

1. A golf club set comprising a plurality of golf clubs having different identification numbers, wherein each of said plurality of golf clubs has a golf club head and a shaft connected to said golf club head;

each of sail golf club heads has an ellipsoid of inertia with its center at a center of gravity;

when said ellipsoid of inertia is virtually cut with a plane passing through the center of gravity of said golf club head and being parallel to a face surface, a major axis of a plane ellipse appearing on its cut surface forms an angle of θ with an intersecting line of said cut surface and a ground surface;

the major axis of said plane ellipse extends upward and away from the ground surface as it approaches a toe part;

said angle θ is not smaller than 0.5° and not larger than 9.5°;

an aspect ratio a/b defined by a ratio α length α of the major axis to length b of a minor axis of said plane ellipse is not smaller than 1 and not larger than 4;

said angle θ of each of the plurality of golf club heads increases successively with an approximately constant ratio according as the identification number of said golf club increases; and said aspect ratio a/b of said plurality of golf club heads decreases successively or remains approximately equal according as said identification number increases.

2. The golf club set as set forth in claim 1, wherein said aspect ratio a/b decreases successively with an approximately constant ratio according as the identification number of said golf club increases.

3. A golf club set comprising a plurality of golf clubs having different identification numbers, wherein each of said plurality of golf clubs has a golf club head and a shaft connected to said golf club head;

each of said golf club heads has an ellipsoid of inertia with its center at a center of gravity;

when said ellipsoid of inertia is virtually cut with a plane passing through the center of gravity of said golf club head and being parallel to a face surface, a major axis of a plane ellipse appearing on its cut surface for ms an angle of θ with an intersecting line of said cut surface and a ground surface;

said major axis extends upward and away from the ground surface as it approaches a toe part;

said angle θ is not smaller than 0.5° and not larger than 9.5°;

said angle θ of each of the plurality of golf club heads increases successively with an approximately constant ratio according as the identification number of said golf club increases; and a height h of a sweet spot of each of said plurality of golf club heads decreases successively or remains approximately equal according as said identification number increases.

4. The golf club set as set forth in claim 3, wherein the height h of said sweet spot decreases successively with an approximately constant ratio according as the identification number of said golf club increases.

5. A golf club set comprising a plurality of golf clubs having different identification numbers, wherein each of said plurality of golf clubs has a golf club head and a shaft connected to said golf club head;

each of said golf club heads has an ellipsoid of inertia with its center at a center of gravity;

when said ellipsoid of inertia is virtually cut with a plane passing through the center of gravity of said golf club head and being parallel to a face surface, an aspect ratio a/b defined by a ratio of a length a of the major axis to a length b of a minor axis of a plane ellipse appearing on its cut surface is not smaller than 1 and not larger than 4;

a height h of a sweet spot from a ground surface is not smaller than 10 mm and not larger than 30 mm;

said aspect ratio a/b of each of said plurality of golf club heads decreases successively with an approximately constant ratio according as the identification number of said golf club increases; and the height h of the sweet spot of each of said plurality of golf club heads decreases successively or remains approximately equal according as said identification number increases.

6. The golf club set as set forth in claim 5, wherein the height h of said sweet spot decreases successively with an approximately constant ratio according as the identification number of said golf club increases.

7. A golf club set comprising a plurality of golf clubs having different identification numbers, wherein each of said plurality of golf clubs has a golf club head and a shaft connected to said golf club head;

each of said golf club heads has an ellipsoid of inertia with its center at a center of gravity;

when said ellipsoid of inertia is virtually cut with a plane passing through the center of gravity of said golf club head and being parallel to a face surface, an aspect ratio a/b defined by ratio of a length a of the major axis to a length b of a minor axis of a plane ellipse appearing on its cut surface is not smaller than 1 and not larger than 4;

a height h of a sweet spot from a ground surface is not smaller than 10 mm and not larger than 30 mm;

said aspect ratio a/b of each of said plurality of golf club heads decreases successively or remains approximately equal according as said identification number increases;

the height h of the sweet spot of each of said plurality of golf club heads decreases successively or remains approximately equal according as said identification number increases;

said major axis forms an angle of θ with an intersecting line of said cut surface and a ground surface;

said major axis extends upward and away from the ground surface as it approaches a toe part;

said angle θ is not smaller than 0.5° and not larger than 9.5°; and said angle θ of each of said plurality of golf club heads increases successively with an approximately constant ratio according as the identification number of said golf club increases.

8. A golf club set comprising a plurality of iron golf clubs having different identification numbers wherein, each iron golf club has a head body having a toe, a sole, and a heel;

wherein each iron golf club has a first weight member disposed in an upper part of the toe of said head body; and wherein each iron golf club has a second weight member disposed in a heel side part of the sole of said head body, wherein each of the iron golf club heads have an ellipsoid of inertia with its center at a center of gravity, wherein when said ellipsoid of inertia is virtually cut with a plane passing through the center of gravity of said head body and being parallel to a face surface, a major axis of a plane ellipse appearing on its cut surface forms an angle of θ with an intersecting line of said cut surface and a ground surface, and wherein said angle θ increases successively with an approximately constant ratio according as the identification number of said golf club increases.

9. The golf club set as set forth in claim 8, wherein said first weight member has a larger specific gravity than a material constituting said head body.

10. The golf club set as set forth in claim 8, wherein said second weight member has a larger specific gravity than in material constituting said head body.

11. The golf club set as set forth in claim 8, wherein said first weight member has a larger density than other parts of said head body.

12. The golf club set as set forth in claim 11, wherein a depth of said back cavity increases according as it approaches from a lower part of the toe to a heel pan.

13. The golf club set as set forth in claim 8, wherein said second weight member has a larger density than other parts of said head body.

14. The golf club set as set forth in claim 8, wherein said head body has a back cavity.

15. The golf club set as set forth in claim 8, wherein a width of a sole part decreases according as it approaches from a lower part of the toe to a heel part.

16. The golf club set as set forth in claim 8, wherein said head body has a through-hole, and further comprising an insert member fitted into said through-hole so as to form a back cavity.

17. A golf club set comprising a plurality of golf clubs having an identification number a club head, and an ellipsoid of inertia with its center at a center of gravity, wherein when said ellipsoid of inertia of each of said plurality of golf clubs is virtually cut with a plane passing through the center of gravity of said golf club head and being parallel to a face surface, a major axis of a plane ellipse appearing on its cut surface forms an angle of θ with an intersecting line of said cut surface and a ground surface;

the major axis of said plane ellipse extends upward and away from the ground surface as it approaches a toe panrt; and an aspect ratio a/b defined by a ratio of a length a of the major axis to a length b of a minor axis of said plane ellipse decreases successively with an approximately constant ratio according as said identification number of said golf club increases.

18. The golf club set as set forth in claim 17, wherein a height h of a sweet spot from the ground surface is not smaller than 10 mm and not larger than 30 mm.

19. The golf club set as set forth in claim 17, wherein a height h of a sweet spot of said golf club head decreases successively or remains approximately equal according as said identification number of said golf club increases.

20. The golf club set as set forth in claim 17, wherein said angle θ increases successively with an approximately constant ratio according as the identification number of said golf club increases.

21. The golf club set as set forth in claim 17, wherein a height h of a sweet spot decreases successively with an approximately constant ratio according as the identification number of said golf club increases.

22. The golf club set as set forth in claim 17, each of said golf clubs further comprise:

a head body having a toe, a sole, and a heel;

a first weight member disposed in an upper part of the toe of said head body; and a second weight member disposed in a heel side part of the sole of said head body.

23. The golf club set as set forth in claim 22, wherein said first weight member has a larger specific gravity than a material constituting said head body.

24. The golf club set as set forth in claim 22, wherein said second weight member has a larger specific gravity than a material constituting said head body.

25. The golf club set as set forth in claim 22, wherein said first weight member has a larger density than other parts of said head body.

26. A golf club set comprising a plurality of golf clubs having different identification numbers, wherein each of said plurality of golf clubs has a golf club head;

each of said golf club heads has an ellipsoid of inertia;

wherein said ellipsoid of inertia is virtually cut with a plane passing through the center of gravity of said golf club head and being parallel to a face surface, a major axis of a plane ellipse appearing on its cut surface forms an angle of θ with an intersecting line of said cut surface and a ground surface; and said angle θ increases successively with an approximately constant ratio according as the identification number of said golf club increases.

27. The golf club set as set forth in claim 26, wherein said angle θ is not smaller than 0.5° and not larger than 9.5°.

28. The golf club set as set forth in claim 26, wherein a height h of a sweet spot from the ground surface of said golf club head is not smaller than 10 mm and not larger than 30 mm.

29. The golf club set as set forth in claim 26, wherein a height h of a sweet spot from the ground surface of said golf club head decreases successively or remains approximately equal according as said identification number of said golf club increases.

30. A golf club set comprising a plurality of golf clubs having different identification numbers, wherein each of said plurality of golf clubs has a golf club head;

each of said golf club heads has an ellipsoid of inertia;

wherein said ellipsoid of inertia is visually cut with a plane passing through the center of gravity of said golf club head and being parallel to a face surface, an aspect ratio a/b defined by a ratio of a length a of the major axis to a length b of a minor axis of a plane ellipse appearing on its cut surface; and wherein said aspect ratio a/b decreases successively with an approximately constant ratio according as the identification number of said golf club increases.

31. The golf club set as set forth in claim 30, wherein said aspect ratio is not smaller than 1 and not larger than 4.

32. The golf club set as set forth in claim 30, wherein a height h of a sweet spot from the ground surface of said golf club head is not smaller than 10 mm and not larger than 30 mm.

33. The golf club set as set forth in claim 30, wherein a height h of a sweet spot from the ground surface of said golf club head decreases successively or remains approximately equal according as said identification number of said golf club increases.

* * * * *